US006592185B2

(12) United States Patent
Lew

(10) Patent No.: US 6,592,185 B2
(45) Date of Patent: Jul. 15, 2003

(54) SEATING DEVICE FOR MANEUVERING A BODY PART

(75) Inventor: Richard Lew, New York, NY (US)

(73) Assignee: Richard Lew INC, New York, NY (US)

( * ) Notice: Subject to any disclaimer, the term of this patent is extended or adjusted under 35 U.S.C. 154(b) by 0 days.

(21) Appl. No.: 10/072,304

(22) Filed: Feb. 7, 2002

(65) Prior Publication Data

US 2002/0140268 A1 Oct. 3, 2002

Related U.S. Application Data

(60) Provisional application No. 60/276,315, filed on Mar. 16, 2001.

(51) Int. Cl.[7] ..... A47C 1/02

(52) U.S. Cl. ..... 297/330; 297/344.17; 297/217.3; 297/411.38; 297/423.35; 297/408; 297/340; 297/362.11

(58) Field of Search ..... 297/362.11, 330, 297/423.35, 411.38, 408, 423.11, 284.1, 284.4, 217.3, 217.1, 411.35, 339, 340, 344.17

(56) References Cited

U.S. PATENT DOCUMENTS

| | | | | |
|---|---|---|---|---|
| 4,114,274 A | | 9/1978 | Jones | 32/22 |
| 4,479,678 A | | 10/1984 | Sharp | 297/71 |
| 4,515,406 A | | 5/1985 | Fujiyama et al. | 297/409 |
| 4,577,358 A | | 3/1986 | Glass | 5/455 |
| 4,966,413 A | | 10/1990 | Palarski | 297/330 |
| 5,098,158 A | | 3/1992 | Palarski | 297/330 |
| 5,150,482 A | | 9/1992 | Shapiro | 4/562.1 |
| 5,158,074 A | | 10/1992 | Grellas | 128/25 |
| 5,249,838 A | | 10/1993 | Kulpa et al. | 297/328 |
| 5,313,961 A | | 5/1994 | McKee | 128/897 |
| 5,348,375 A | * | 9/1994 | Steininger | |
| 5,582,464 A | * | 12/1996 | Maymon | |
| 5,624,159 A | | 4/1997 | Celoni et al. | 297/325 |
| 5,733,012 A | | 3/1998 | Jones | 297/452.17 |
| 5,971,485 A | * | 10/1999 | Clark | |
| 5,984,411 A | * | 11/1999 | Galumbeck | |
| 6,106,065 A | | 8/2000 | Carroll | 297/330 |
| 6,158,808 A | * | 12/2000 | Margolis et al. | |

* cited by examiner

*Primary Examiner*—Milton Nelson, Jr.
(74) *Attorney, Agent, or Firm*—Rashida A. Karma

(57) ABSTRACT

A seating device for maneuvering a body part comprising a fully adjustable chair including a base assembly, an occupant supporting assembly and an elevator assembly including drive mechanisms for raising, lowering and tilting the occupant supporting assembly. The chair has a head rest, leg rest, chest rest and a plurality of arm rests. The chair has full adjustment in all axes: rotation around a vertical central axis; vertical height adjustment; fully adjustable seat back for proper lumbar support; and tilt of the seat. The base assembly includes a power unit biased toward the floor. The chair permits support of the occupant with a full range of adjustment so that the occupant can have proper positioning for selected medical procedures and body part positions.

11 Claims, 60 Drawing Sheets

ERGOEZ (Prototype #1)

Part #2
4 req

Mat. Nylon

Part # 3

Part #4

Material Steel

Part # 6

Wheel Linkage
4 req top view

Part # 9 wheel linkage
mat alum
1 req

Part # 9 a

Material alum 1 req

Part # 13

3/4" Dia with .380" hole
washer wheel linkage 4 req

Part # 17

Side View

Part # 19

Part # 25 hole detail

Part # 25 a hole detail

Part # 32 arm rest
cylinder pin
mat steel 2 req

Part # 34 leg rest
mat alum
2 req top view side view

Part # 35

Part # 39

Part # 40

Part # 42 foot rest
bearing block

Part # 43 mat alum
1 req side view top view

Drill thru 8.5mm + counter
bore for striper bolt-tap
10x1.5

Part # 44

Part # 46

Part # 48 rest column
slide brackets
2 req
mat alum

Part # 49 rest column
bearing block mat alum
1 req top view side view

Part # 50 back strap

Part # 51 column compensator
cylinder mount bracket
1 req
mat alum top view

Part # 54 side view 3 stage column
bottom bracket mat alum
1 req top view

Part # 55

Part # 56 sway bar spacer
mat alum
2 req 12 mm thru

Part # 57 sway bar pin
mat alum
1 req

Part # 58 sway bar mat alum
2 req

Part # 59 sway bar bushing
mat nylon
2 req

Part # 60 side view top view

Part # 61 sway bar mount top view side view

Part # 63

Part # 66

Part # 67 head rest hinge
mat alum
2 req head rest hinge
mat alum
2 req

Part # 68

Part # 68
side view

SEATING DEVICE FOR MANEUVERING A BODY PART

This application claims the benefit of U.S. Provisional Application No. 60/276,315 filed Mar. 16, 2001.

FIELD OF THE INVENTION

The present invention generally relates to an adaptive power-operated instrument assembly and/or treatment chair device comprising of and characterized by structural elements being selectively, individually or simultaneously movable to desired positions for patient treatment or placement of an individual at proper elevations and/or angles.

BACKGROUND OF THE INVENTION

Various arrangements for dental, ophthalmological, medical, cosmetic or other treatment or adaptive power-operated chairs have heretofore been provided. Such chairs have been constructed to enable the proper positioning of a patient or individual undergoing treatment or procedures that require control of movements and position adaptations.

Many injuries to joints result in long term disuse of the joint and result in joint stiffness and possible muscular atrophy. For example, patients with arthritis or chronic back pain need to have power-assisted movement of joints and musculature. Baseball and football players with rotator cuff injuries need power-assisted exercise of musculature in order to rebuild their muscles for functional use. Current state of the art devices for both passive and active resistive therapies for a variety of surgical and chronic diseases pose problems in proper utilization for specific therapy requirements because proper patient positioning with respect to the machine is important, if not critical. Because both the height, size and nature of the chair used by the operator, and the size and mobility of the patient, generally vary over a wide range, patient positioning problems become significant.

Accordingly, there is need in the art for an improved power-operated positioning system which properly positions the patient in the correct position. This state of the art system should be adjustable along all axes to provide for a full range of active and passive movements. And, this system should be suitable for use in a wide variety of surgical, chronic and other applications. The present invention was conceived and reduced to practice by the inventor, largely as a result of the inventor's own needs. As a sufferer of chronic back pain, the patient and inventor was subjected to a wide variety of systems when undergoing therapy involving spinal injections. Out of the necessity to reduce pain and improve the positioning and delivery of the medication, was born the present invention. The present invention provides an improved system for correctly positioning an individual and, is both adaptive to specific therapy requirements. The system is controlled by the operator or specialist, and is not subject to inadvertent patient change leading to improper positioning.

SUMMARY OF THE INVENTION

It is the object of this invention to provide power-operated instrument assemblies and treatment chair devices which overcome problems presented by prior instruments and devices described in the art, and are characterized by being selectively individually or simultaneously movable to desired positions for patient treatment.

By this invention, it has been found that the above object may be accomplished by providing such apparatus, generally as follows.

A treatment chair includes an occupant supporting assembly, a base assembly, a central control elevator assembly connected to and between the occupant supporting assembly and the base assembly for raising and lowering the occupant supporting assembly. A second control means is connected with the treatment chair elevator assembly for operating the same.

An IDEK control means is provided which includes a plurality of DC actuators, the IDEK control unit being attached to the second control means, having a power supply transformer, and connected to a main power supply.

The IDEK control means is attached to a touch screen control, said control being placed in a suitable position for an operator to access and use.

Control means are connected with the chair elevator assembly and the second control means for selectively operating both the control means for simultaneously raising or lowering of the treatment chair, thereby suitably positioning the occupant supporting assembly, and the chest assembly and the head assembly. The control means may be operated independently of each each other, for example, the control means may independently raise or lower the treatment chair, while the supporting assembly can be moved independently of the control elevator assembly.

Preferably, the elevator assembly of the treatment chair device includes a plurality of pivotally mounted actuators in which one of the actuators has one end thereof pivotally connected to the base, and the other end thereof pivotally connected to the elevator assembly, for providing easy independent movement of the rest column, the chest rest and/or the arm rest, to the desired positions for the patient.

Also, the treatment chair supporting base assembly preferably comprises a first stationary metal base support, and a second portion comprising of rubber for supporting the housing unit on a floor or other surface.

In accordance with a preferred form of device according to this invention, an IDEK control means, in addition to the chair assembly described above, is provided. Such control means is connected to the treatment chair and the elevator assembly for the desired positioning adjacent thereto and includes a plurality of DC actuators, relays, actuators, breakers and power supply transformers and the like. The IDEK control unit is connected with a touch screen control for use by the specialist or the chair operator.

In accordance with this invention, the touch screen control device includes a plurality of switches adapted to effect power operated movement in different positions, for example, in the sleep or bed mode, in the sitting mode, in the auto mode, in the rotating mode, in the spine compressing mode or in the traction mode.

In accordance with this invention, it is preferred that the above described control means, comprise a plurality of actuators which are electrically operable, and include reversible motors for being selectively operated in either forward or reverse directions. The plurality of actuators are positioned suitably and controlled by a control means for effecting raising and lowering operations of the respective elevator assemblies of the treatment chair, the seat, arm rests, chest rest, rest column, leg rest and foot rest.

The control means preferably comprises a source of electrical energy, a power and relay control for alternating polarity, an electric circuit connected between the source of electric energy and each of the reversible motors and actuators. The control means comprises suitably operated switches in the circuit for simultaneously completing the electric circuit to each of the reversible actuators. The operator uses the switches on the touch screen to bring about the simultaneous operation of the whole chair in the desired direction, for effecting simultaneous raising or lowering operations in the treatment chair.

In a preferred embodiment of this invention, an auxiliary unit includes a portable micro camera assembled on a surgical instrument to enable exploratory surgery of difficult to reach parts. In yet another embodiment this invention includes a television screen projecting the instantly taken pictures by the camera. In another embodiment this invention uses various additional available technologies, for example, the burst recognition technology, fluorescence and even gravity independent forces, to achieve an even greater accuracy in positioning of an individual.

BRIEF DESCRIPTION OF THE DRAWINGS

Some of the objects and advantages of the invention having been stated, other objects and advantages will appear when taken in conjunction with the accompanying drawings in which.

Figure 4:
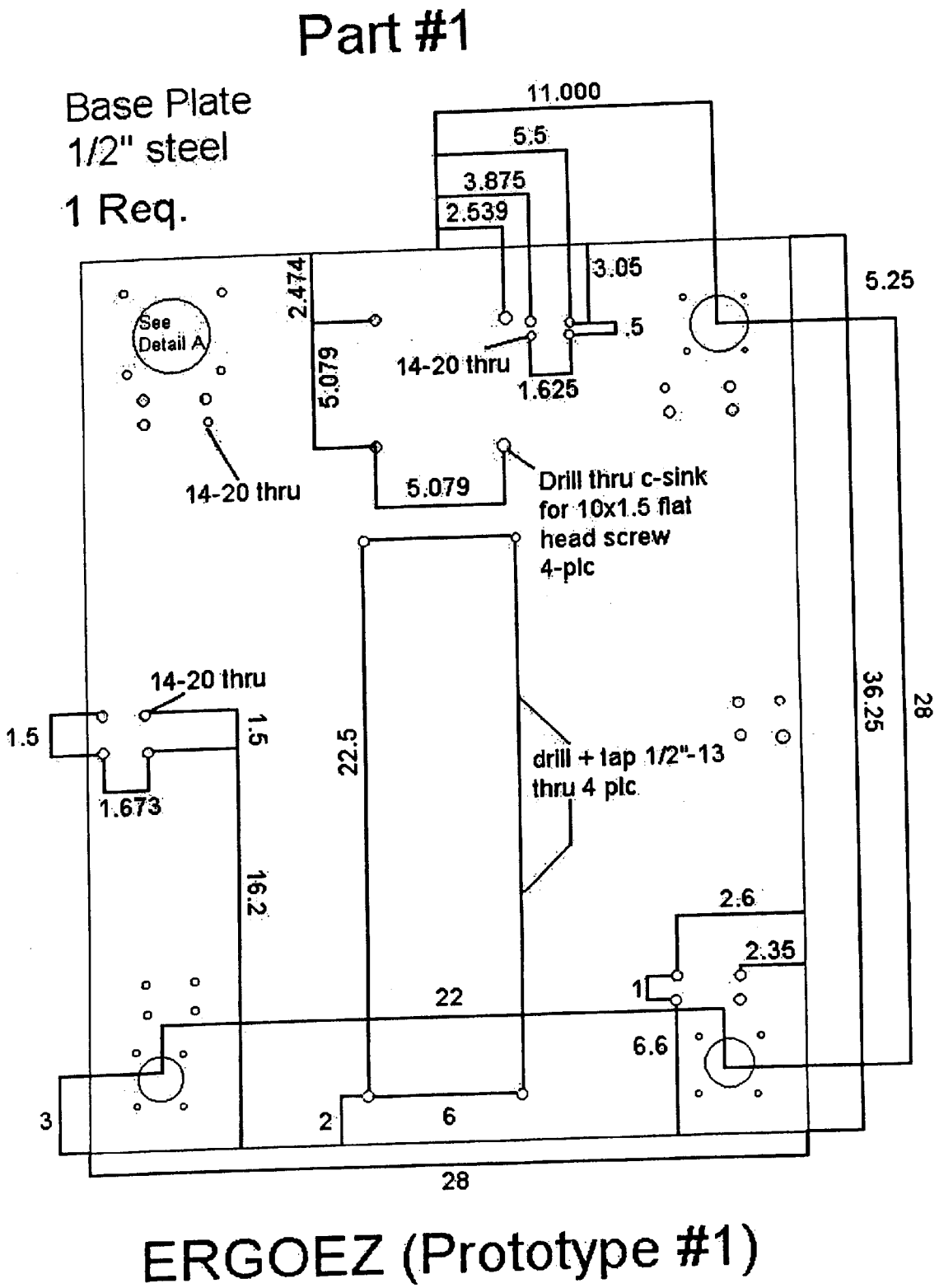

The overall construction of one embodiment of a treatment chair was divided into several parts (sixty-nine parts) and each part was designed individually so as to enable one with ordinary skill in the art to assemble the parts into the whole assembly, as described in the following figures which represent the structural plans for one embodiment of the invention in which:

FIG. 4 represents the plans for the construction of Part 1 representing the Base Plate.

Figure 5:
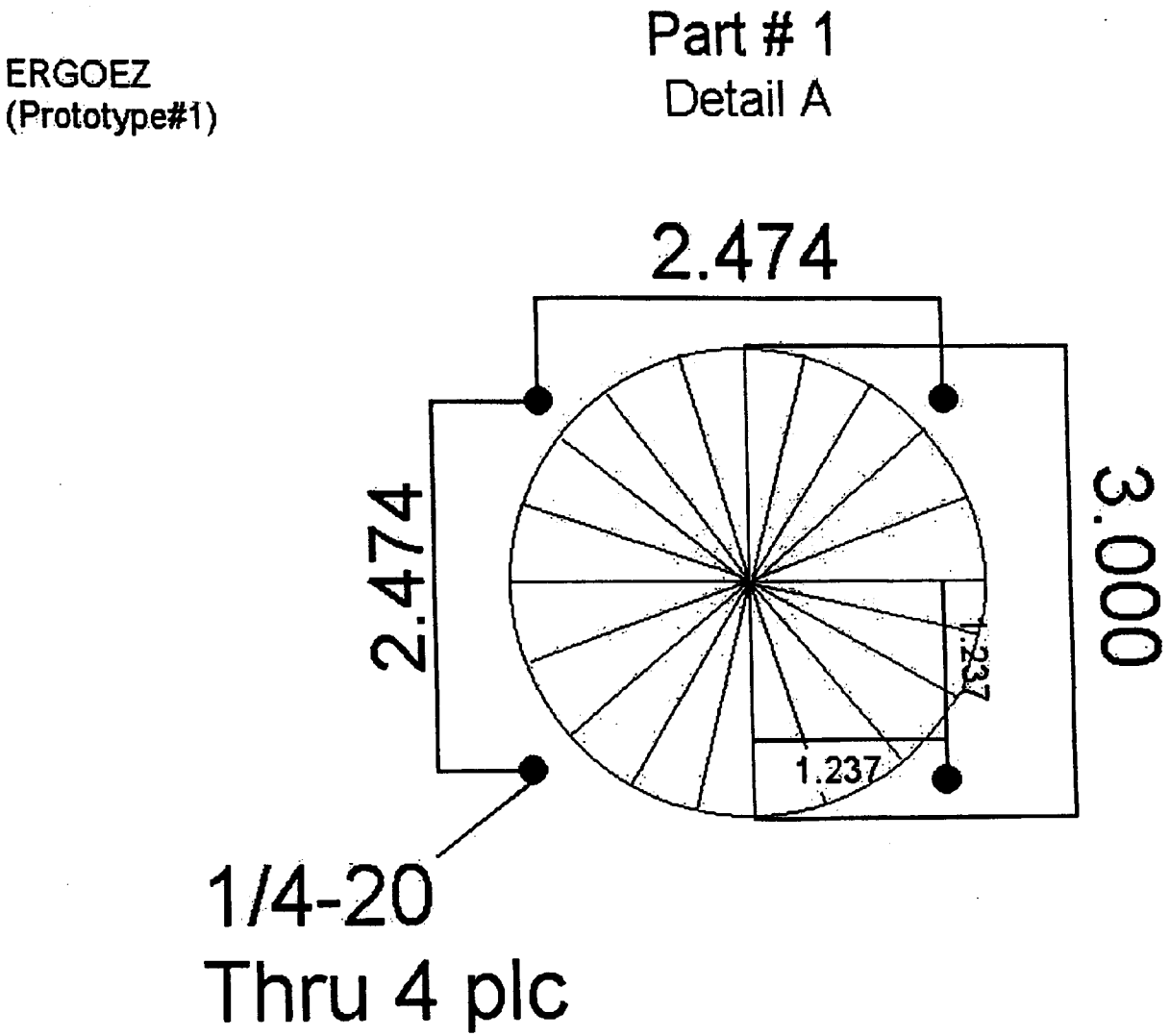

FIG. 5 describes the Detail A for the base plate construction referred to as Part 1.

Figure 6:
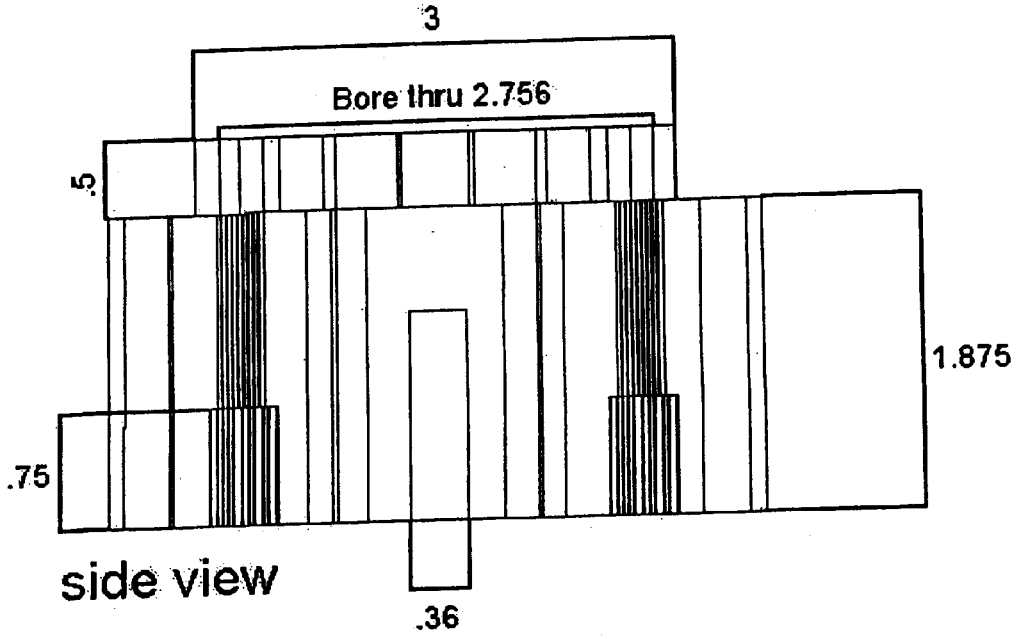
Figure 6:
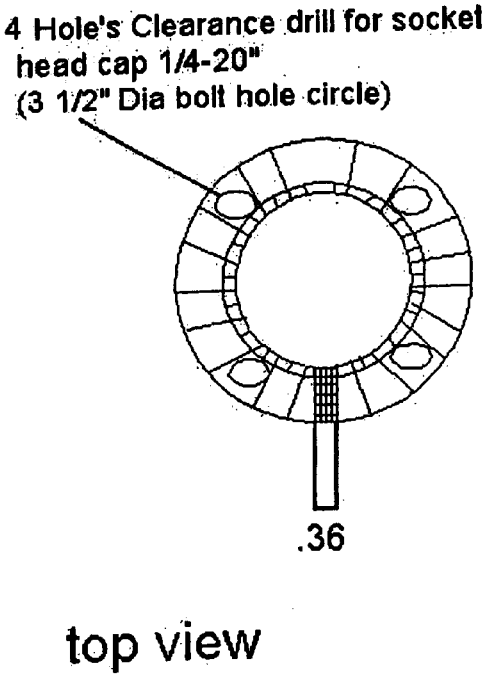

FIG. 6 describes the side view and top view of the housing of the wheel. (Part 2).

Figure 7:
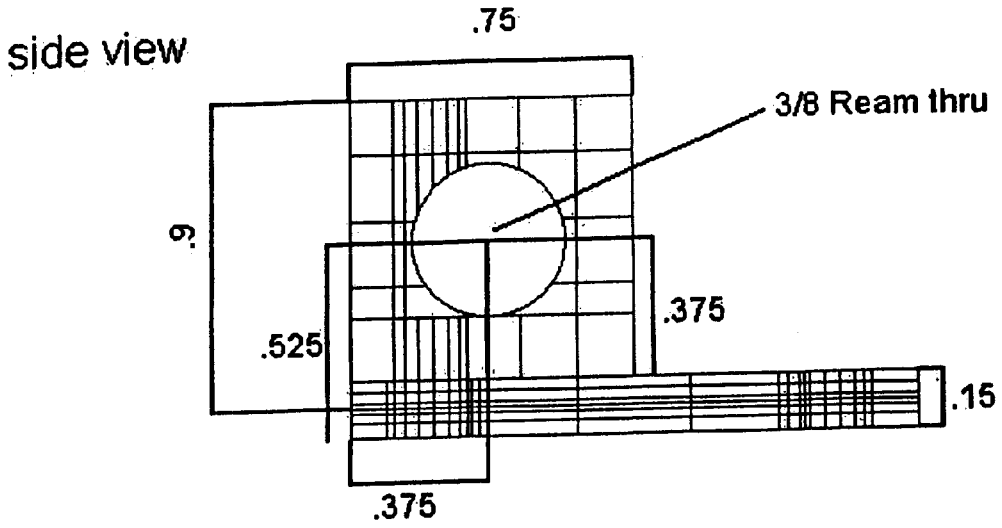
Figure 7:
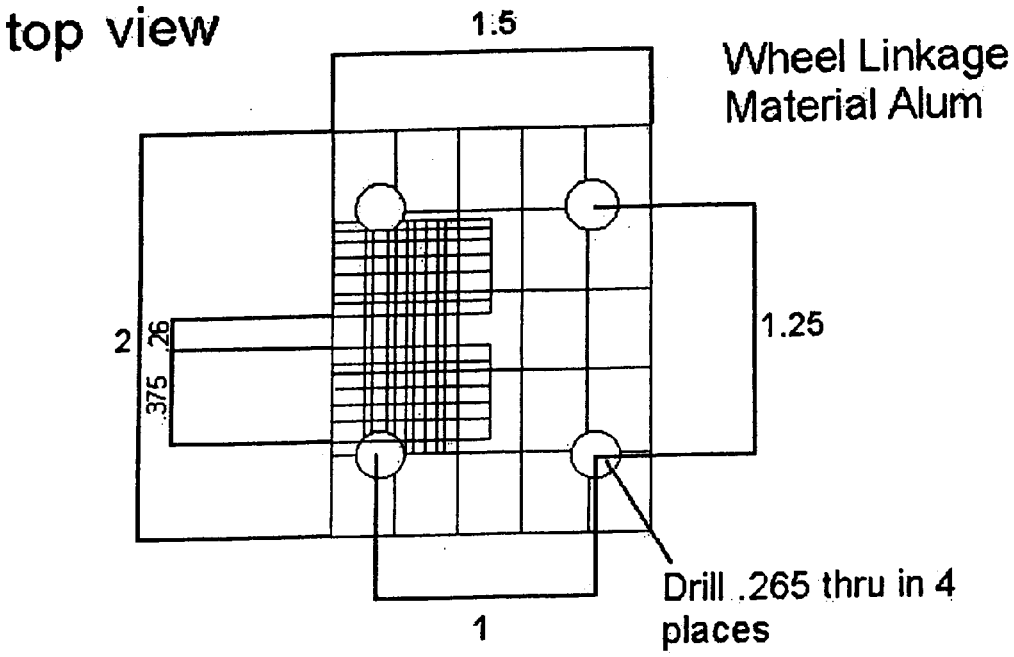

FIG. 7 describes the side view and top view of the wheel linkage mount (Part 3).

Figure 8:
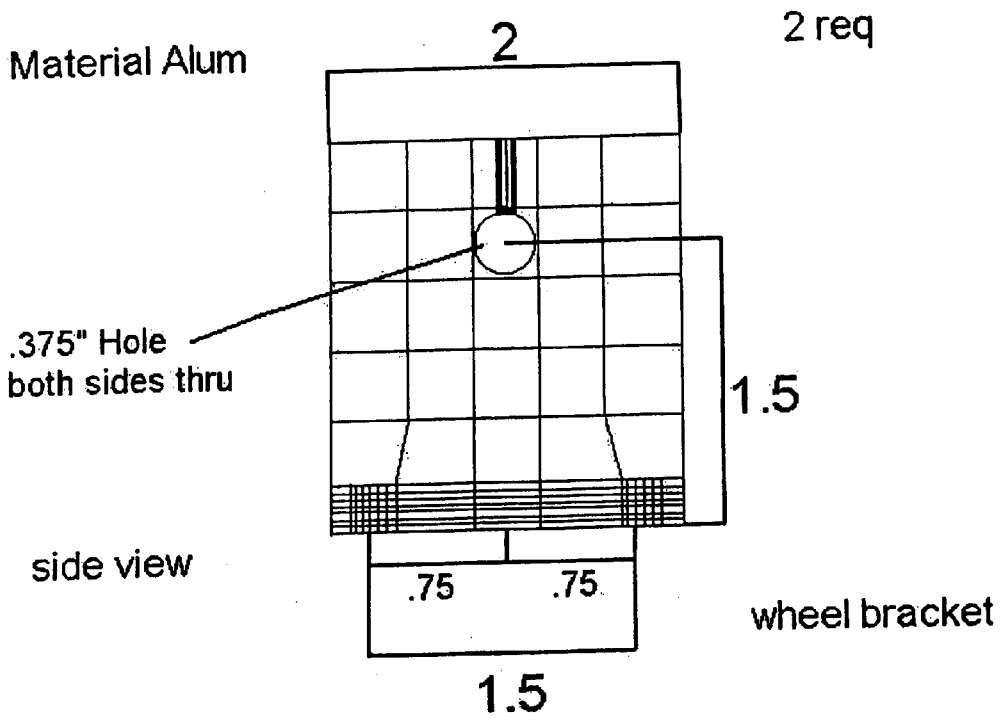
Figure 8:
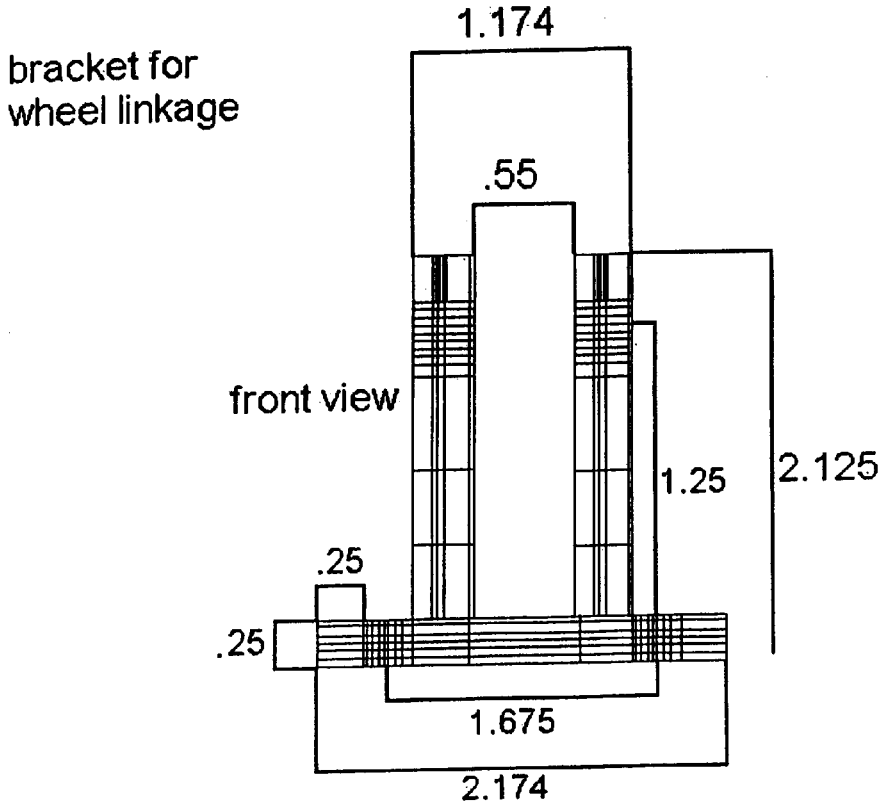

FIG. 8 describes the side view and front view of the wheel linkage mount which is different from Part 3. (Part 4)

Figure 9:
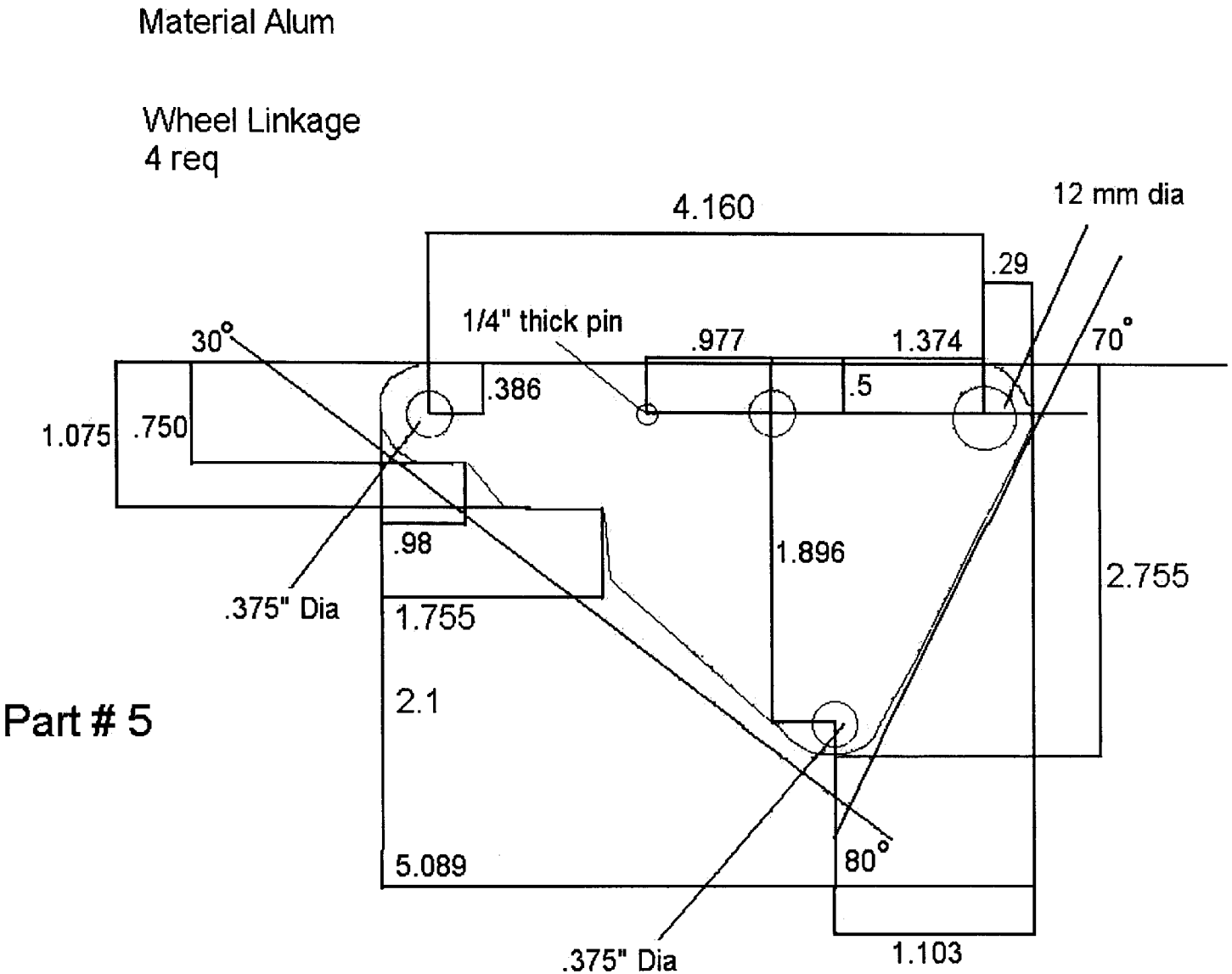

FIG. 9 describes the wheel linkage. (Part 5)

Figure 10:
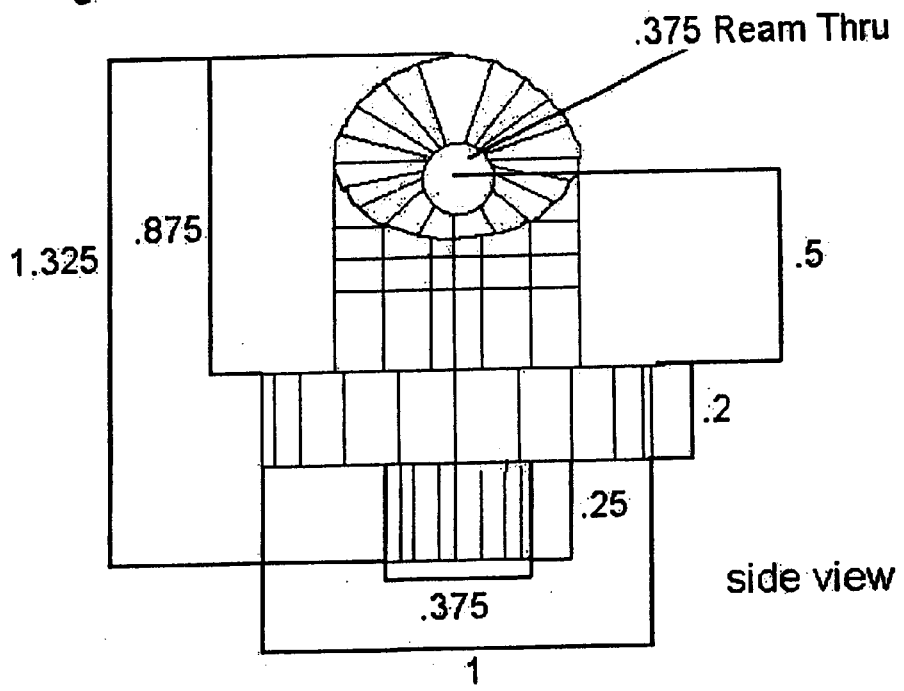
Figure 10:
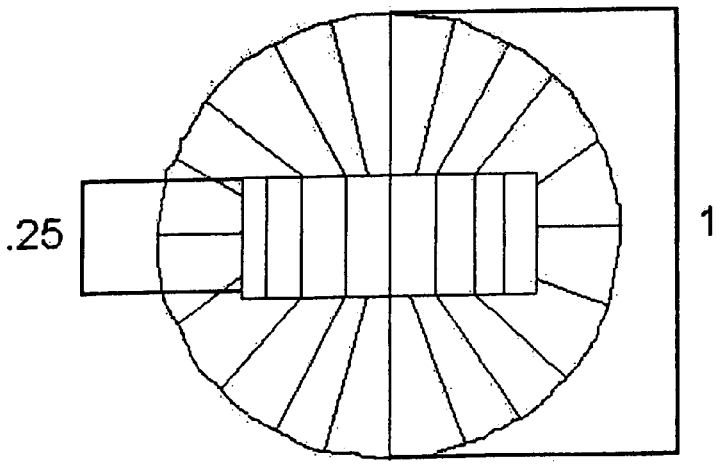

FIG. 10 describes the side view and top view of the steel welds. (Part 6)

Figure 11:
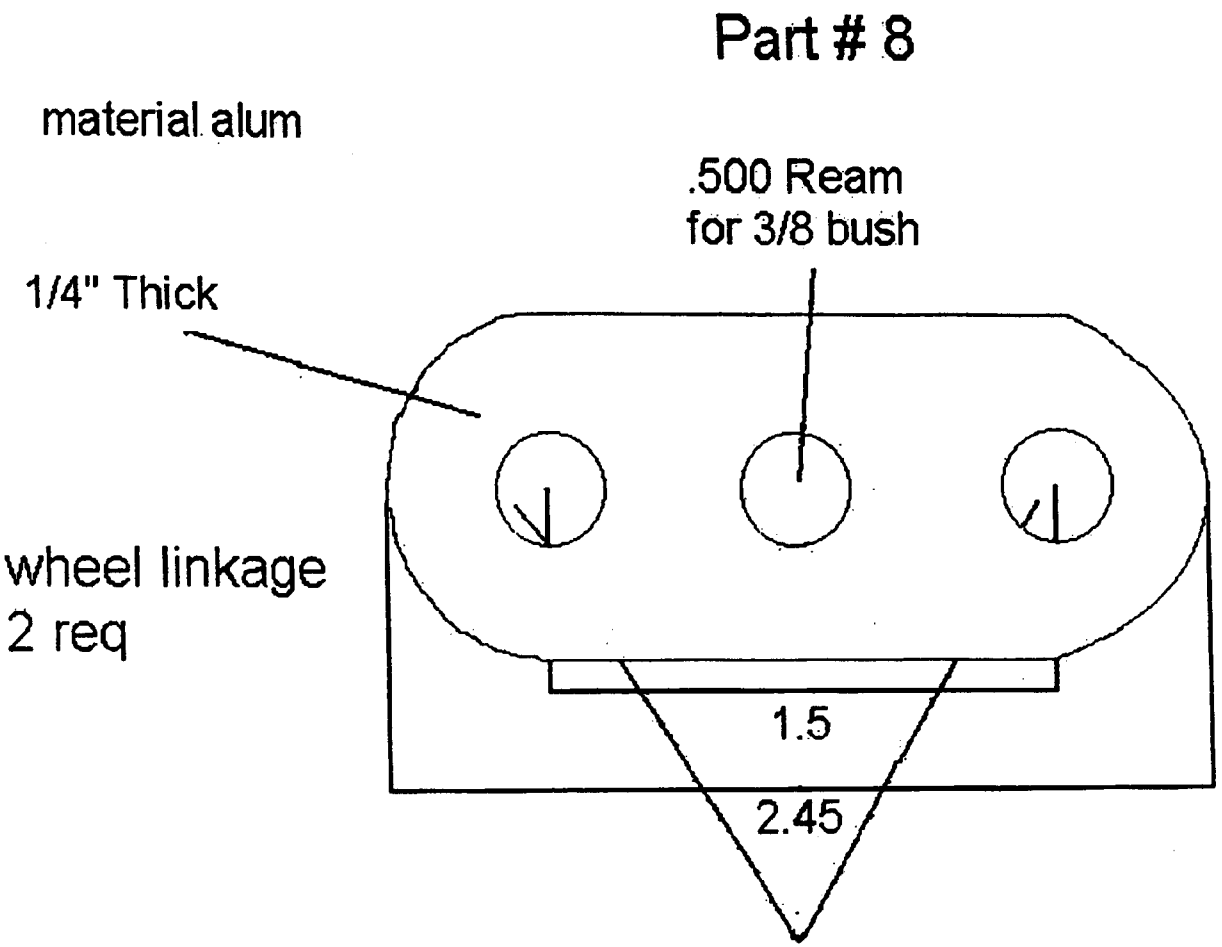

FIG. 11 describes the Bell crank (Part 8)

Figure 12:
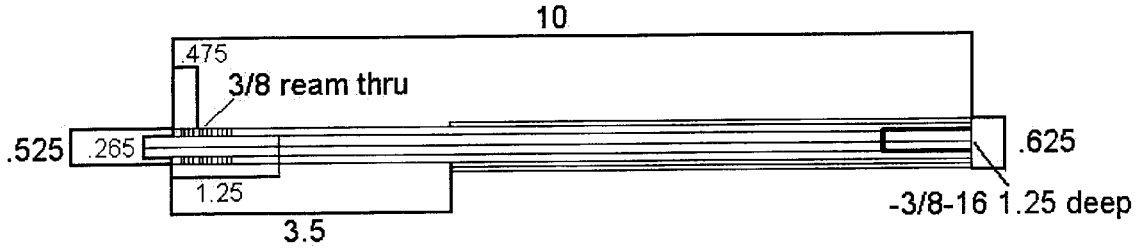
Figure 12:
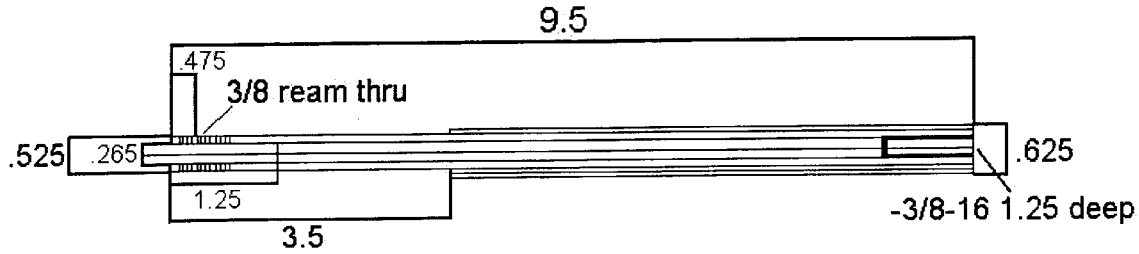

FIG. 12 describes Part 9, and 10 representing the wheel linkage.

Figure 13:
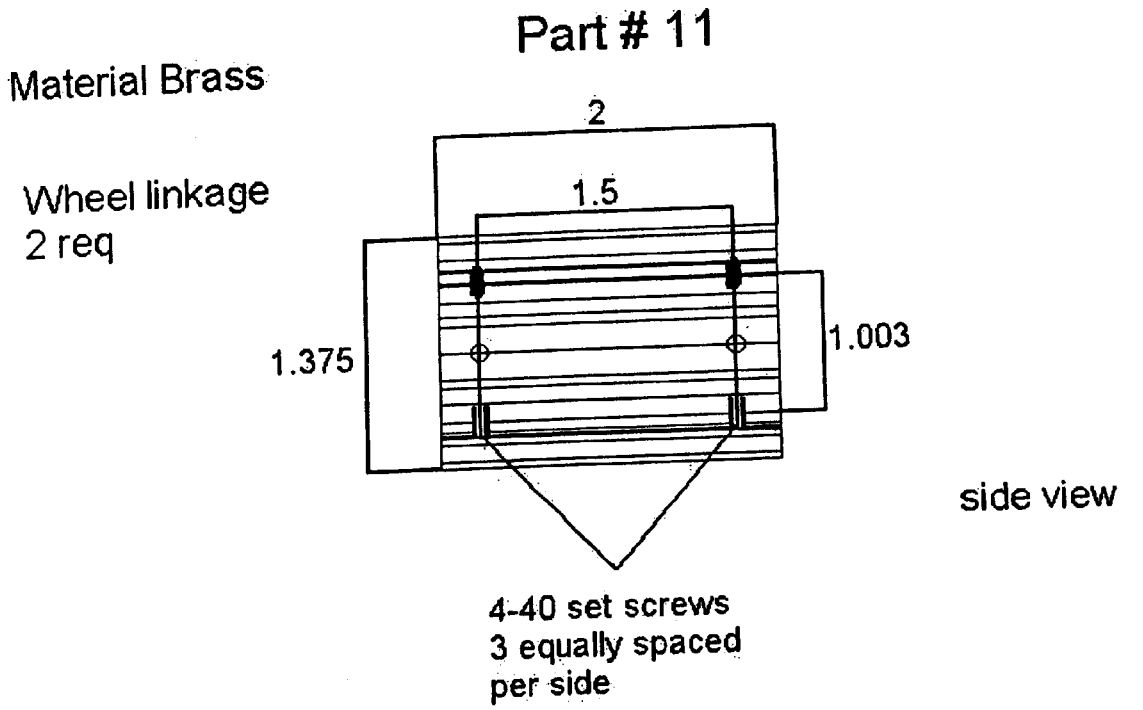
Figure 13:
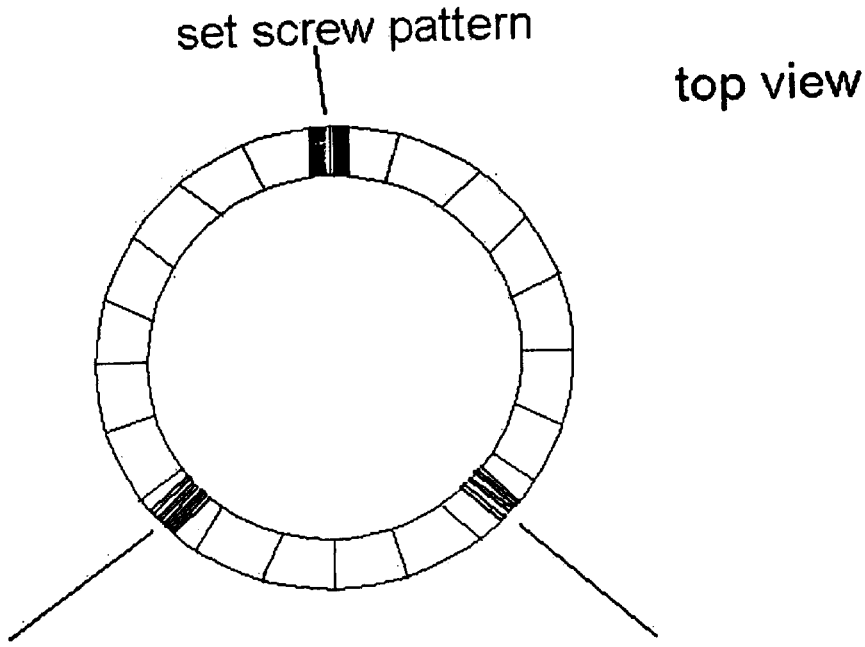

FIG. 13 describes the side view and top view of Part 11.

Figure 14:
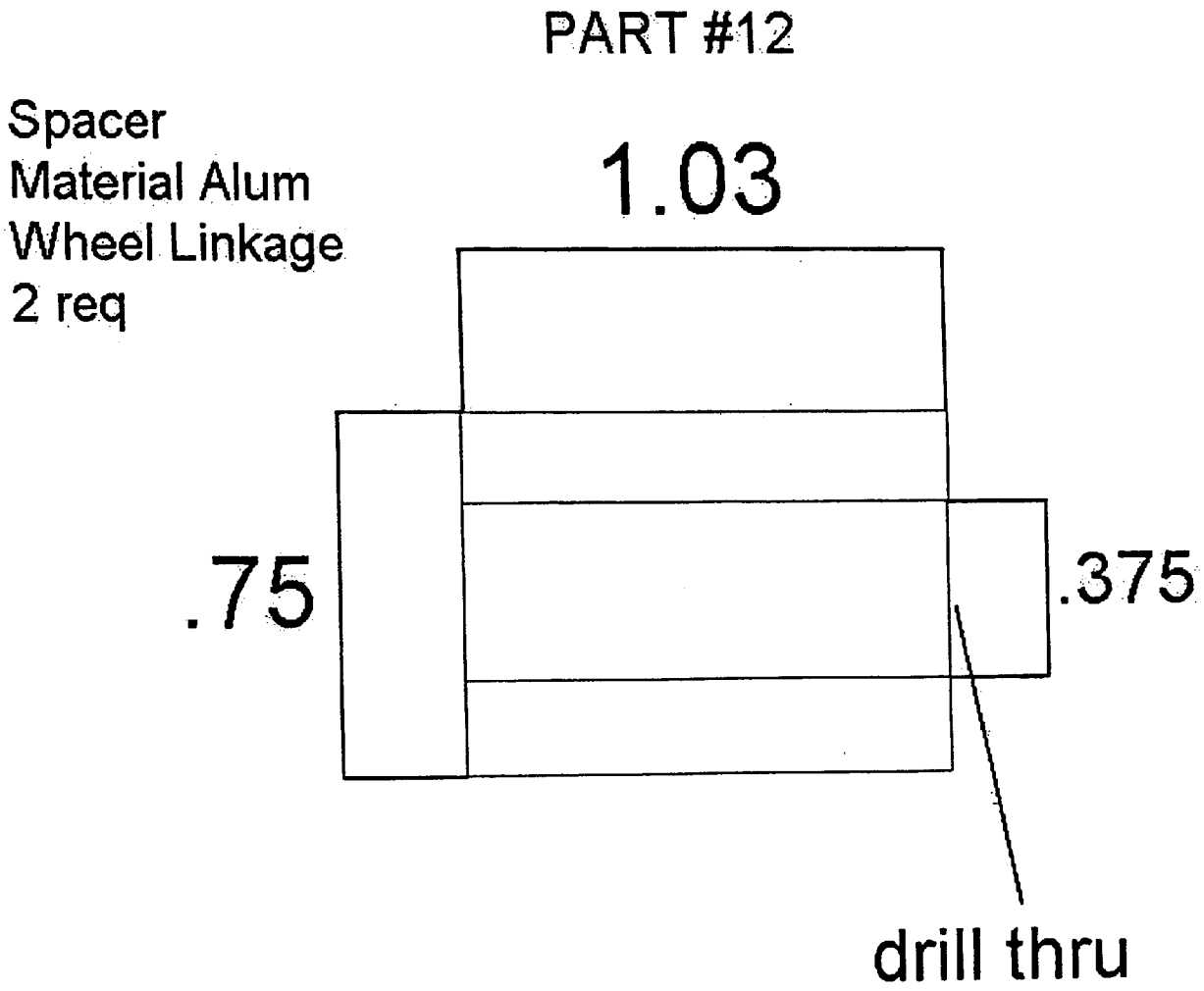

FIG. 14 describes Part 12, a spacer which connects Parts 9 and 5.

Figure 15:
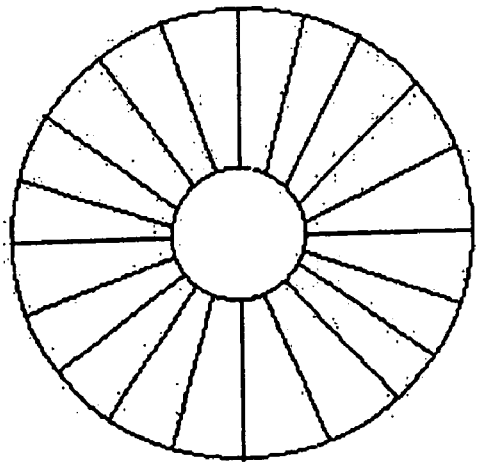

FIG. 15 describes Part 13, a washer for Part 12.

Figure 16:
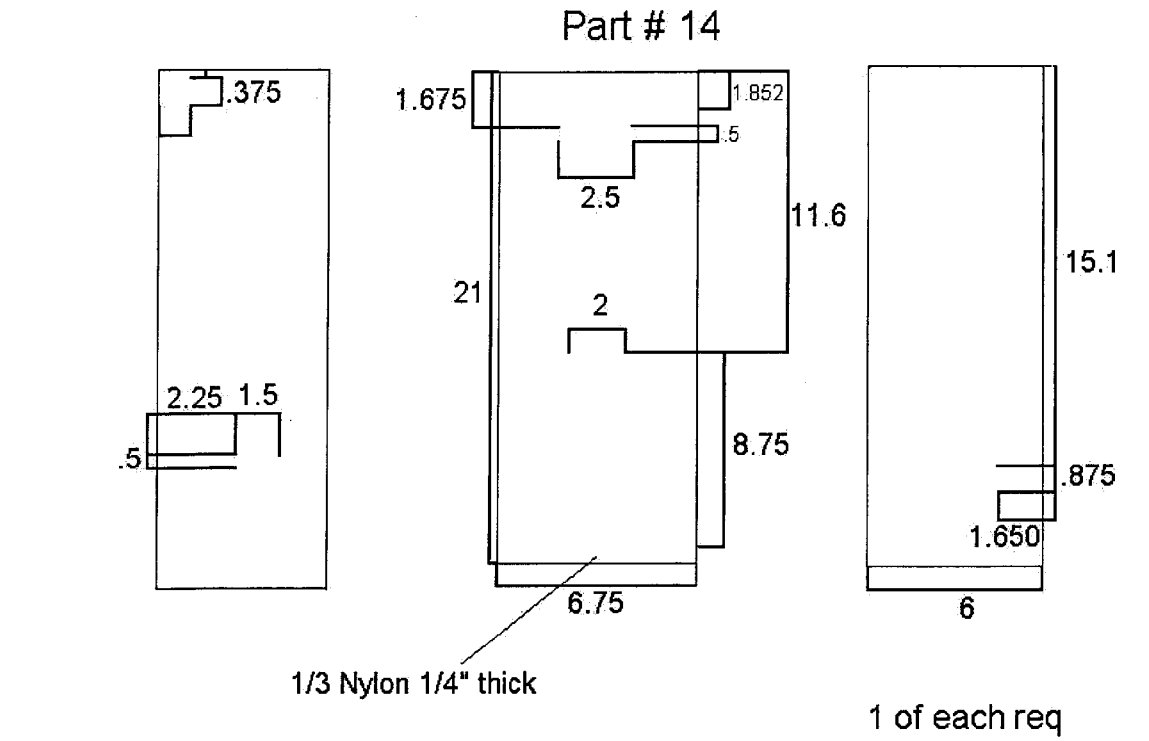
Figure 16:
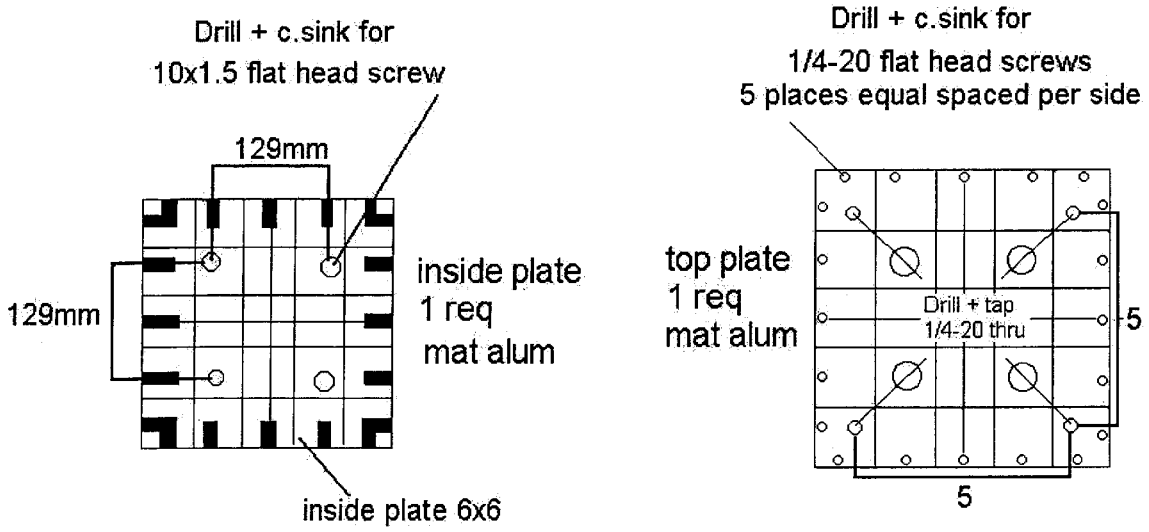

FIG. 16 describes Part 14, a shroud.

Figure 17:
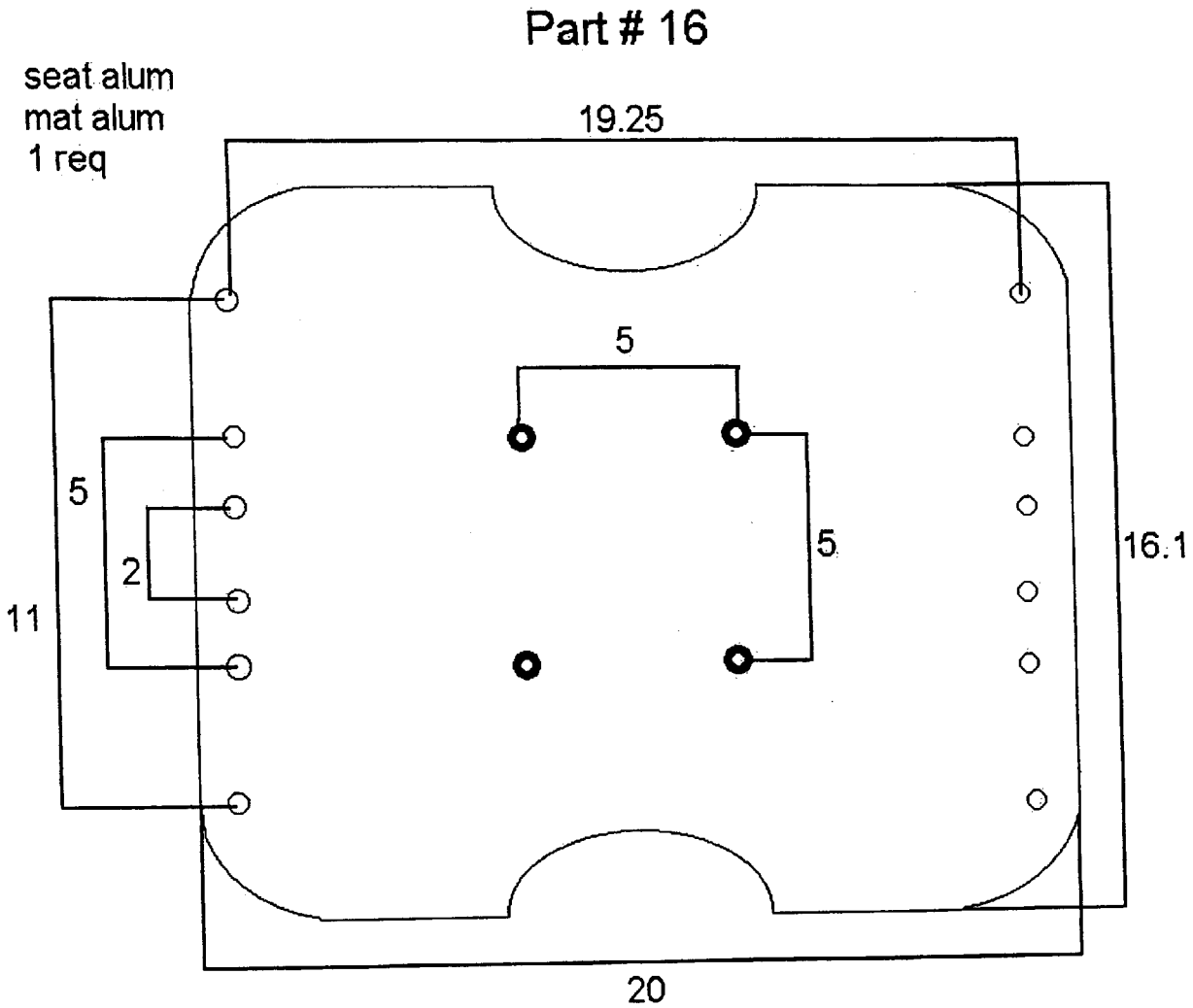

FIG. 17 describes a swivel Part 15 and a seat Part 16.

Figure 18:
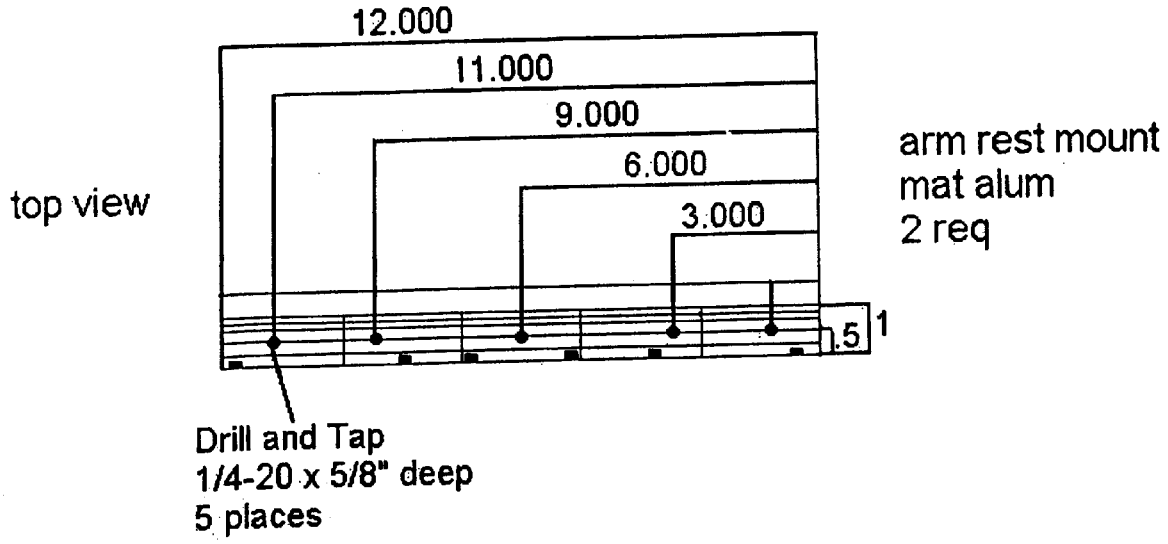
Figure 18:
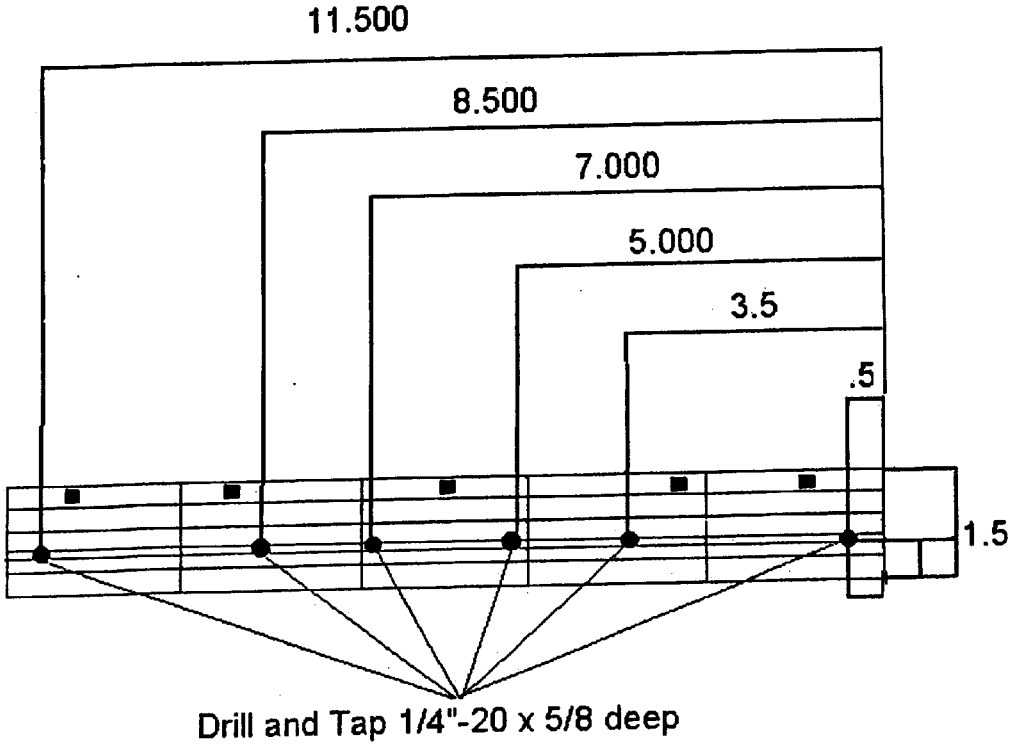

FIG. 18 describes the top view and side view of Part 17, which mounts under the seat plate to attach the arm rests.

Figure 19:
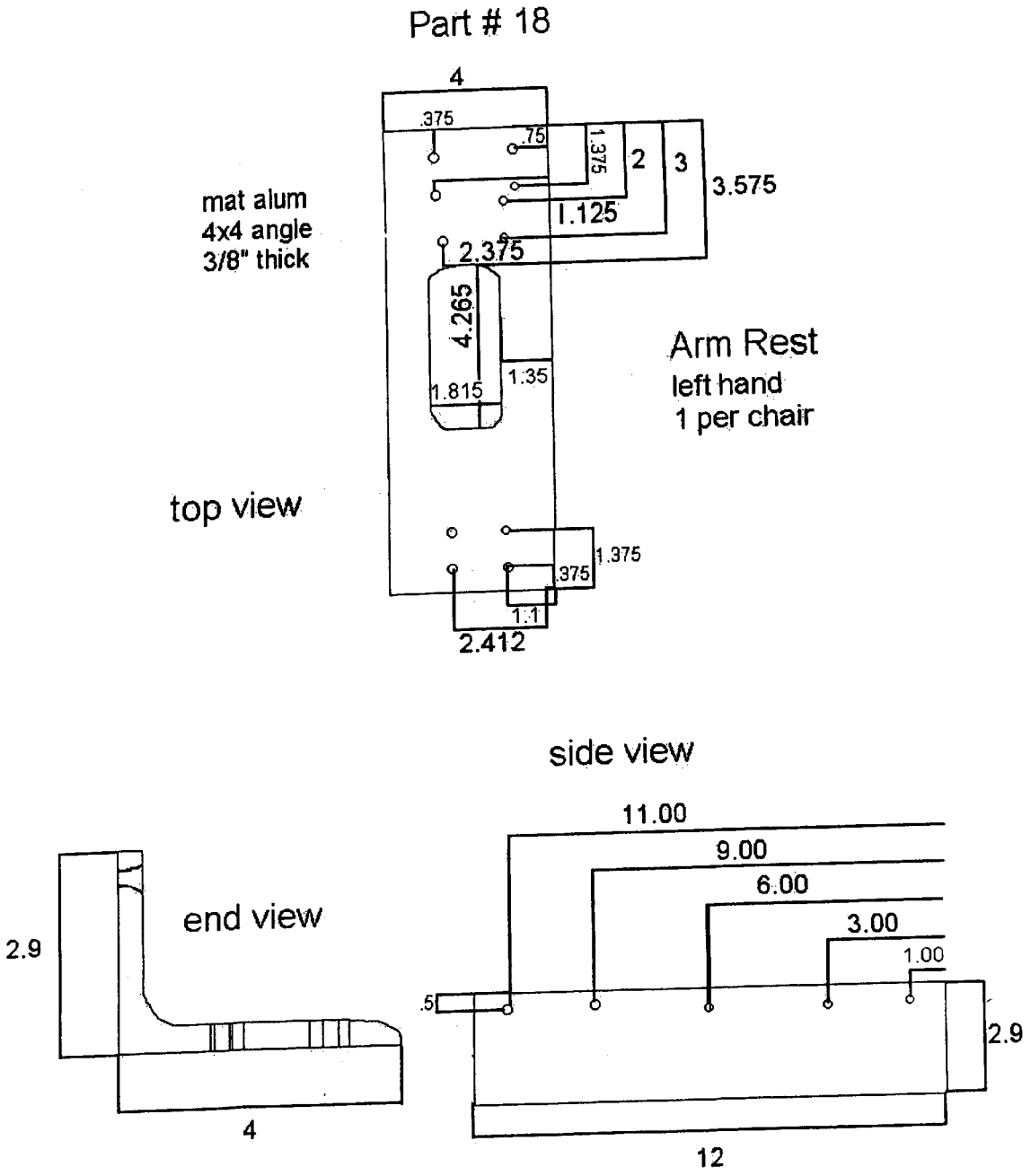

FIG. 19 describes the top, side and end views of the arm rest, Part 18 for the left hand, and attaches to Part 17.

Figure 20:
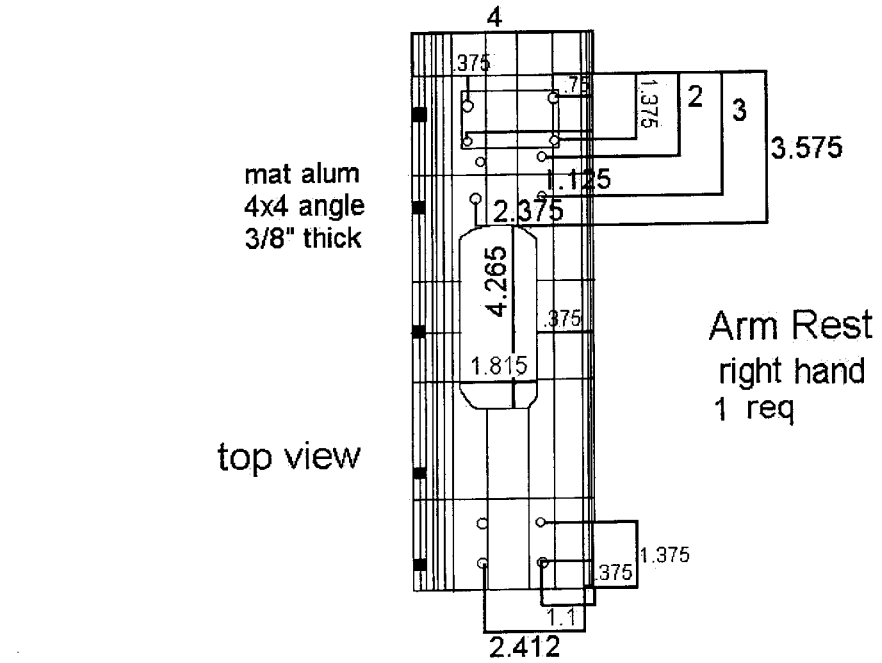
Figure 20:
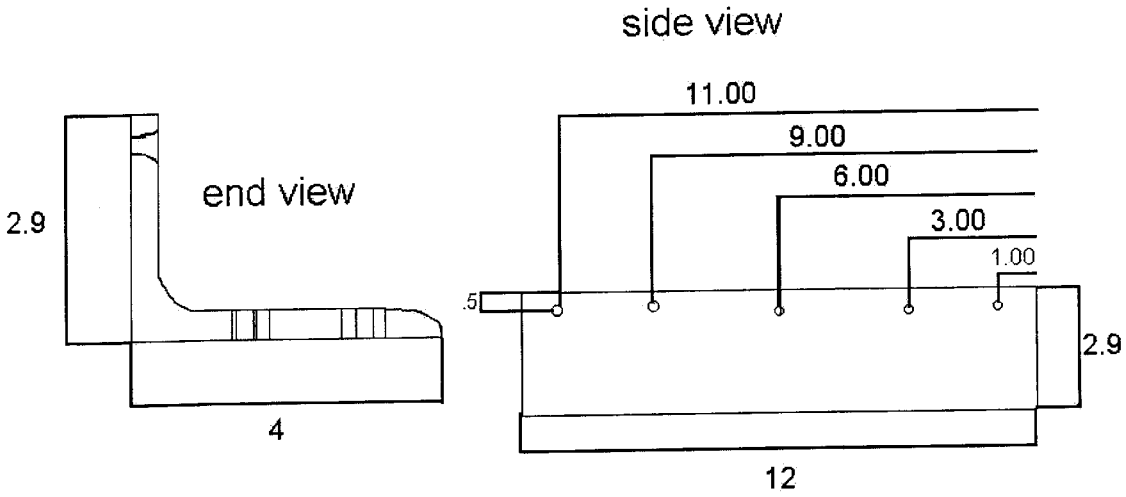

FIG. 20 describes the top, side and end views of arm rest, Part 19 for the right hand, the Part 19 and attaches to Part 17.

Figure 21:
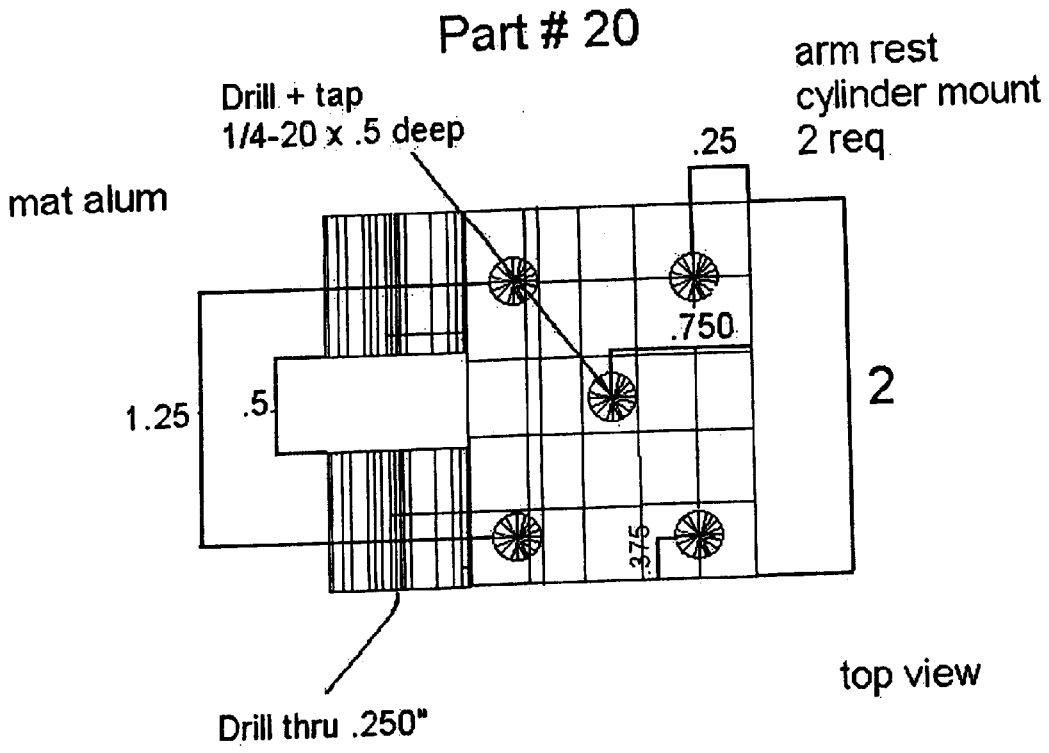
Figure 21:
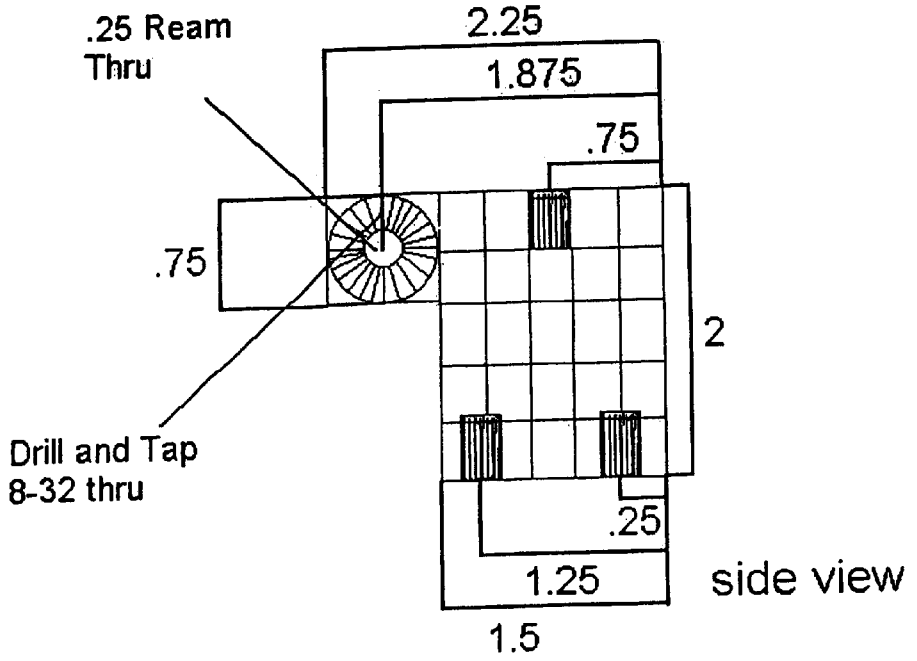

FIG. 21 describes the top view and side view of the arm rest cylinder mount, Part 20, and attaches to Part 18 and Part 19.

Figure 22:
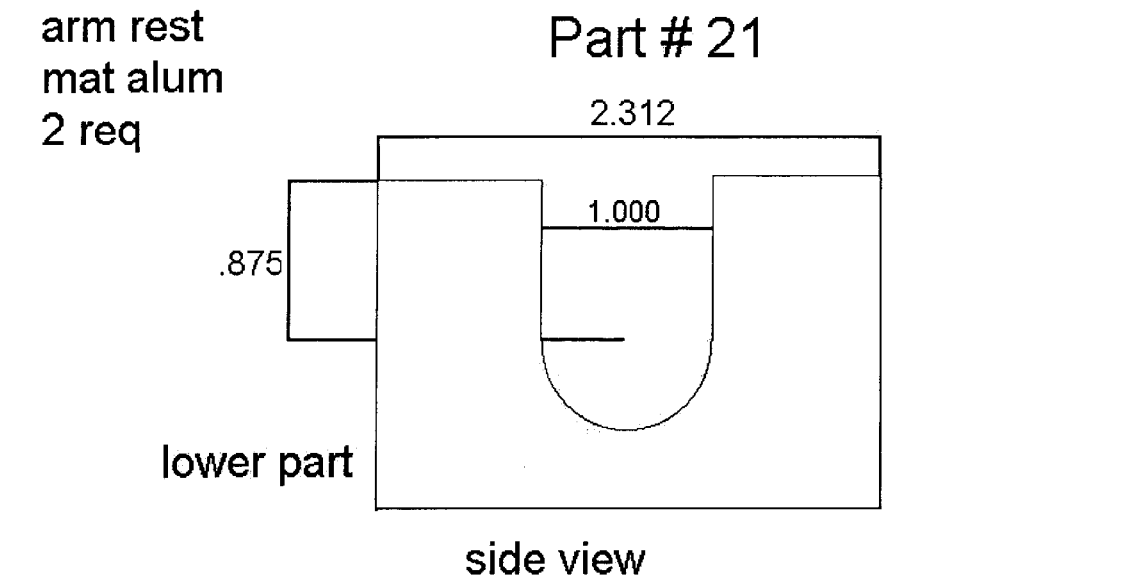
Figure 22:
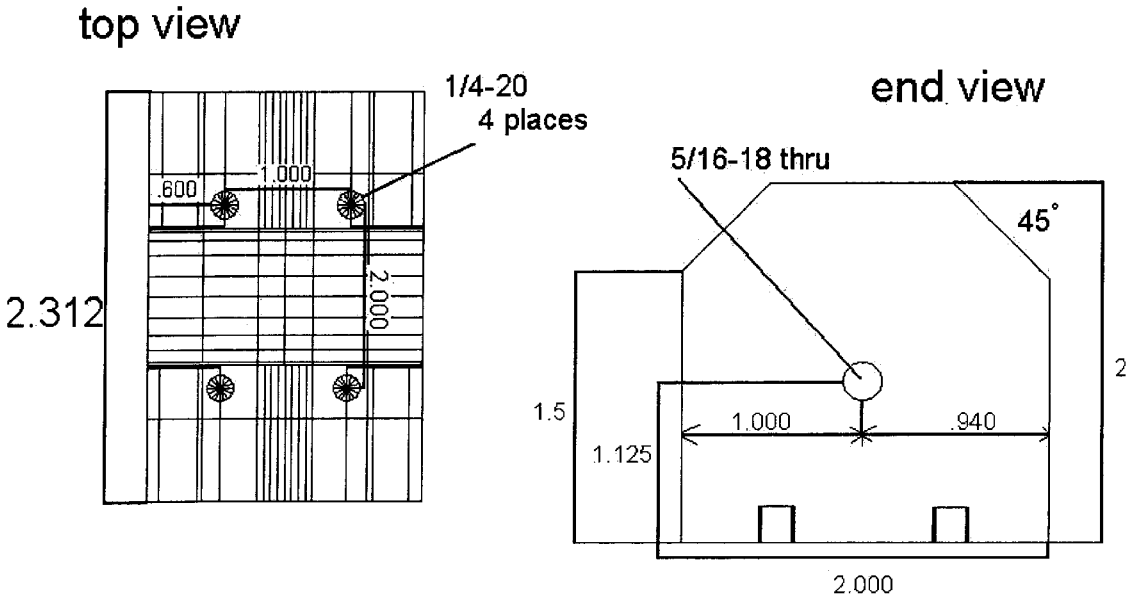

FIG. 22 describes the side view, end view and top view of the arm rest Part 21, and attaches to Part 18 and Part 19.

Figure 23:
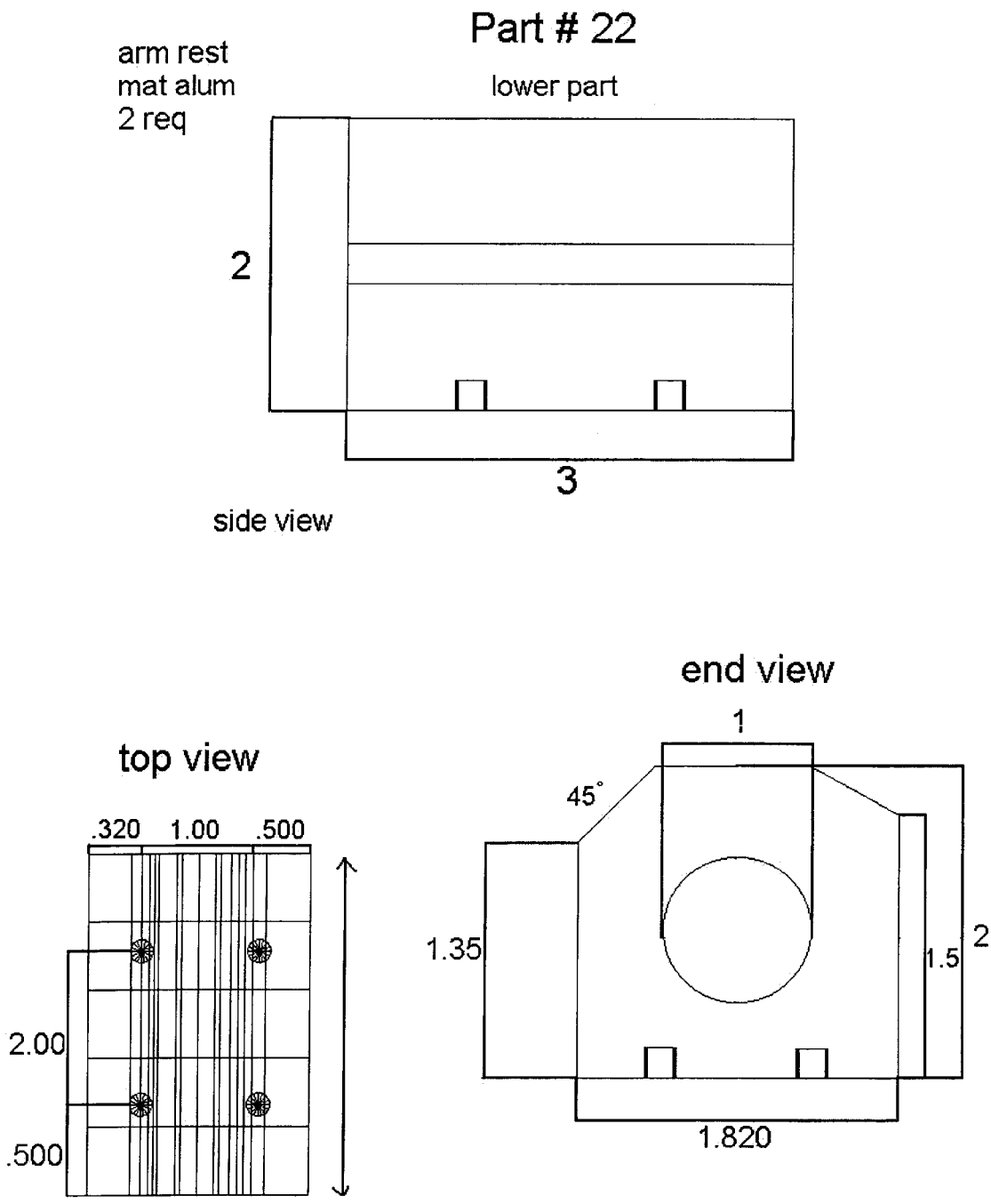

FIG. 23 describes the side view, end view and top view of arm rest, Part 22, and attaches to Part 18 and Part 19.

Figure 24:
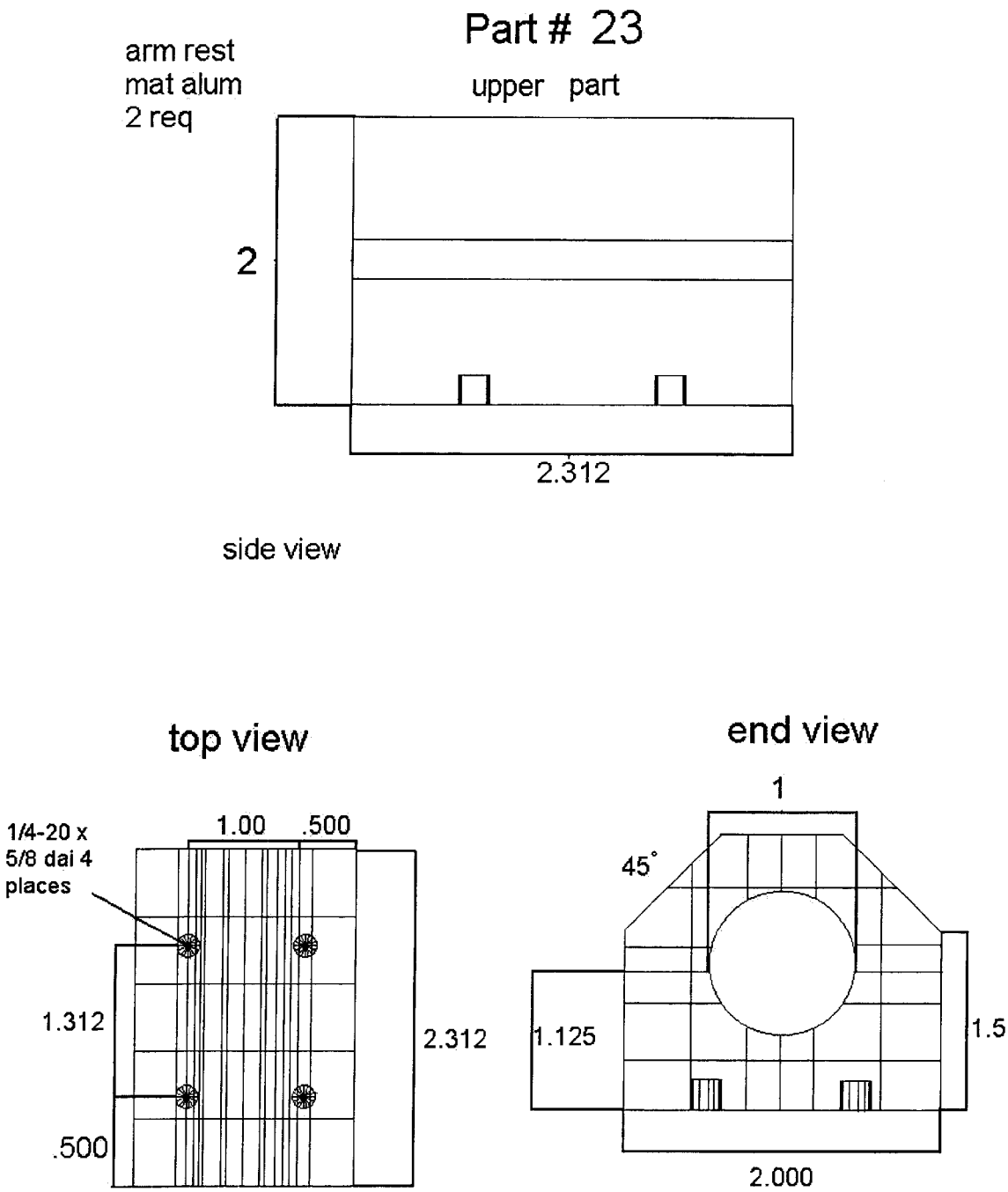

FIG. 24 describes the side view, end view and top view of the upper part of arm rest Part 23 and attaches to Part 26.

Figure 25:
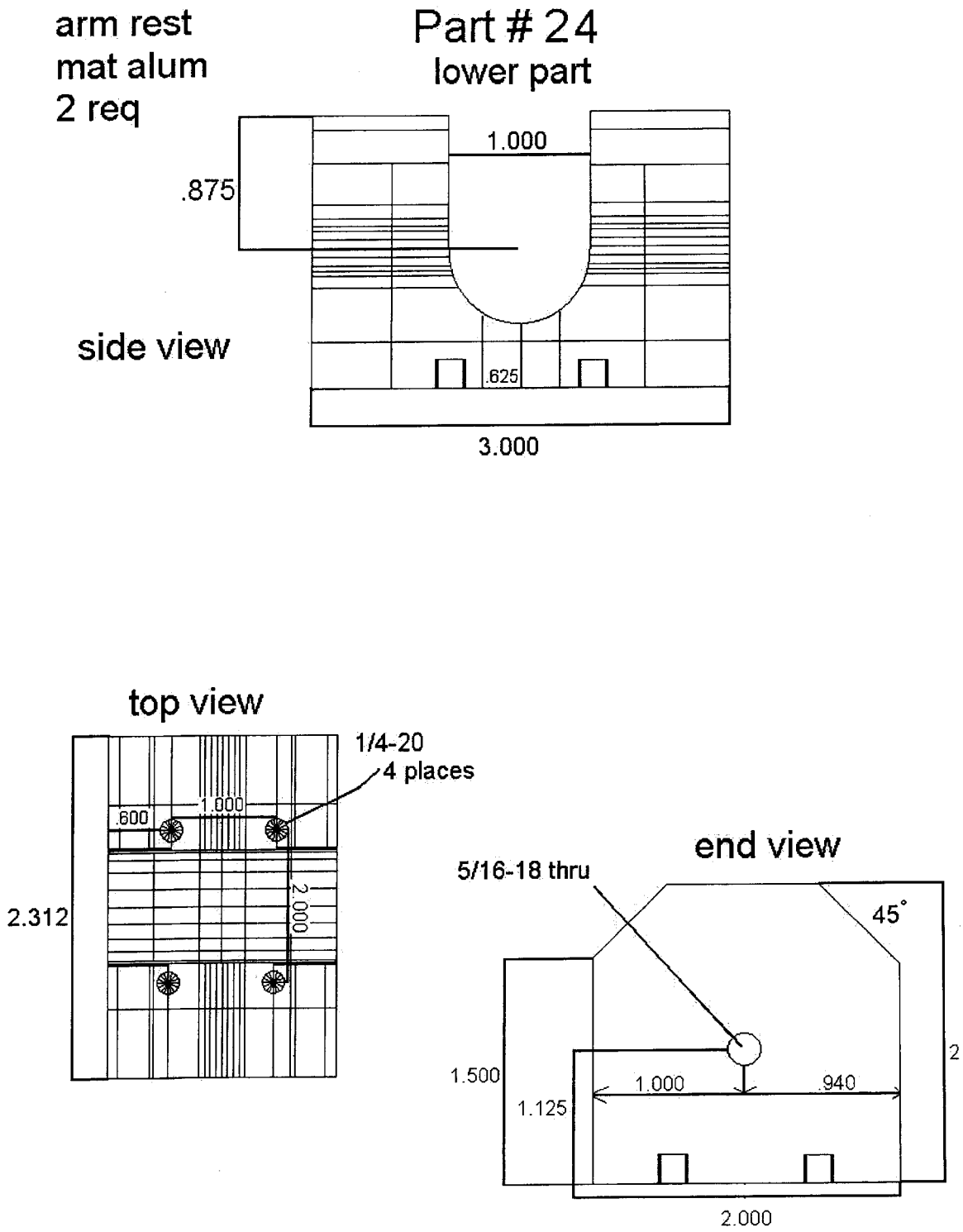

FIG. 25 describes the side view, end view and top view of the lower part of arm rest, Part 24 and attaches to Part 26.

Figure 26:
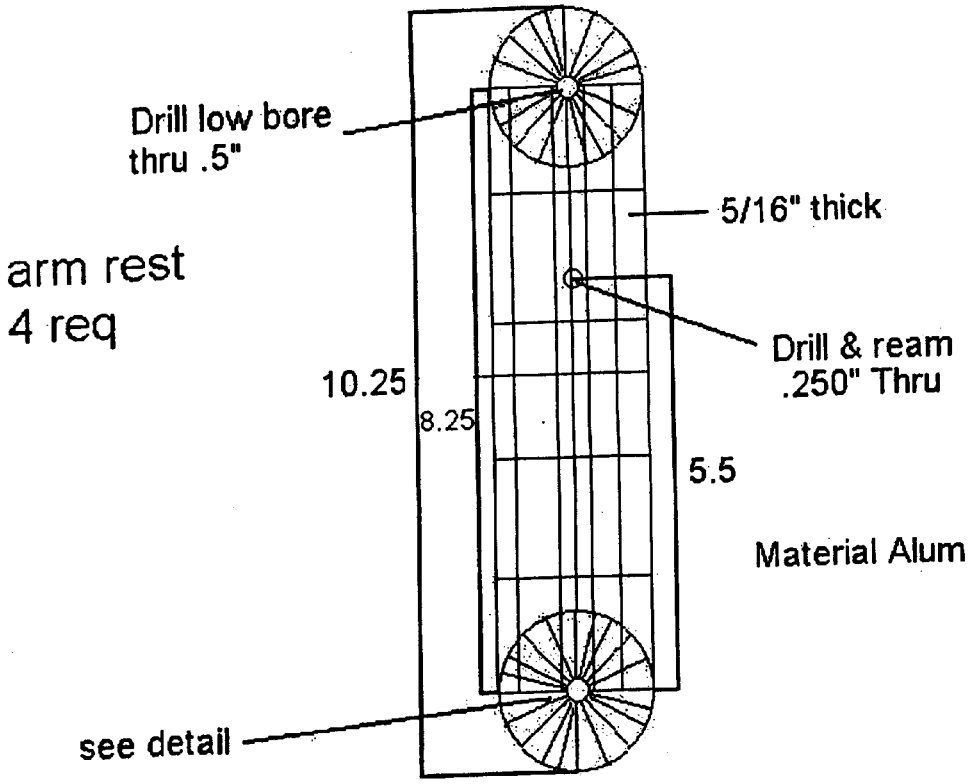
Figure 26:
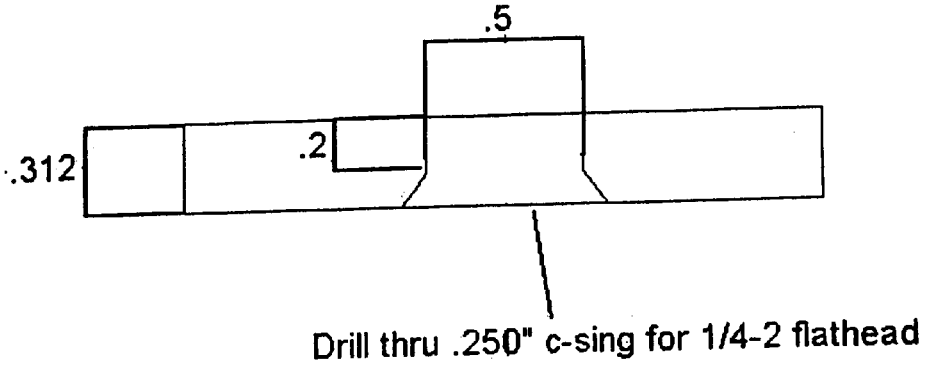

FIG. 26 describes the arm rest and hole detail for Part 25 and attaches to Parts 21 and 23.

Figure 27:
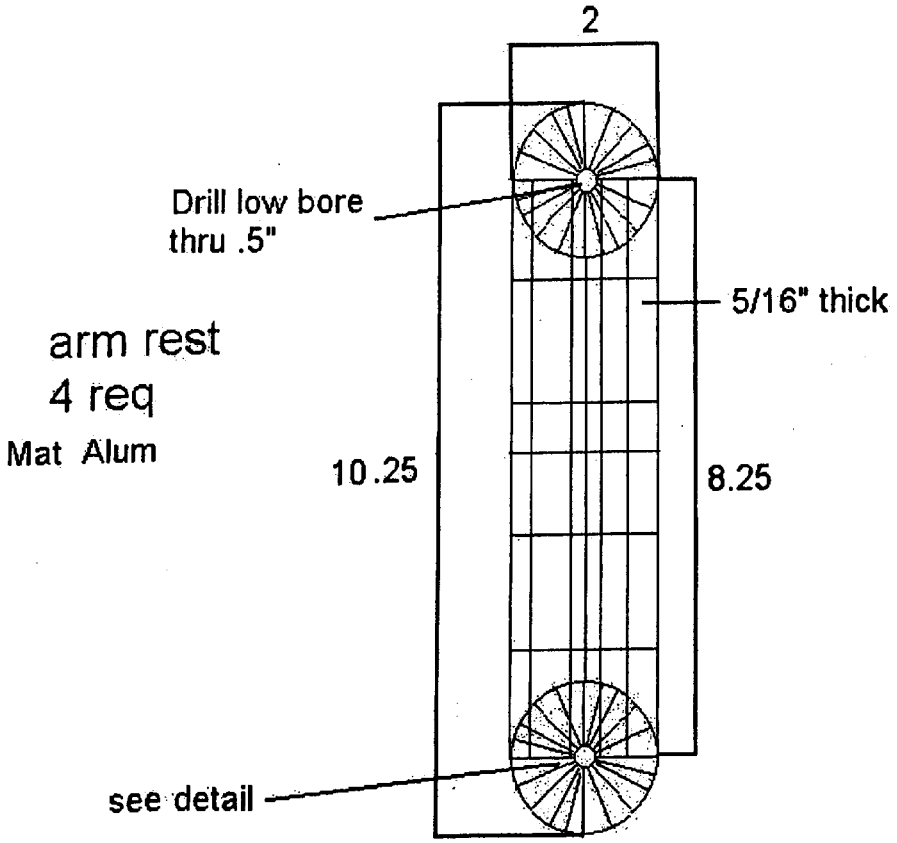
Figure 27:
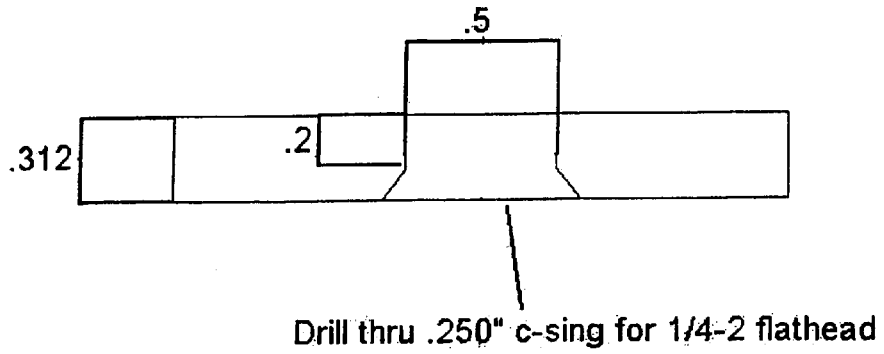

FIG. 27 describes the arm rest and hole detail for Part 25 and attaches to Parts 22 and 24.

Figure 28:
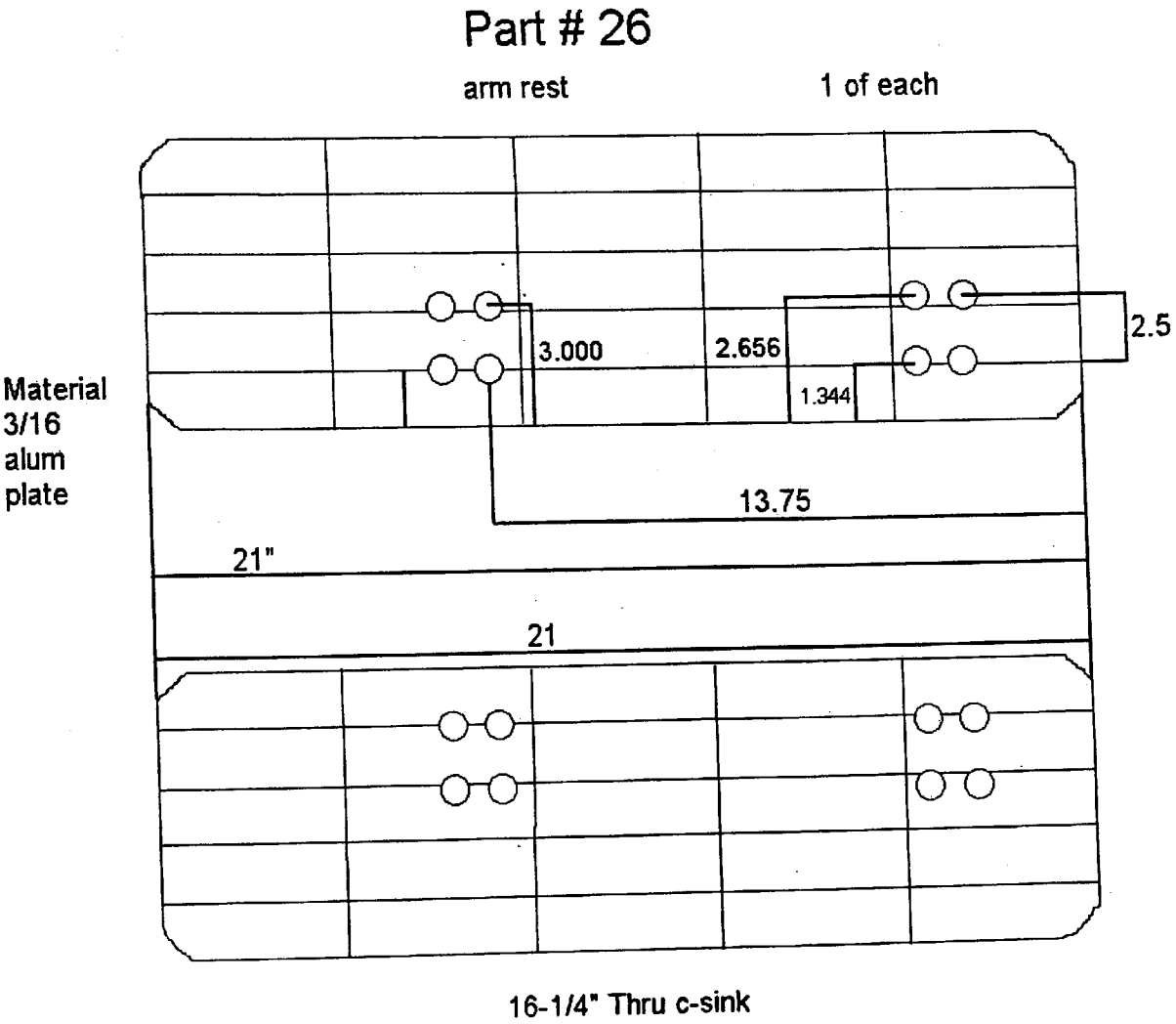

FIG. 28 describes the plate, Part 26 and arm rest.

Figure 29:
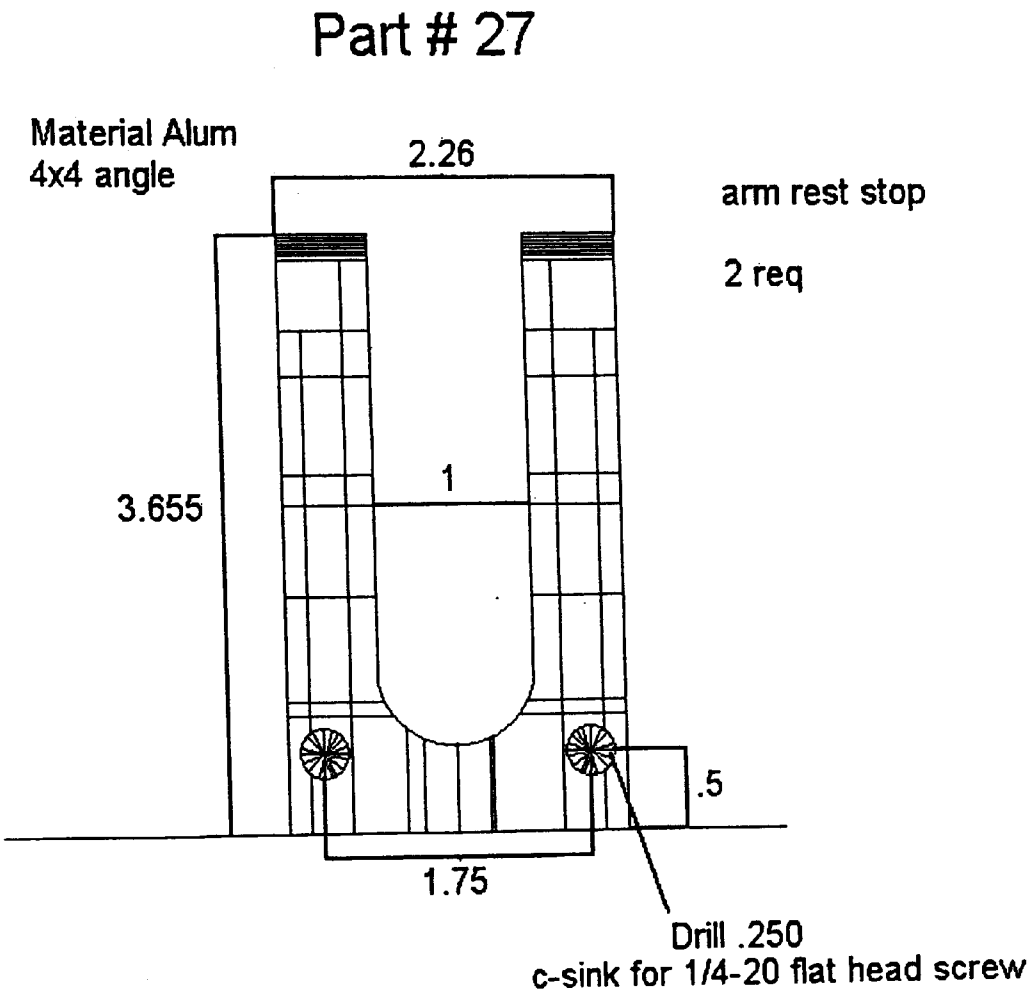

FIG. 29 describes the arm rest stop for Part 27 and attaches to Part 20.

Figure 30:
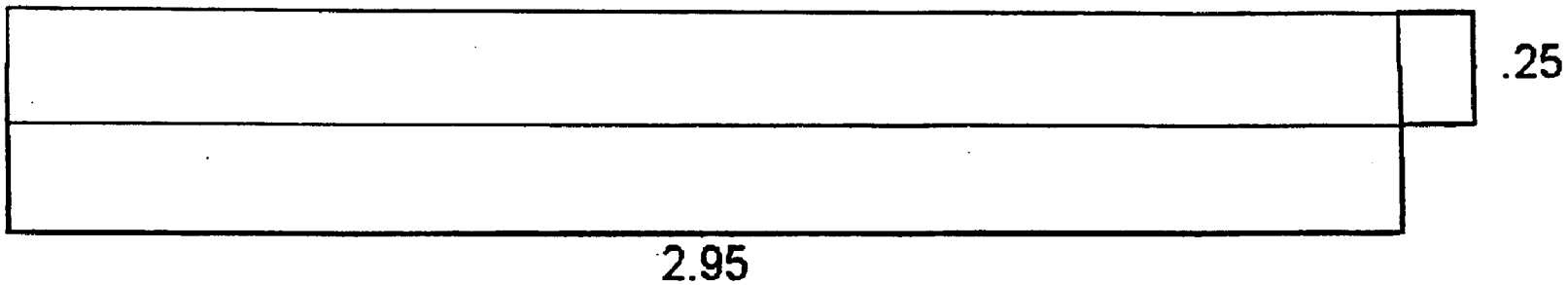

FIG. 30 describes the arm rest cylinder pin mat steel for Part 32 and connects the cylinder to Part 25.

Figure 31:
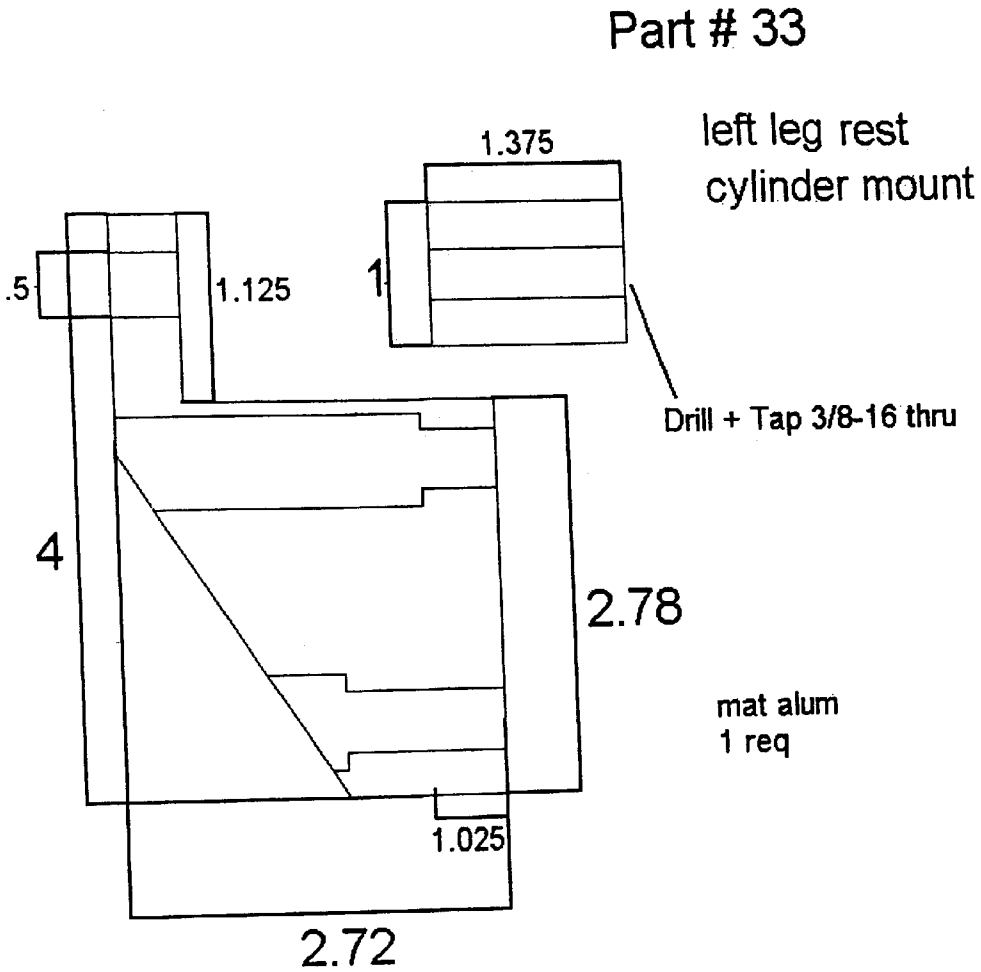

FIG. 31 describes the left leg rest cylinder mat for Part 33 and attaches to Part 14.

Figure 32:
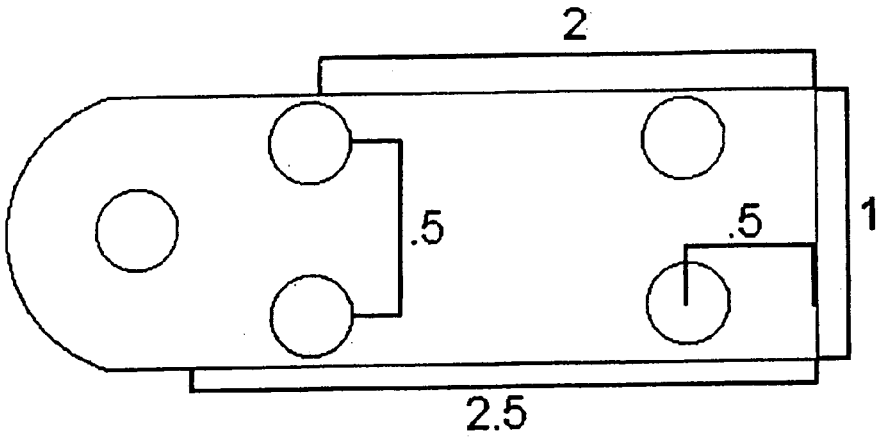
Figure 32:
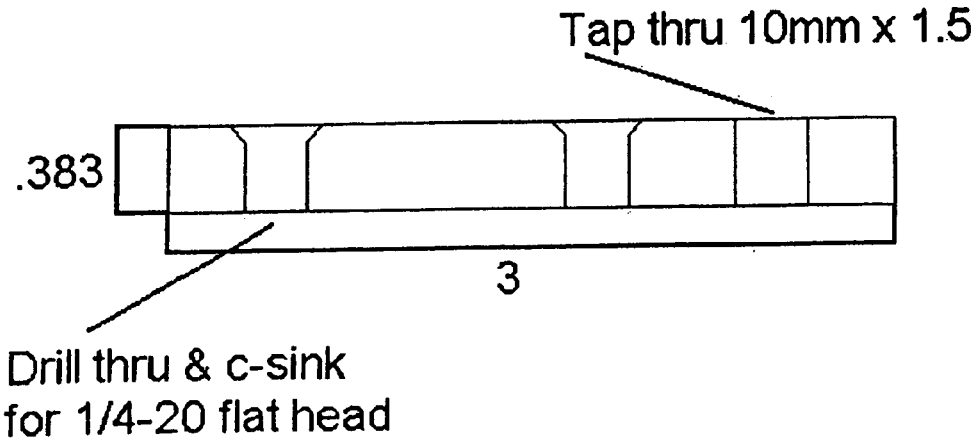

FIG. 32 describes the top view and side view of leg rest Part 34 and attaches to Part 14 to mount cylinder.

Figure 33:
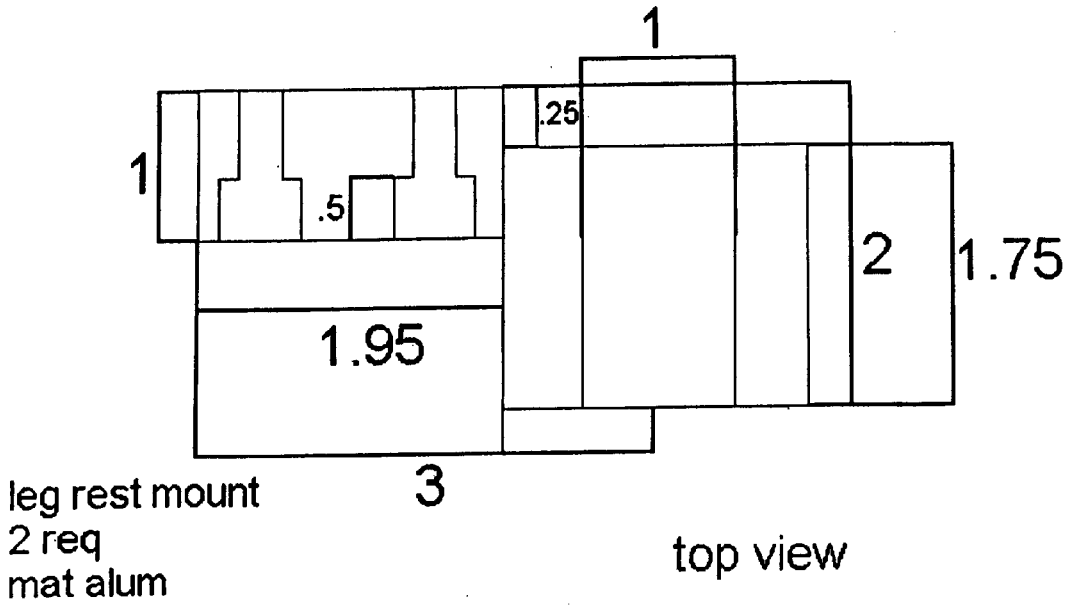
Figure 33:
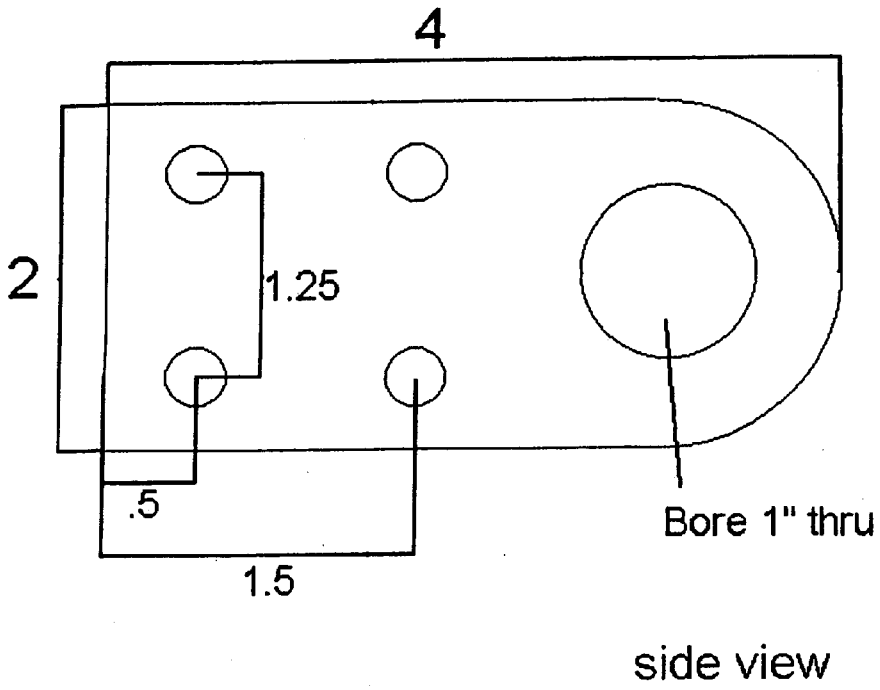

FIG. 33 describes the top view and side view of leg rest mat Part 35 and mounts to Part 14—leg rest hinge.

Figure 34:
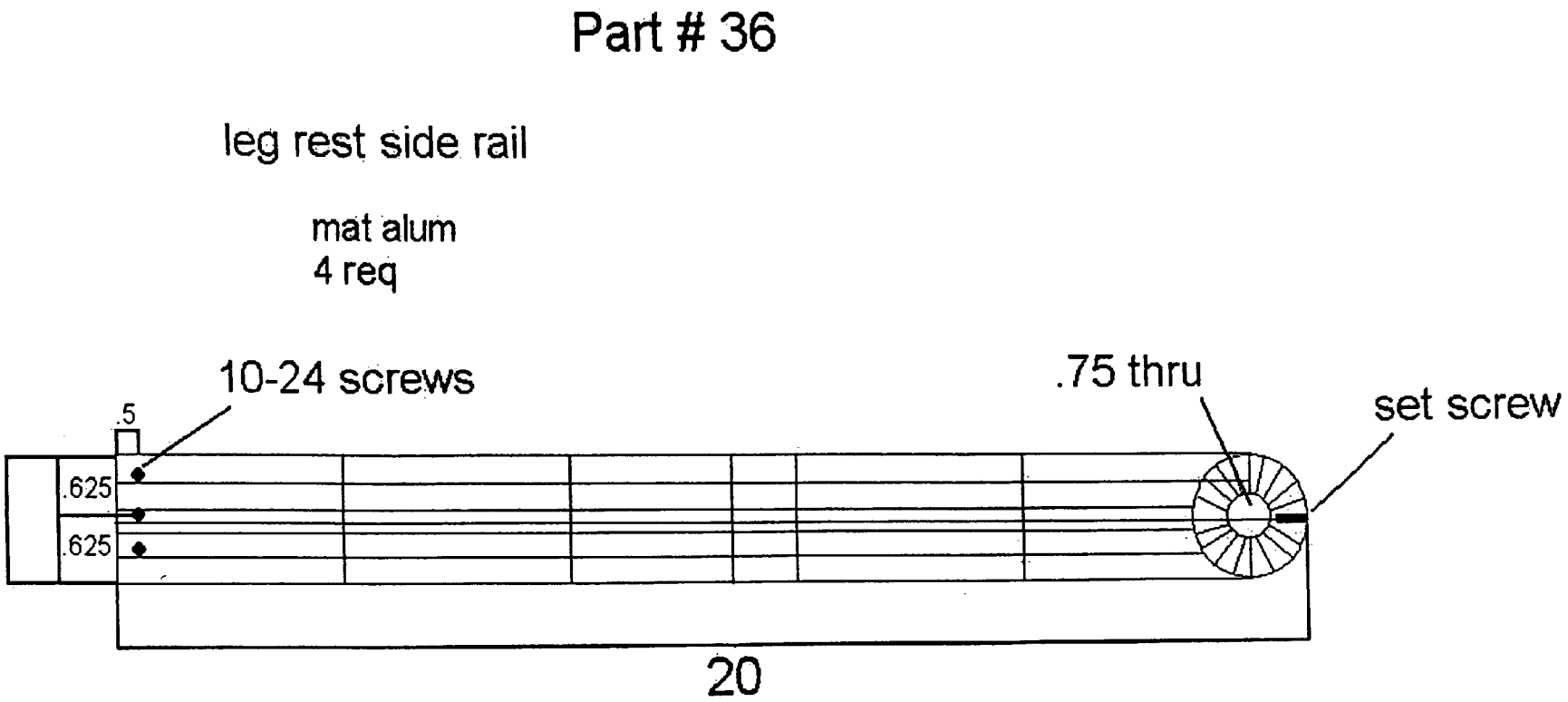

FIG. 34 describes the leg rest side rail for Part 36 and mounts to Part 35.

Figure 35:
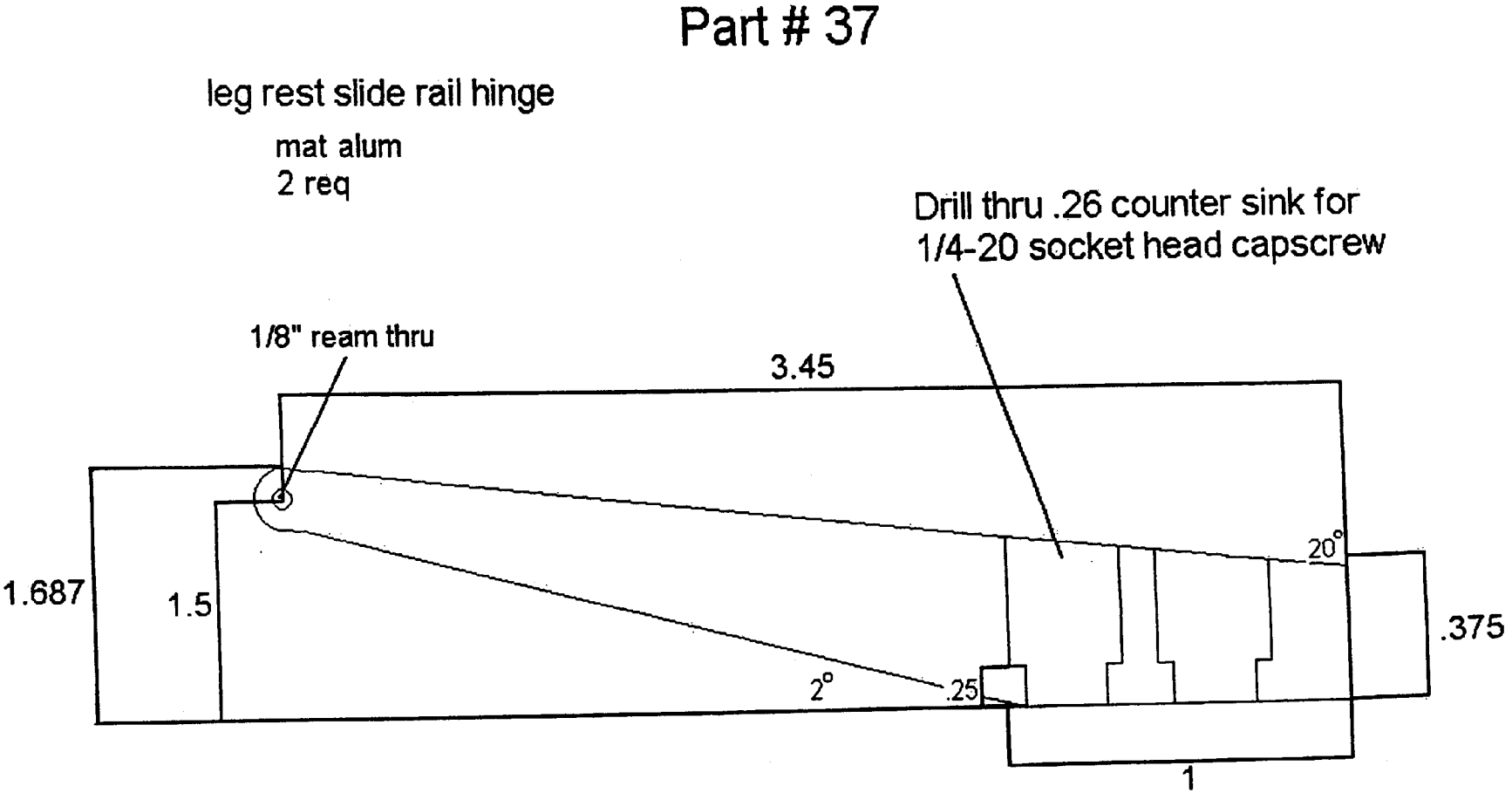

FIG. 35 describes the leg rest slide hinge for Part 37, and attaches to Part 35.

Figure 36:
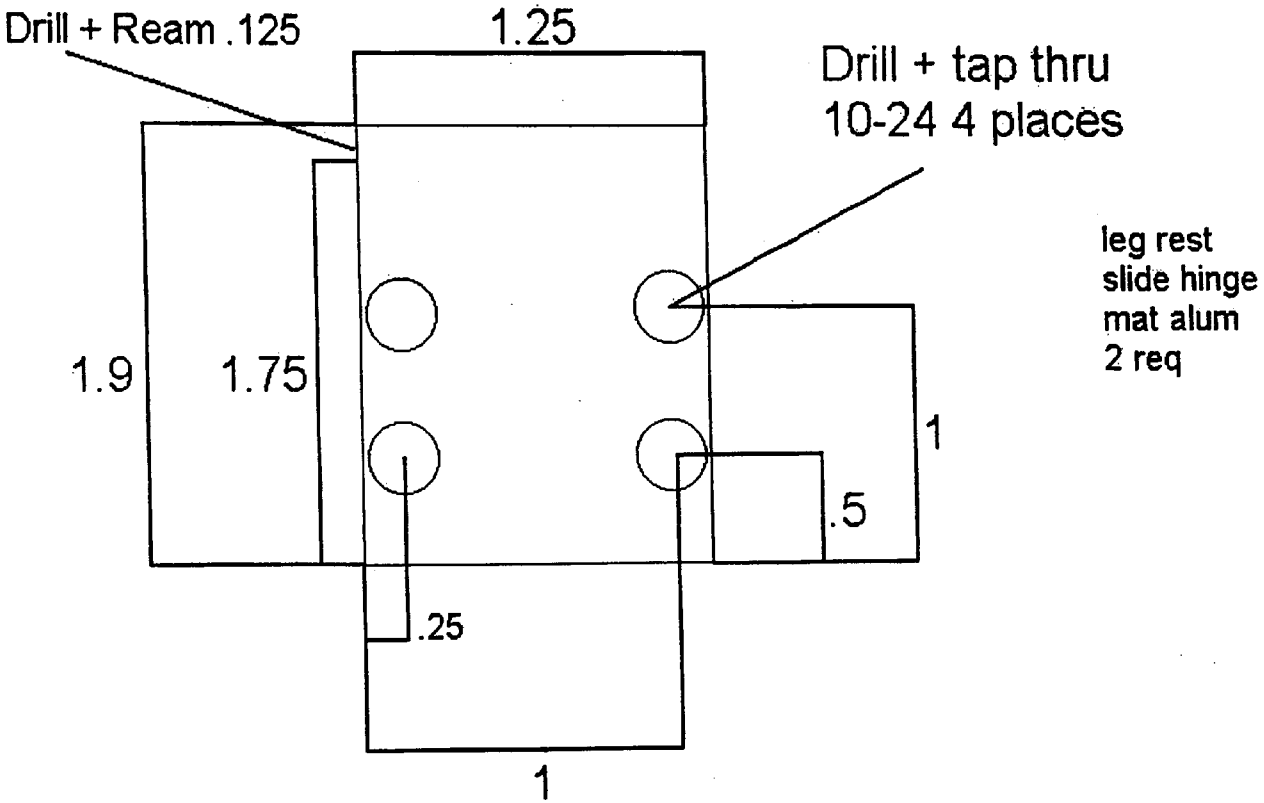

FIG. 36 describes the leg rest slide hinge for Part 39 and attaches to Part 34.

Figure 37:
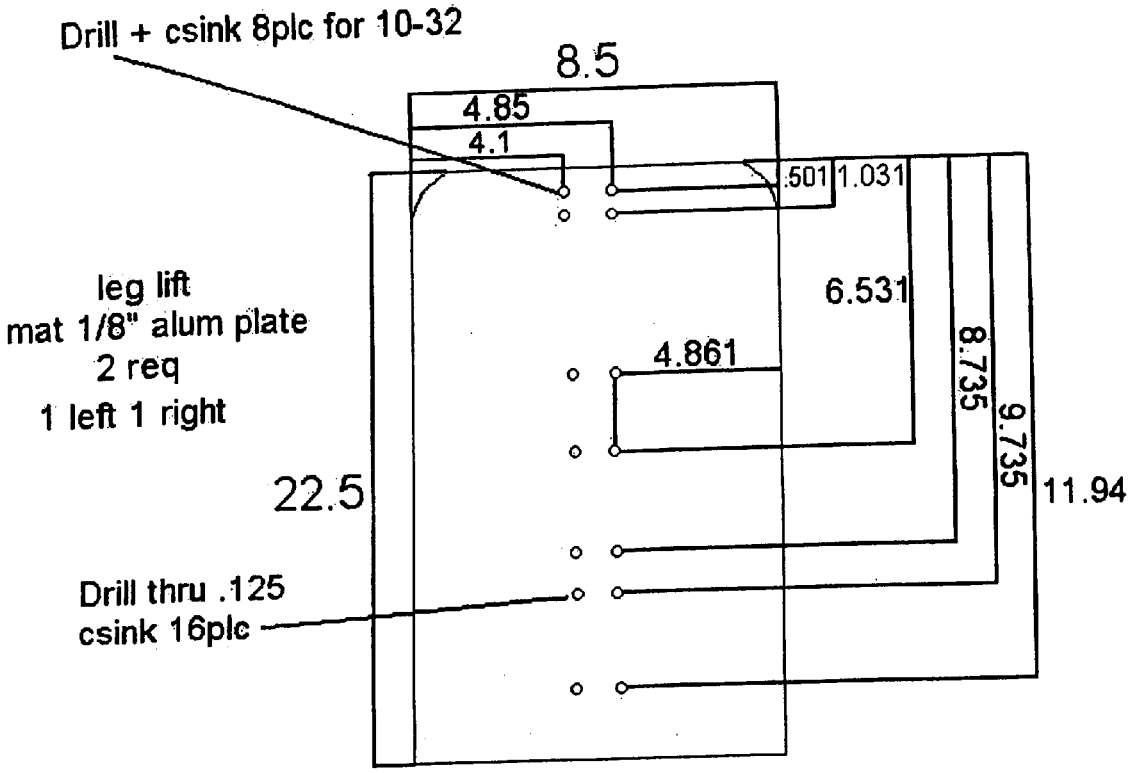
Figure 37:
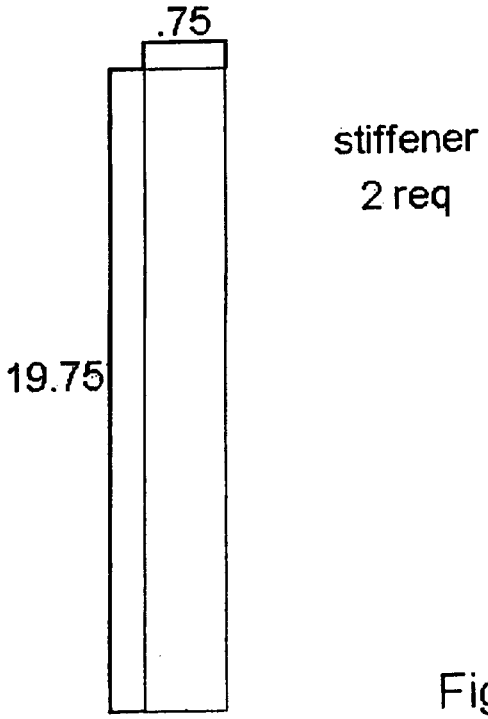

FIG. 37 describes a stiffener for Part 40 and attaches to Part 40.

Figure 38:
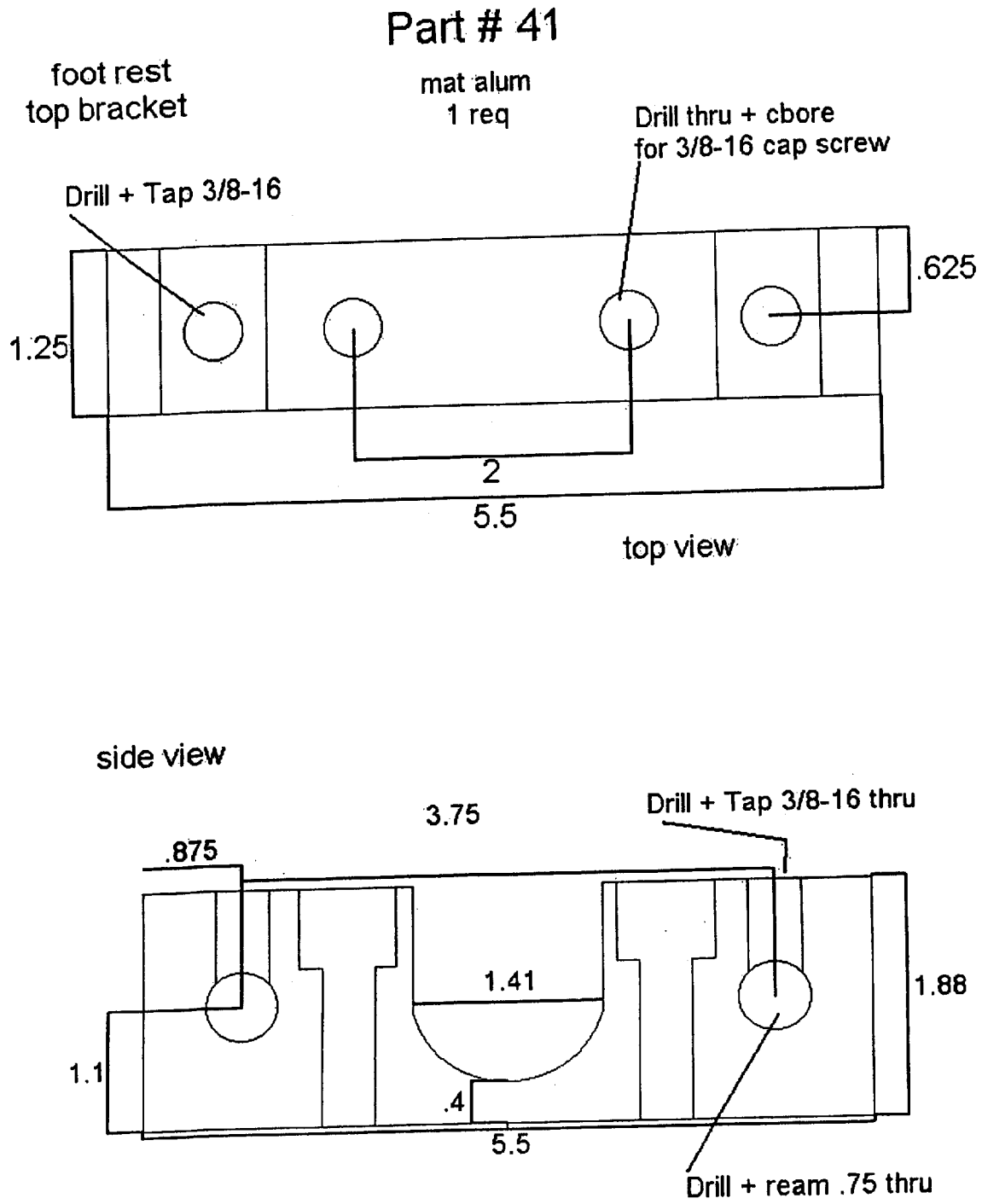

FIG. 38 describes the top view and side view of foot rest top bracket for Part 41. Both brackets attach to seat column Part 41 and 42 and shroud Part 14.

Figure 39:
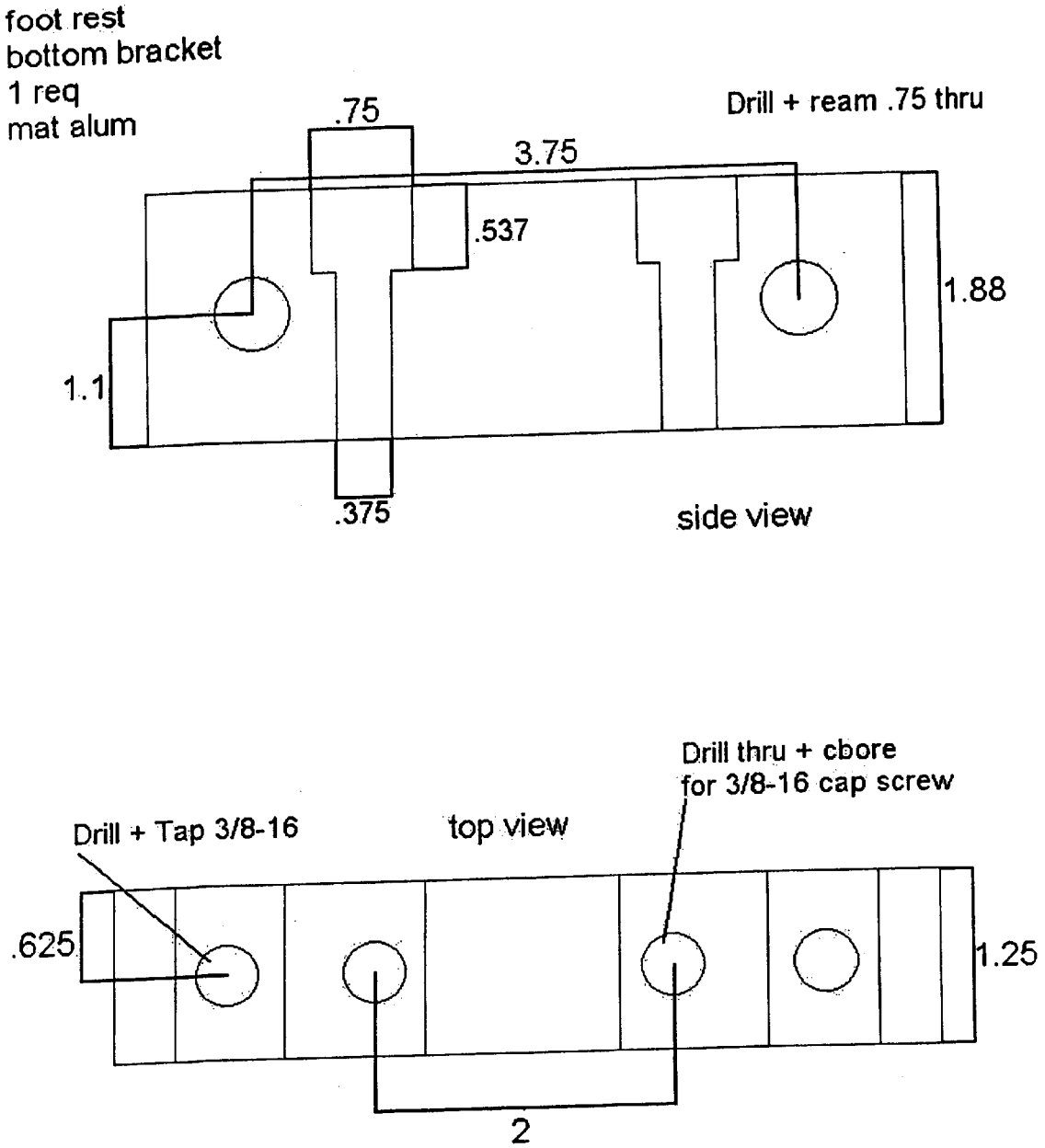

FIG. 39 describes the side view and top view of foot rest bottom bracket (Part 42).

Figure 40:
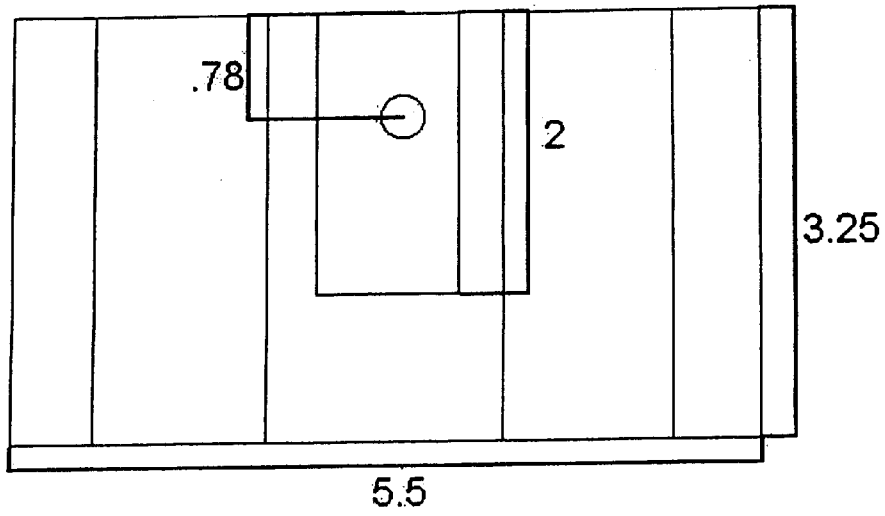
Figure 40:
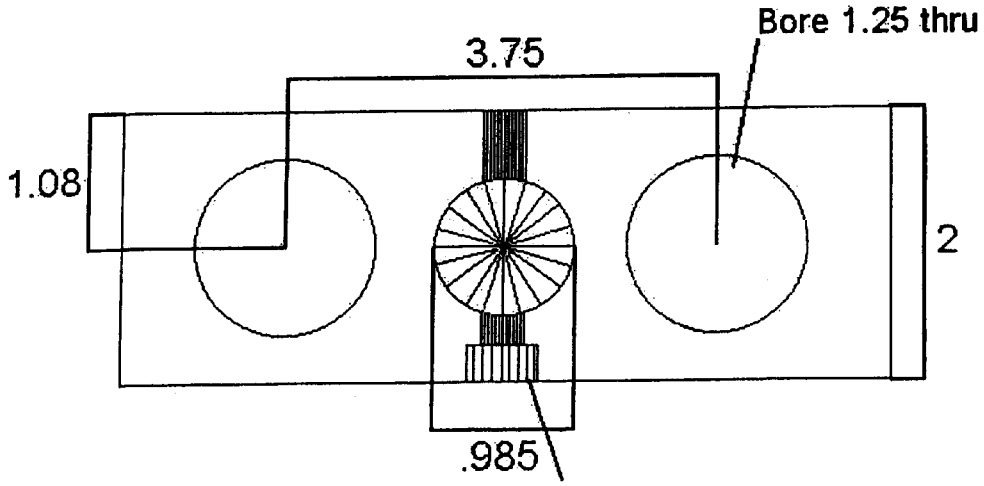

FIG. 40 describe the side view and top view of foot rest bearing block for Part 43 and mounts between Parts 41 and 42.

Figure 41:
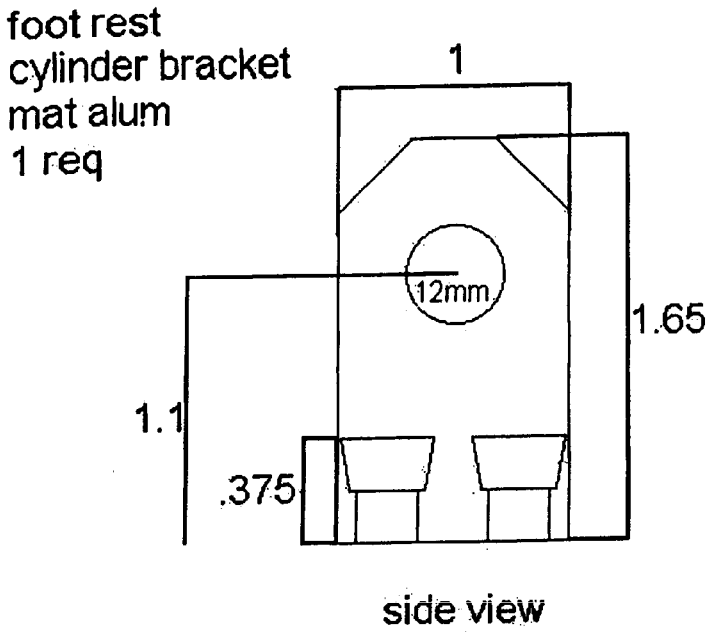
Figure 41:
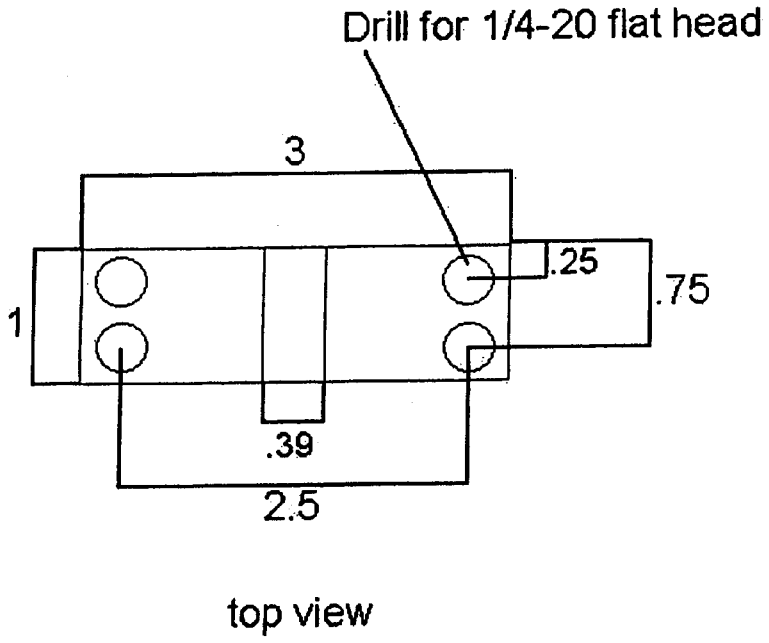

FIG. 41 describes the side view and top view of foot rest cylinder bracket for Part 44, and mounts to seat shroud Part 14. The cylinder mounts to Part 44 and Part 43.

Figure 42:
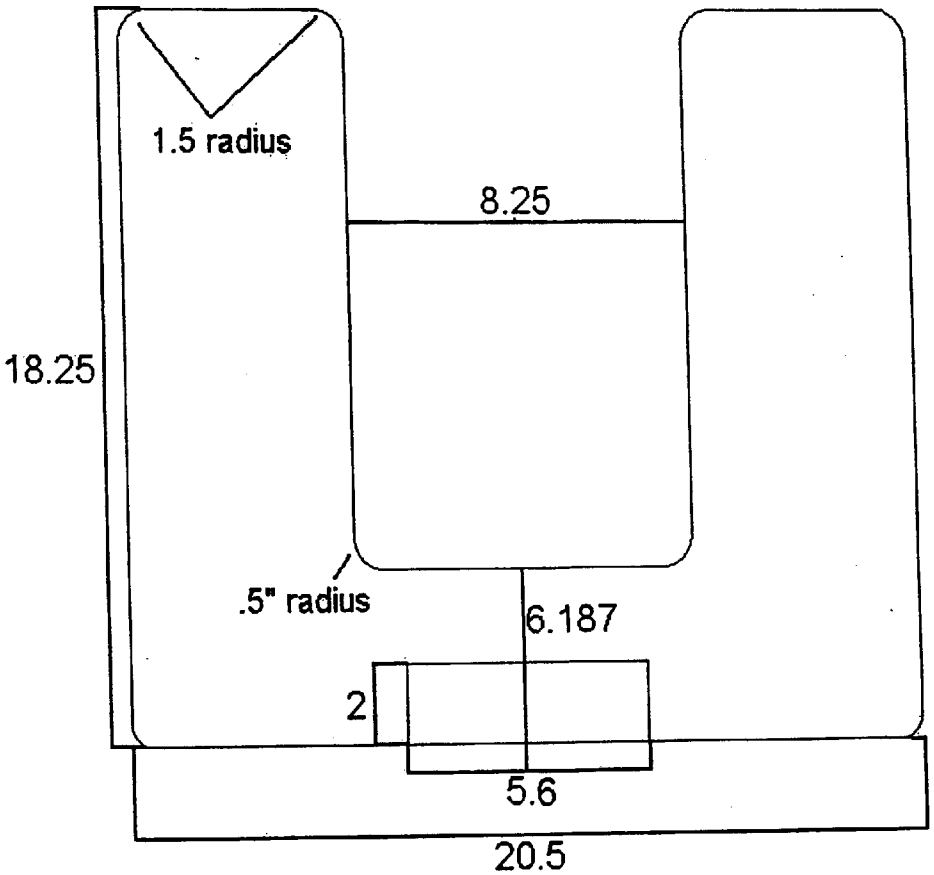

FIG. 42 describes foot rest for Part 46 and mounts to bearing block Part 43.

Figure 43:
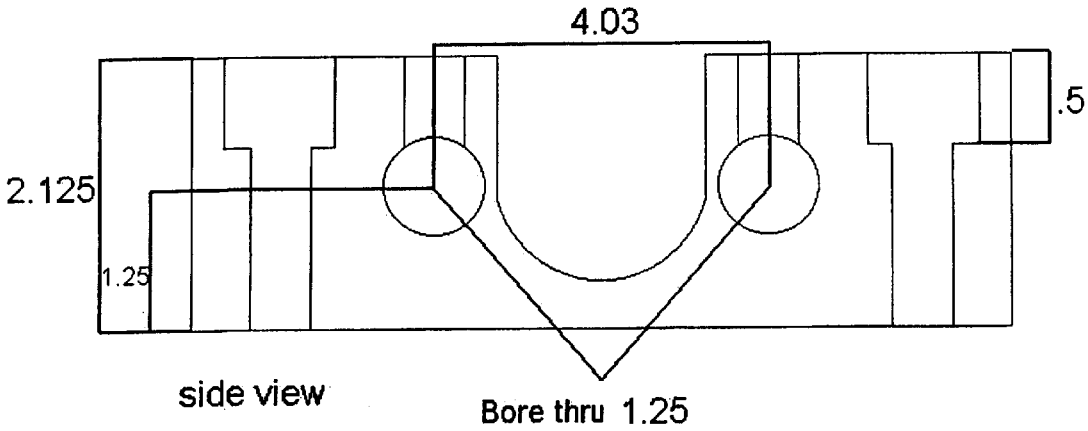
Figure 43:
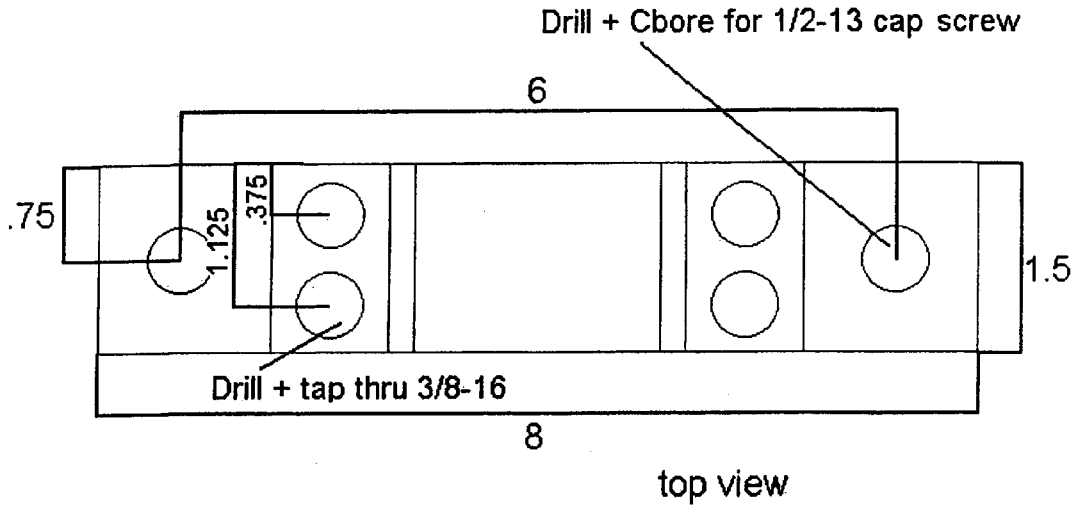

FIG. 43 describes the side view and top view of rest column side brackets for Part 48. Brackets attach to Base Plate.

Figure 44:
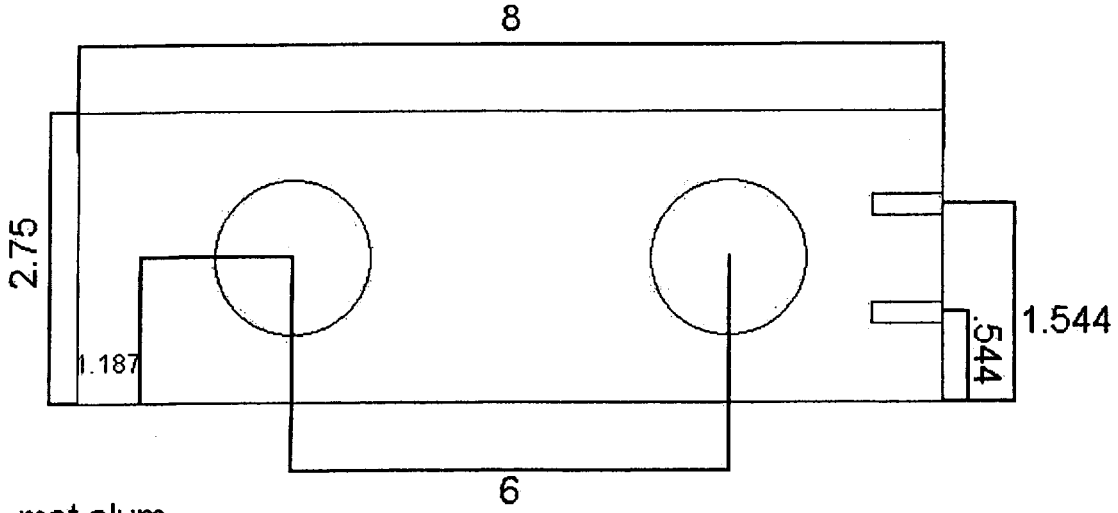
Figure 44:
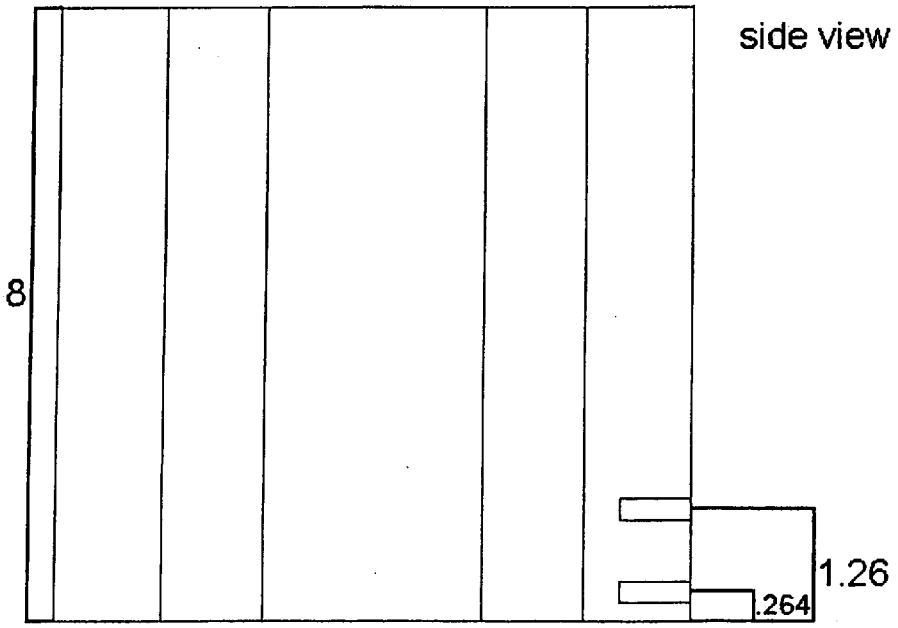

FIG. 44 describes the top view and side view of rest column bearing block for Part 49, and mounts between parts 48 to create linear motion of rest columns.

Figure 45:
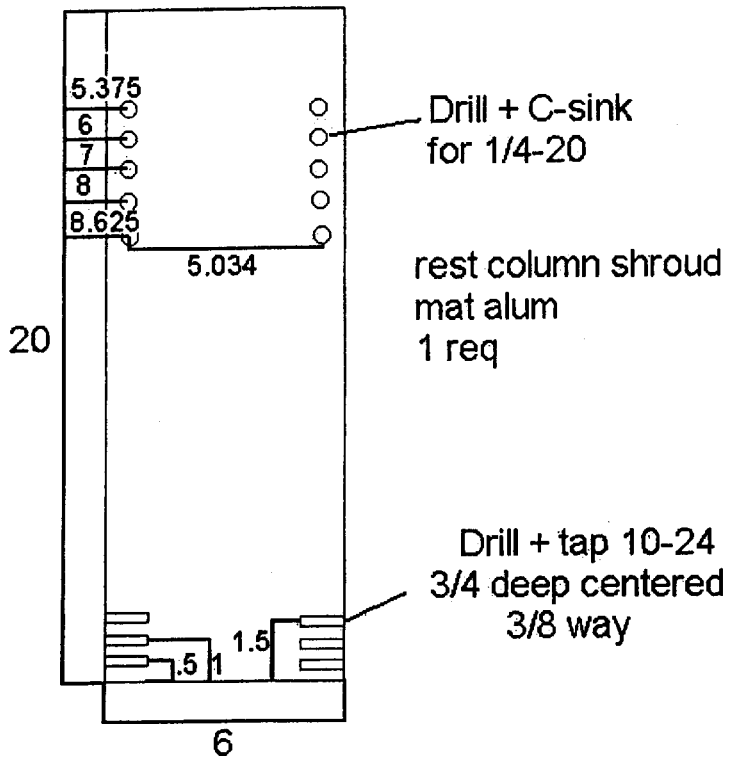
Figure 45:
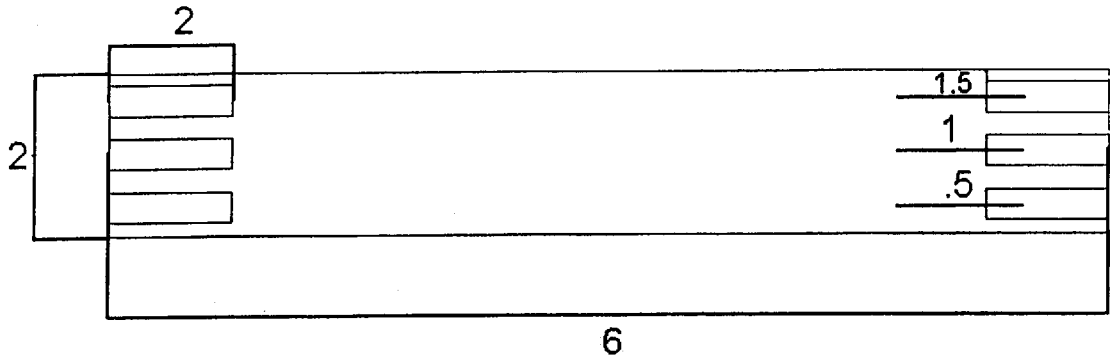

FIG. 45 describes the rest column shroud for Part 50.

Figure 46:
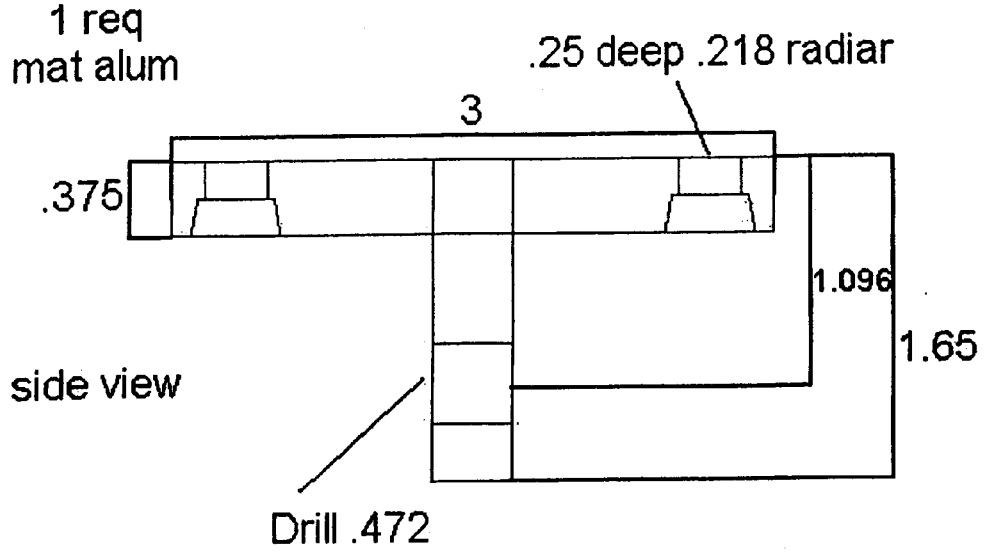
Figure 46:
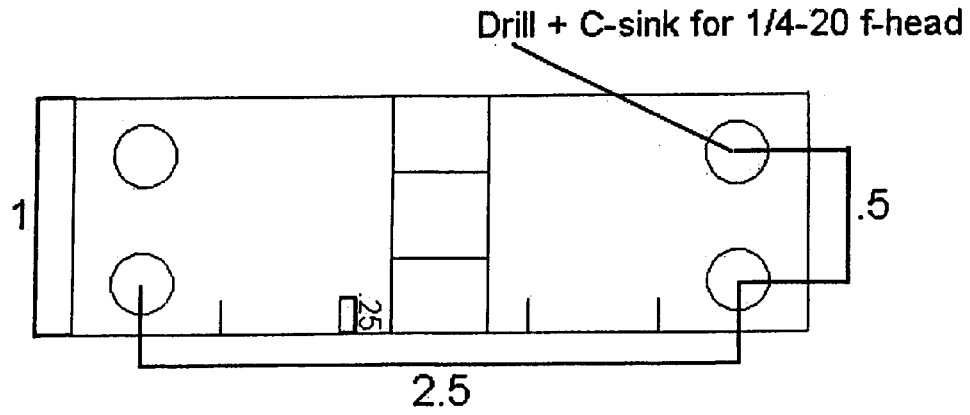

FIG. 46 describes the side view and top view of a column compensator cylinder mount bracket for Part 51, and attaches to the rest column shroud Part 50.

Figure 47:
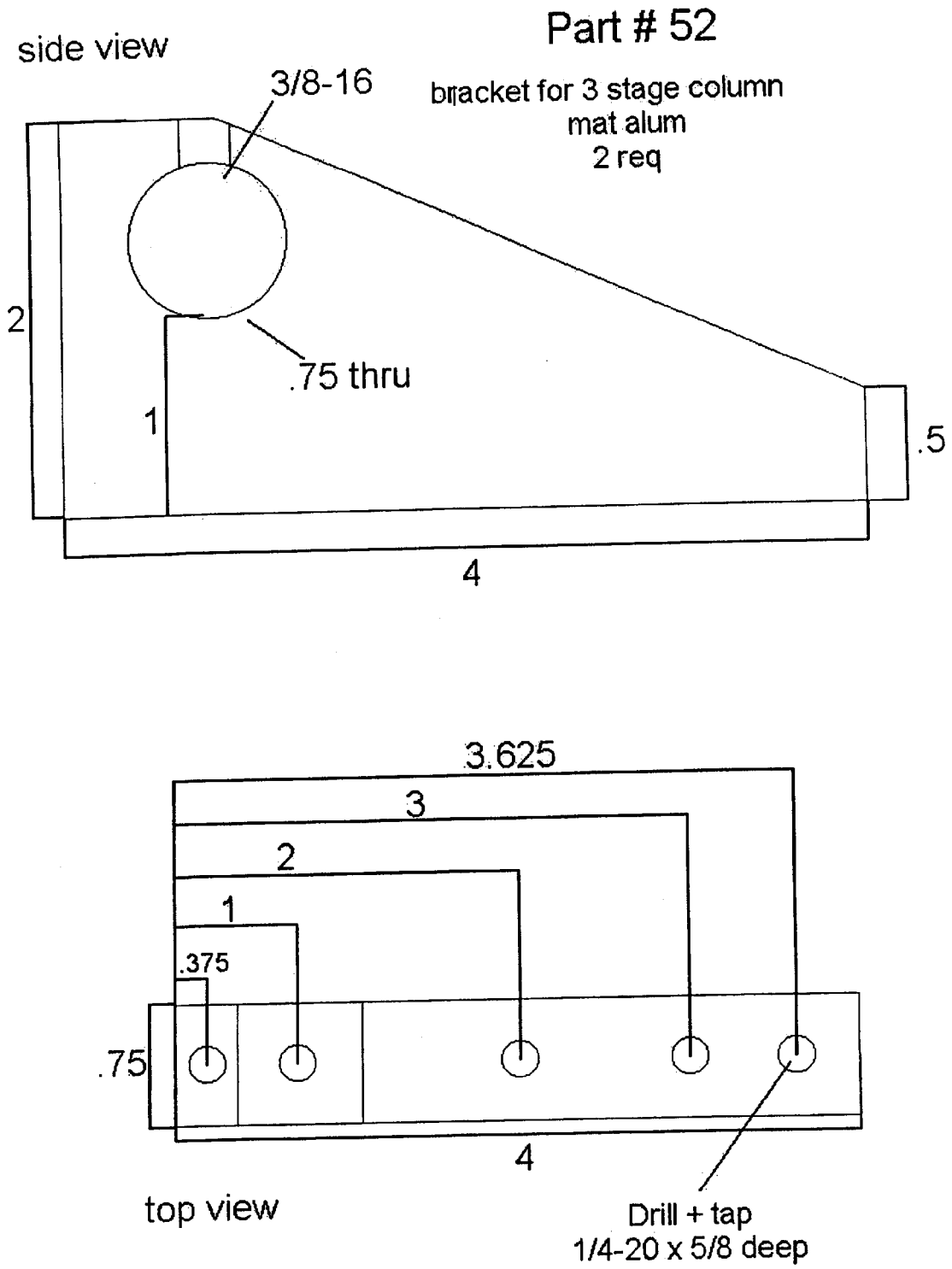

FIG. 47 describes the side view and top view of bracket for 3 stage column (Part 52), and attaches to rest column shroud Part 50.

Figure 48:
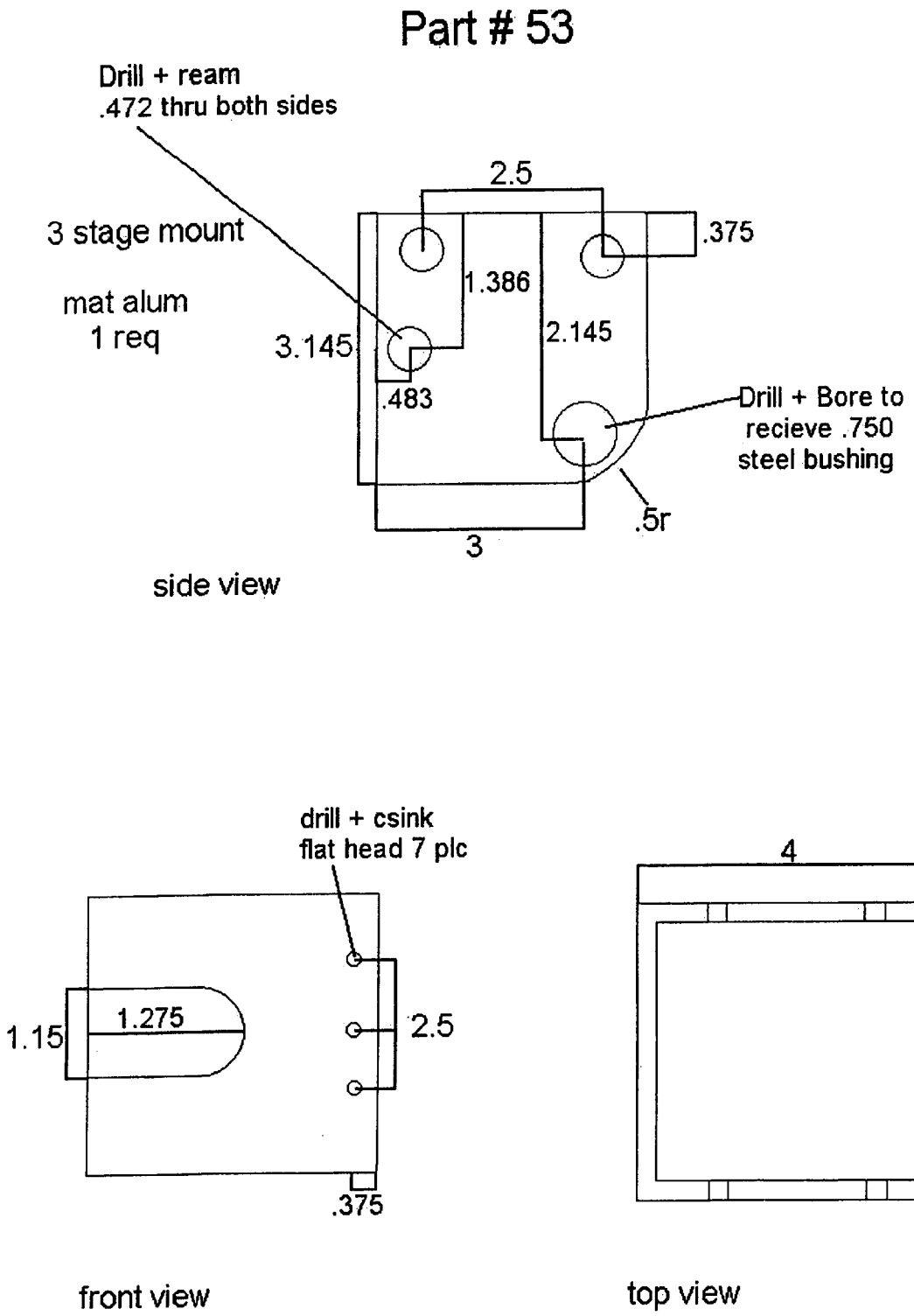

FIG. 48 describes the side view, top view and front view of 3 stage mount for Part 53, and attaches to Part 52 with a ¾"×4" pin.

Figure 49:
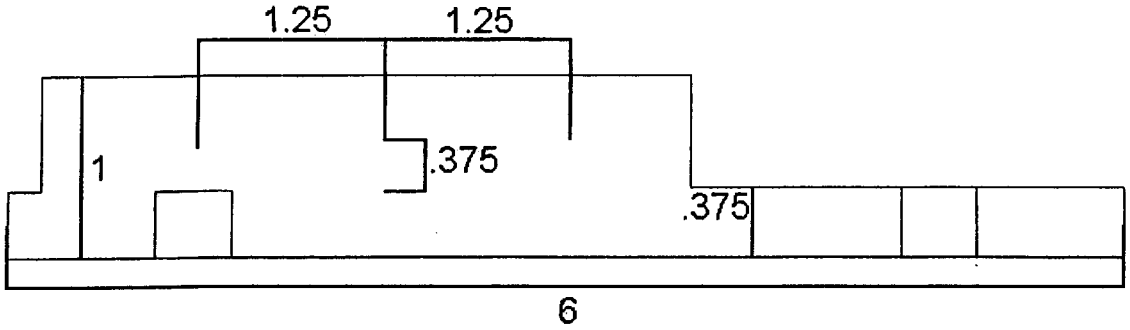
Figure 49:
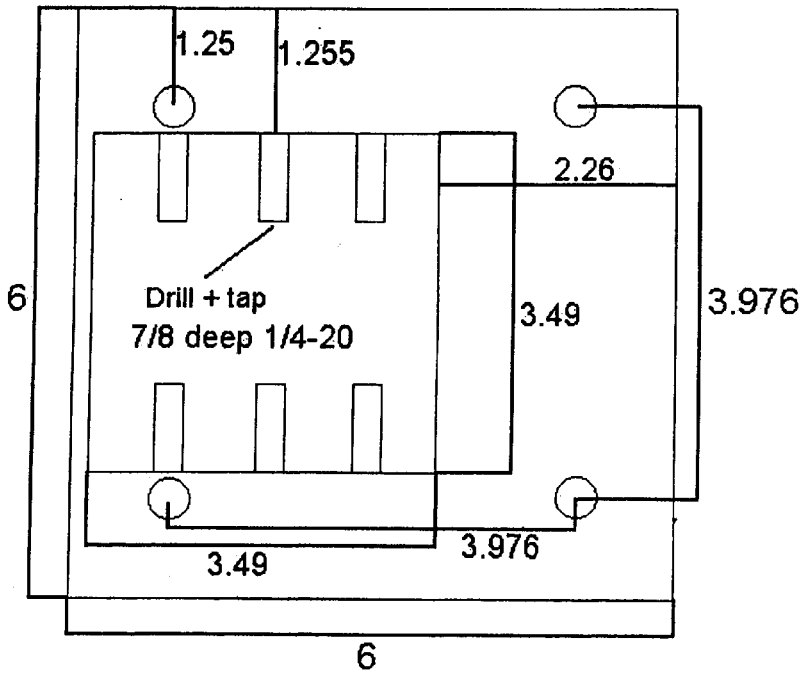

FIG. 49 describes the side view and top view of 3 stage column bottom bracket (Part 54) and attaches to bottom of 3" stage cylinder then mounts to Part 53.

Figure 50:
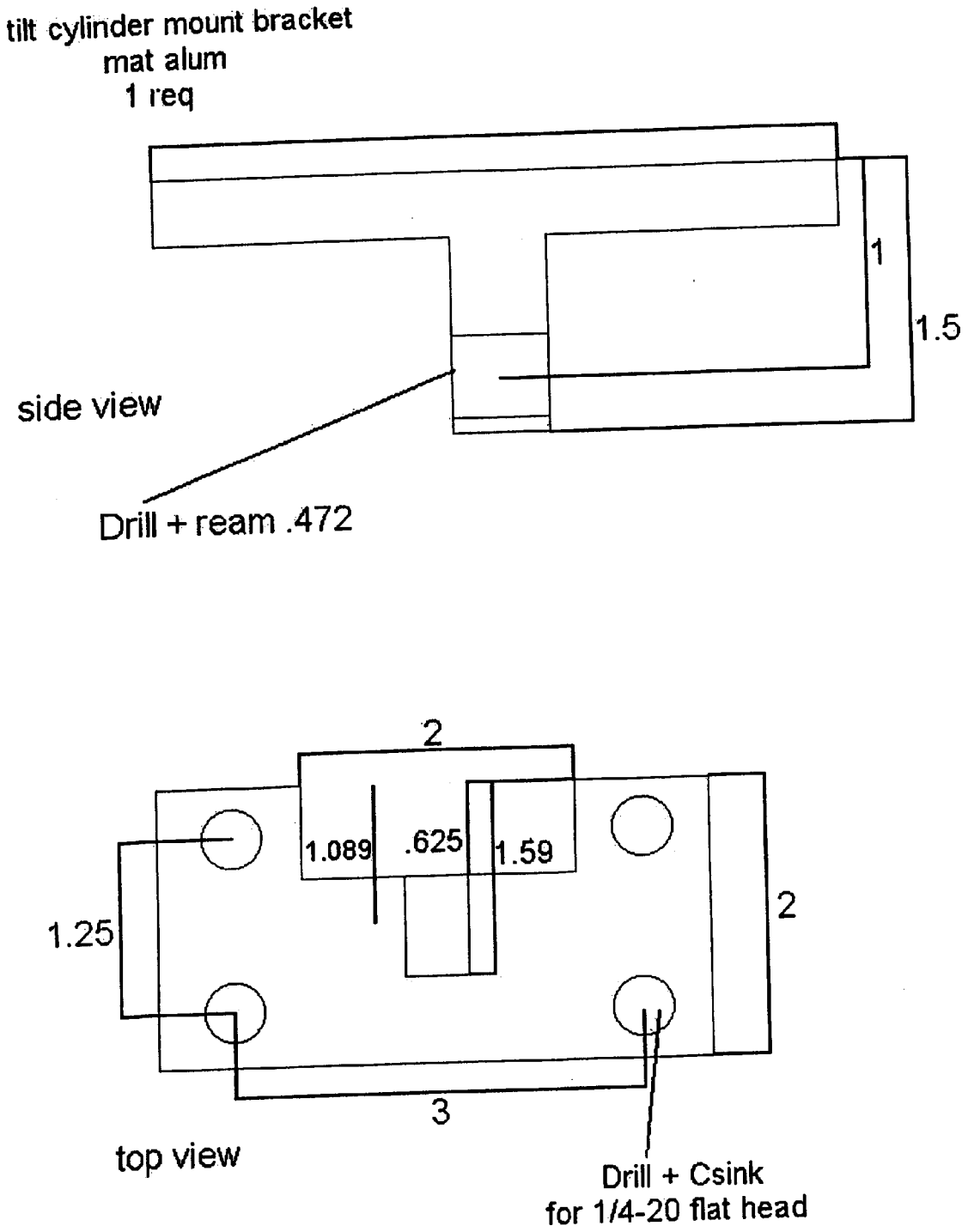

FIG. 50 describes the side view and top view of tilt cylinder mount bracket for Part 55, and attaches to a rest shroud. The cylinder mounts between Parts 55 and 53.

Figure 51:
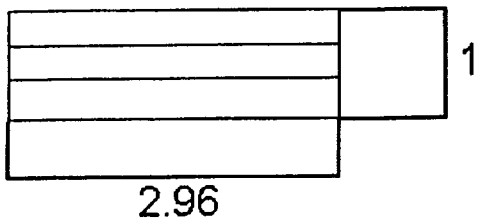

FIG. 51 describes the sway bar spacer for Part 56, and goes on each side of a cylinder end to hold the cylinder in center.

Figure 52:
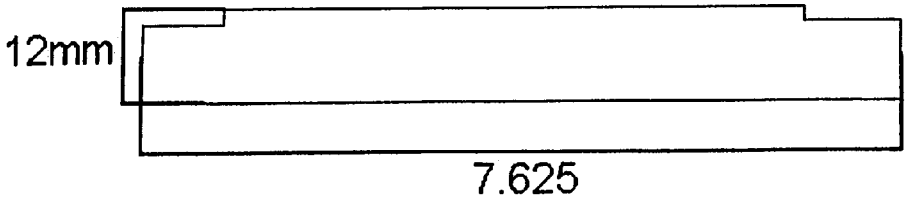

FIG. 52 describes the sway bar pin for Part 57, and attaches Part 58 and cylinder end.

Figure 53:
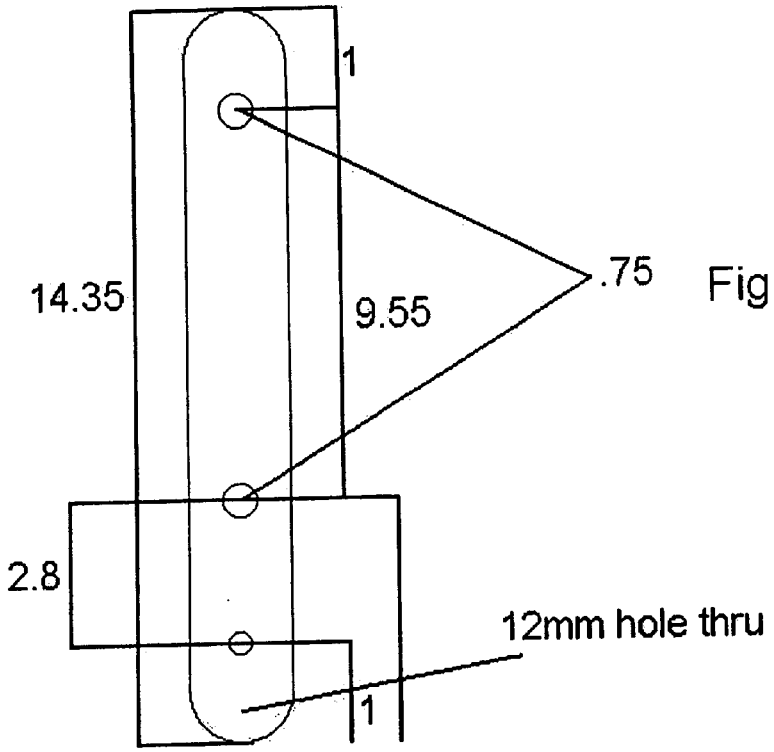

FIG. 53 describes the sway bar for Part 58 and attaches between Parts 60 and 61.

Figure 54:
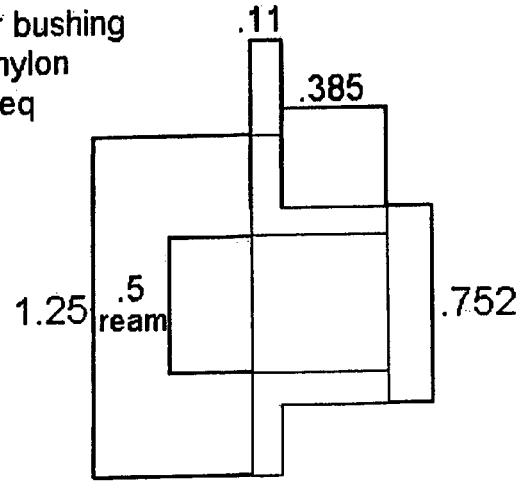

FIG. 54 describes the sway bar bushing for Part 59.

Figure 55:
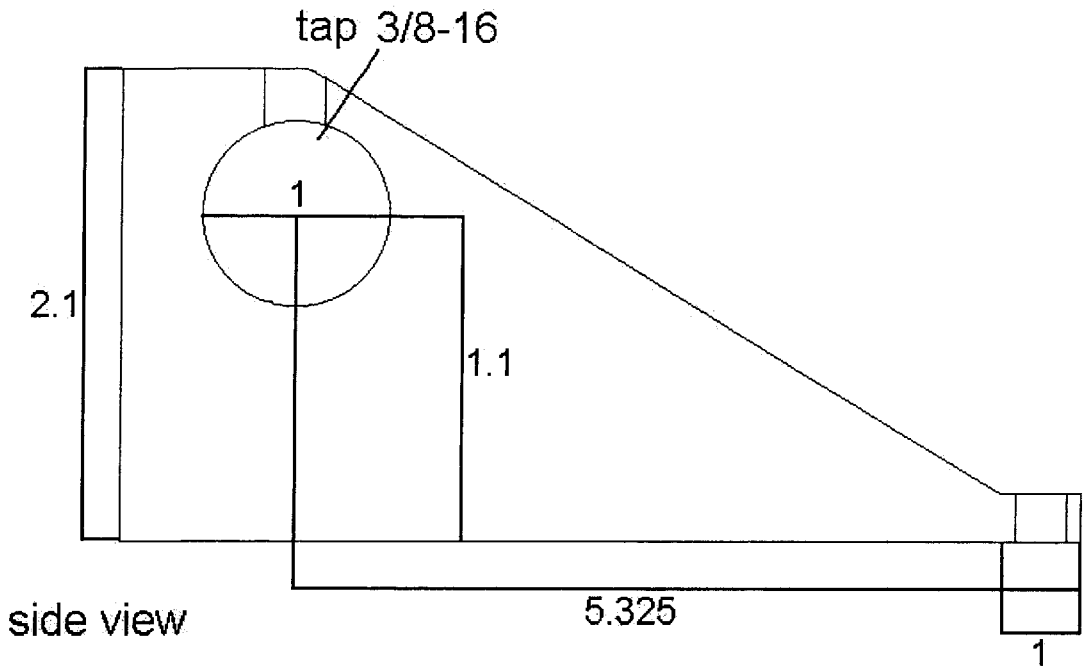
Figure 55:
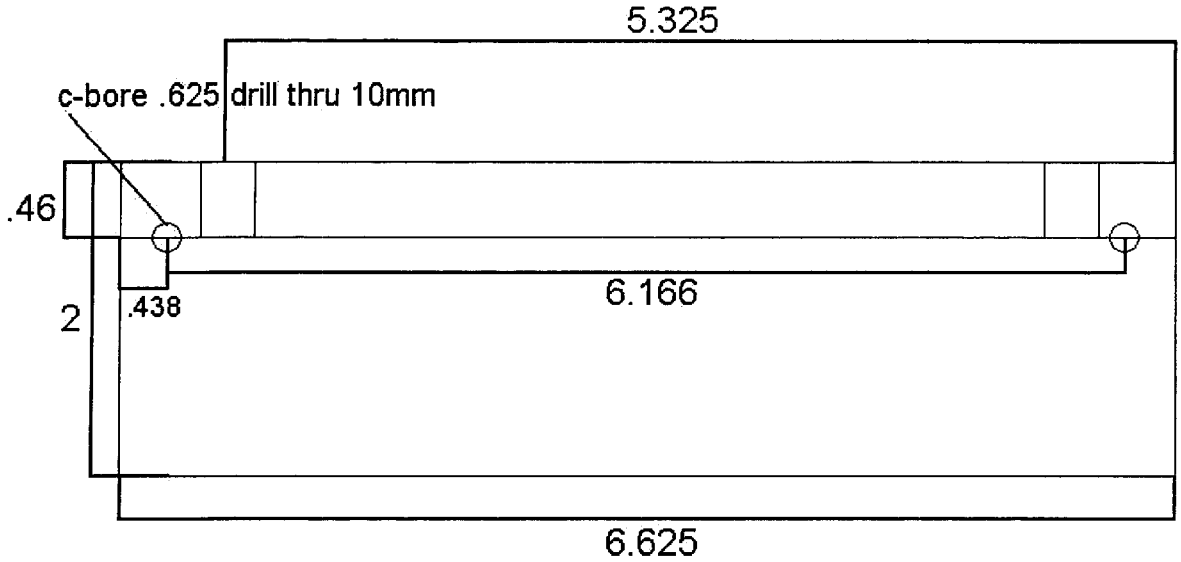

FIG. 55 describes the side view and top view of the sway bar mount for Part 60, and mounts to top of 3 stage cylinder.

Figure 56:
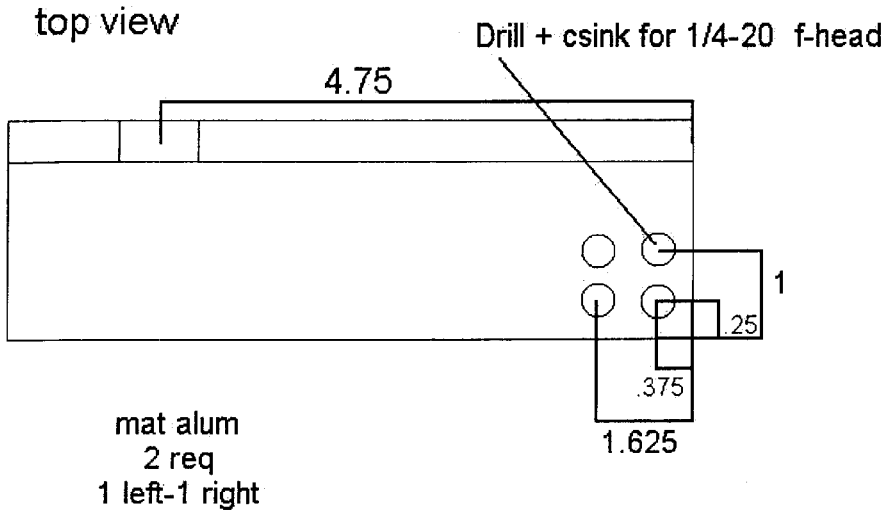
Figure 56:
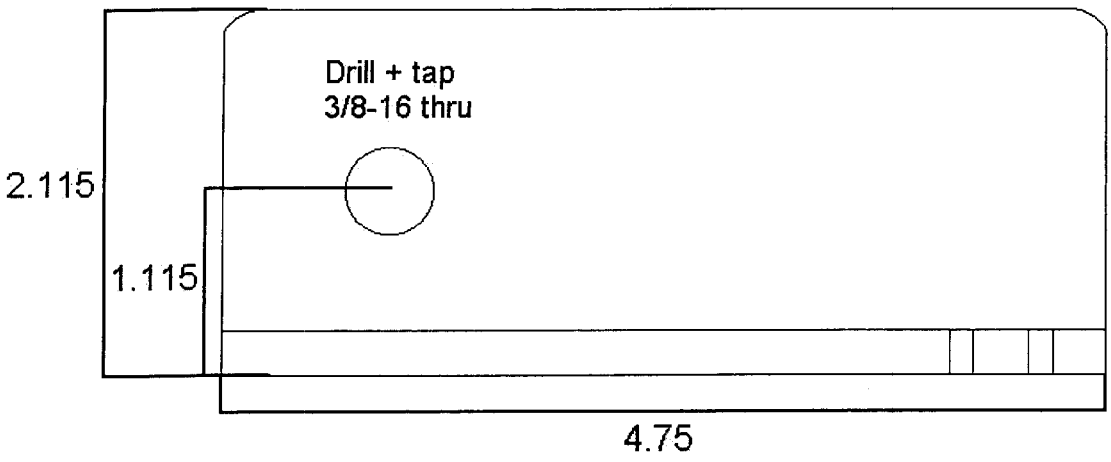

FIG. 56 describes the sway bar mount Part 61, and attaches to bottom of Part 62.

Figure 57:
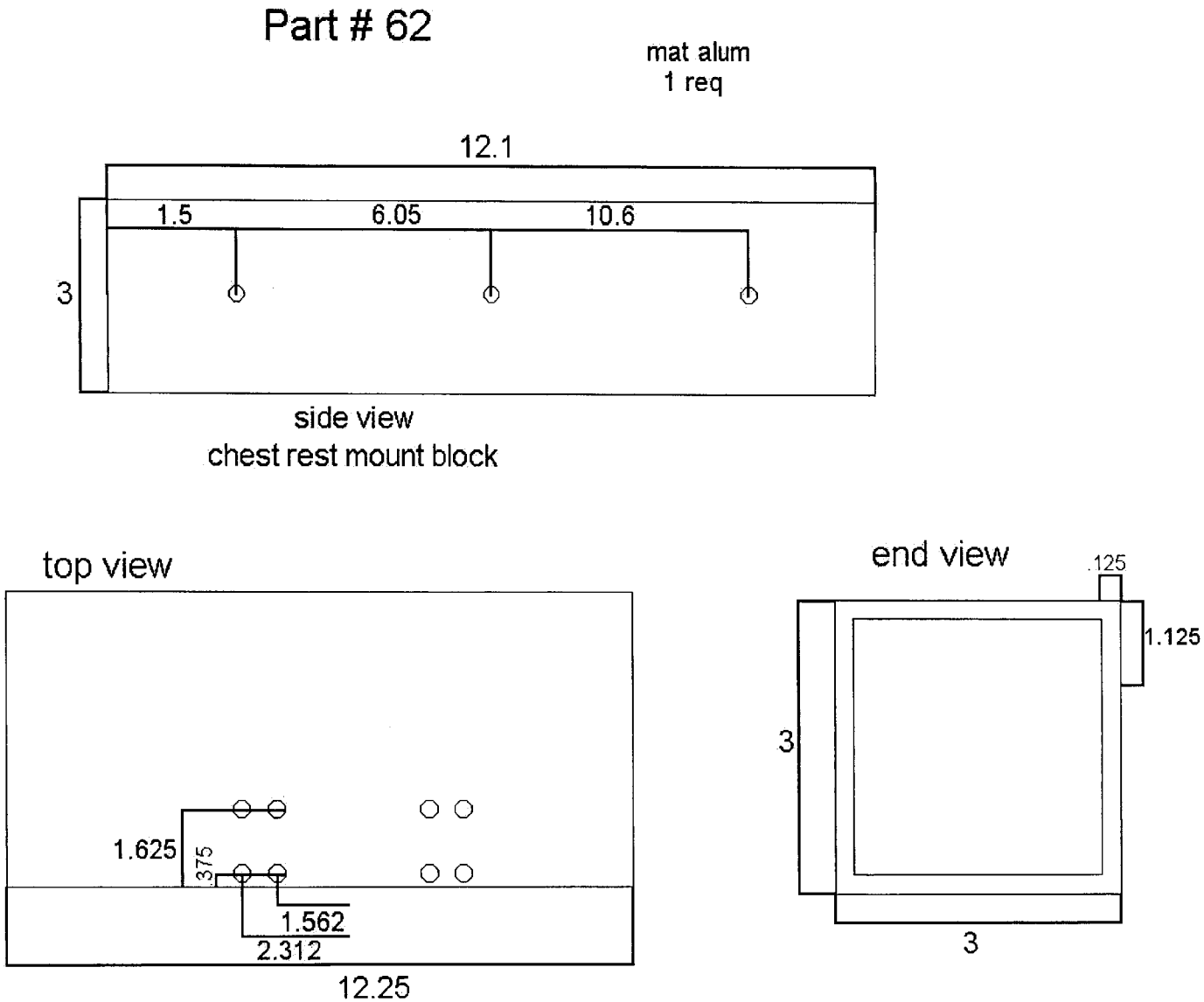

FIG. 57 describes the side view, top view and end view of chest rest mount block Part 62, and mount for Part 65.

Figure 58:
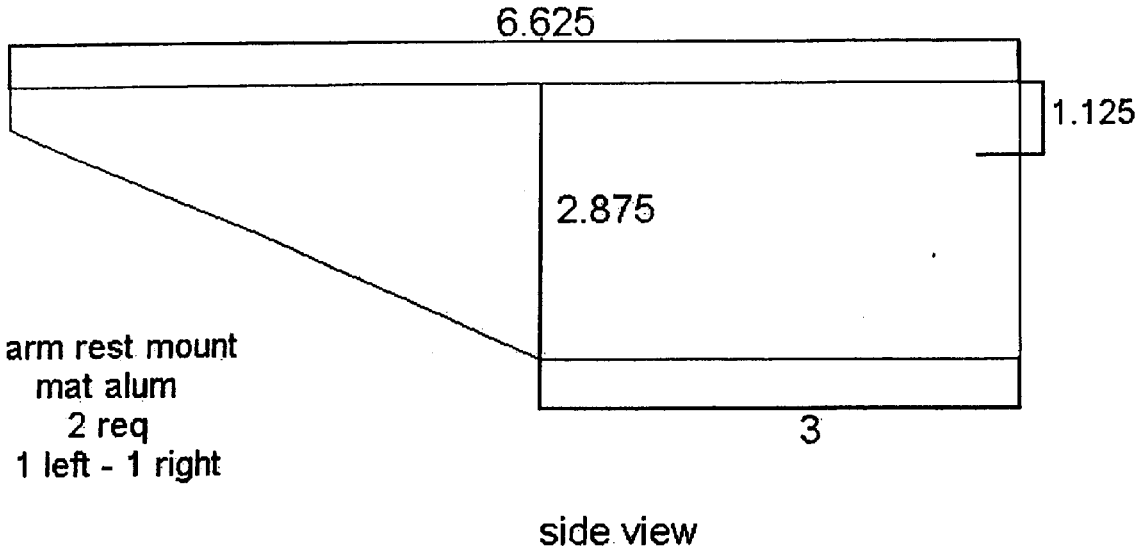
Figure 58:
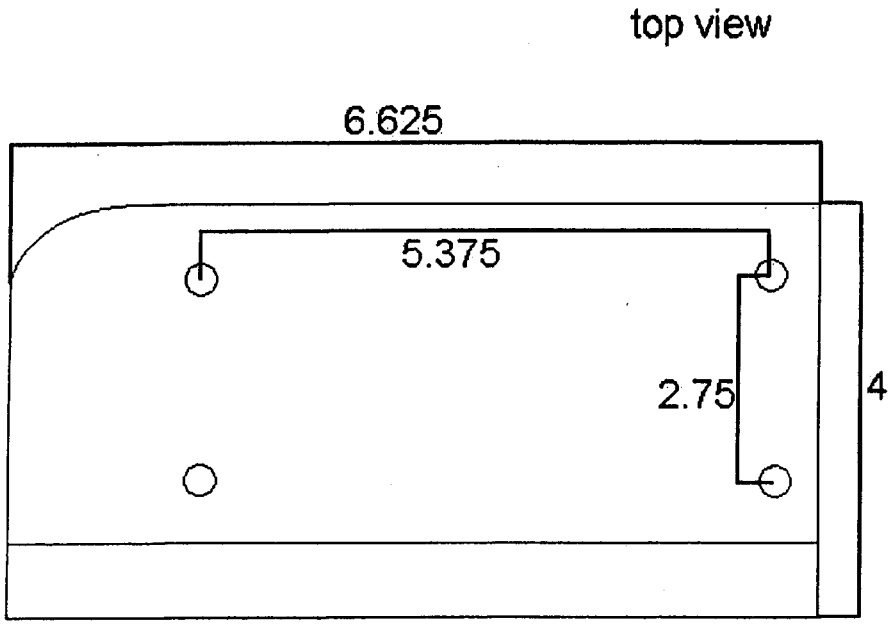

FIG. 58 describes the side view and top view of the arm rest mount for Part 63, and act as slide mount for arm rest—upper.

Figure 59:
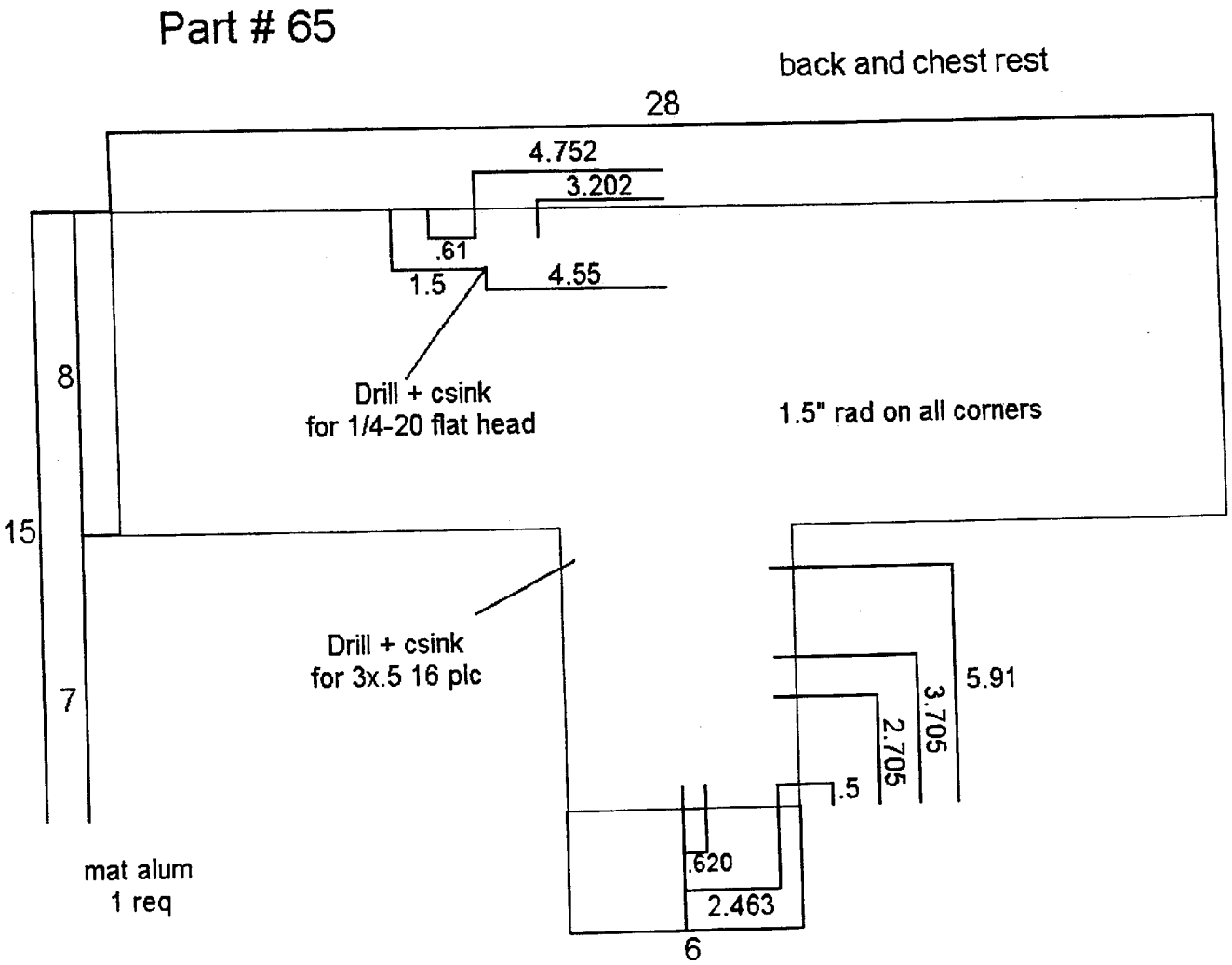

FIG. 59 describes the back and chest rest for Part 65 and attaches to Part 62.

Figure 60:
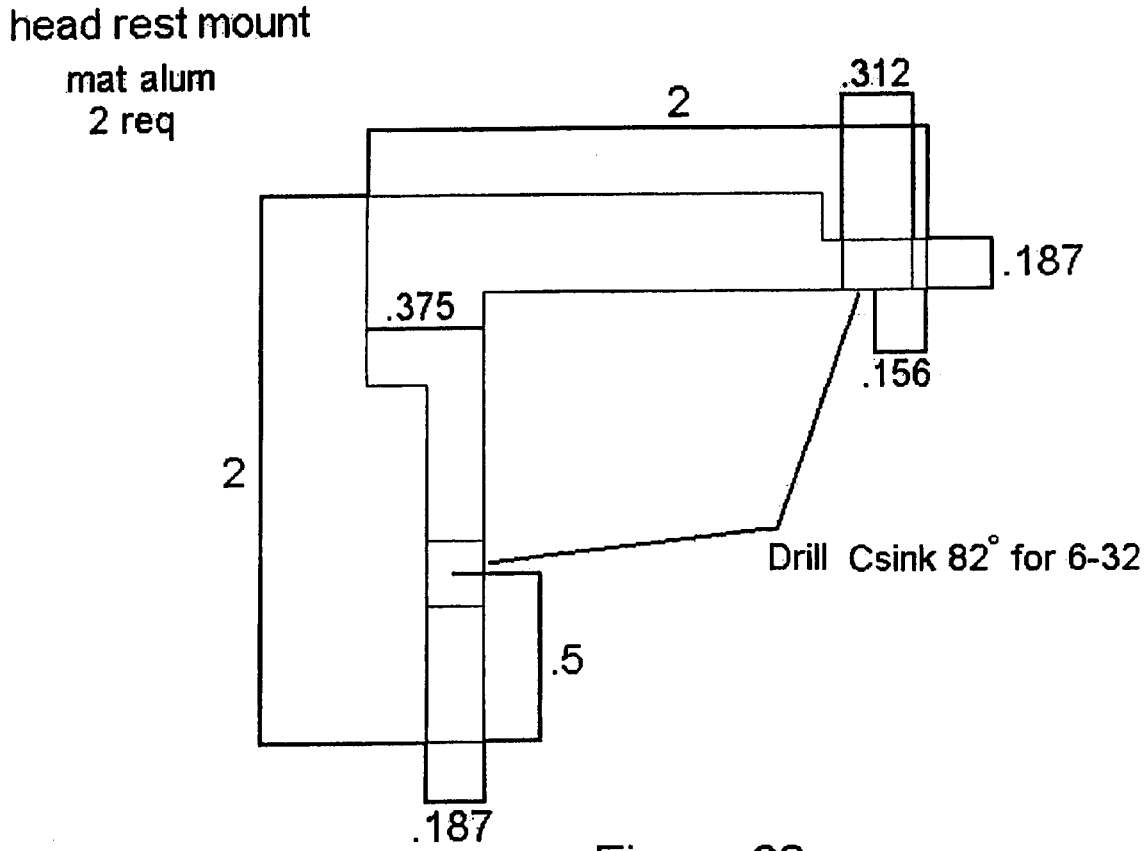

FIG. 60 describes the head rest mount for Part 66 and attaches to Part 65.

Figure 61:
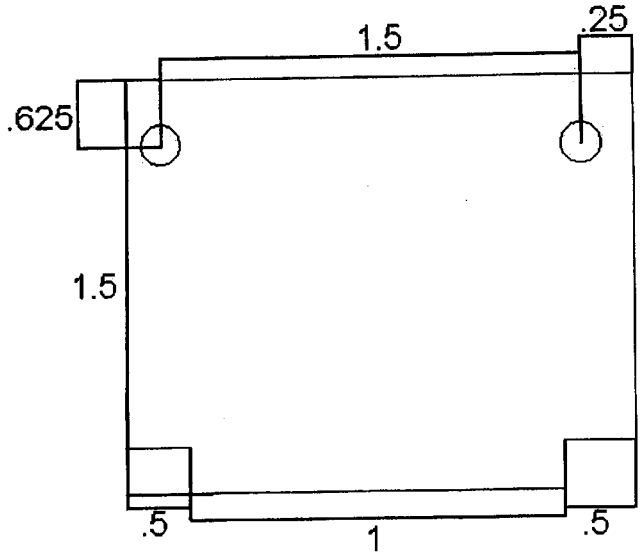

FIG. 61 describes the head rest hinge for Part 67 and attaches to Part 66.

Figure 62:
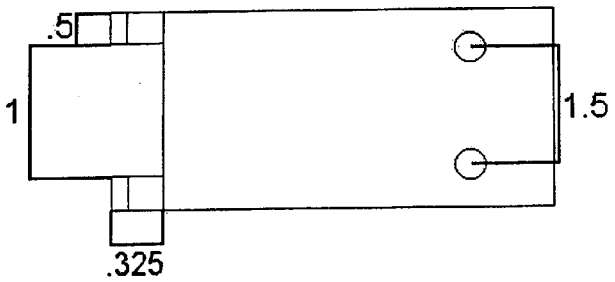
Figure 62:
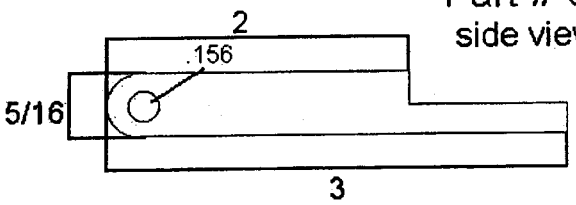

FIG. 62 describes the top view and side view of head rest hinge Part 68, and attaches to Part 67.

Figure 63:
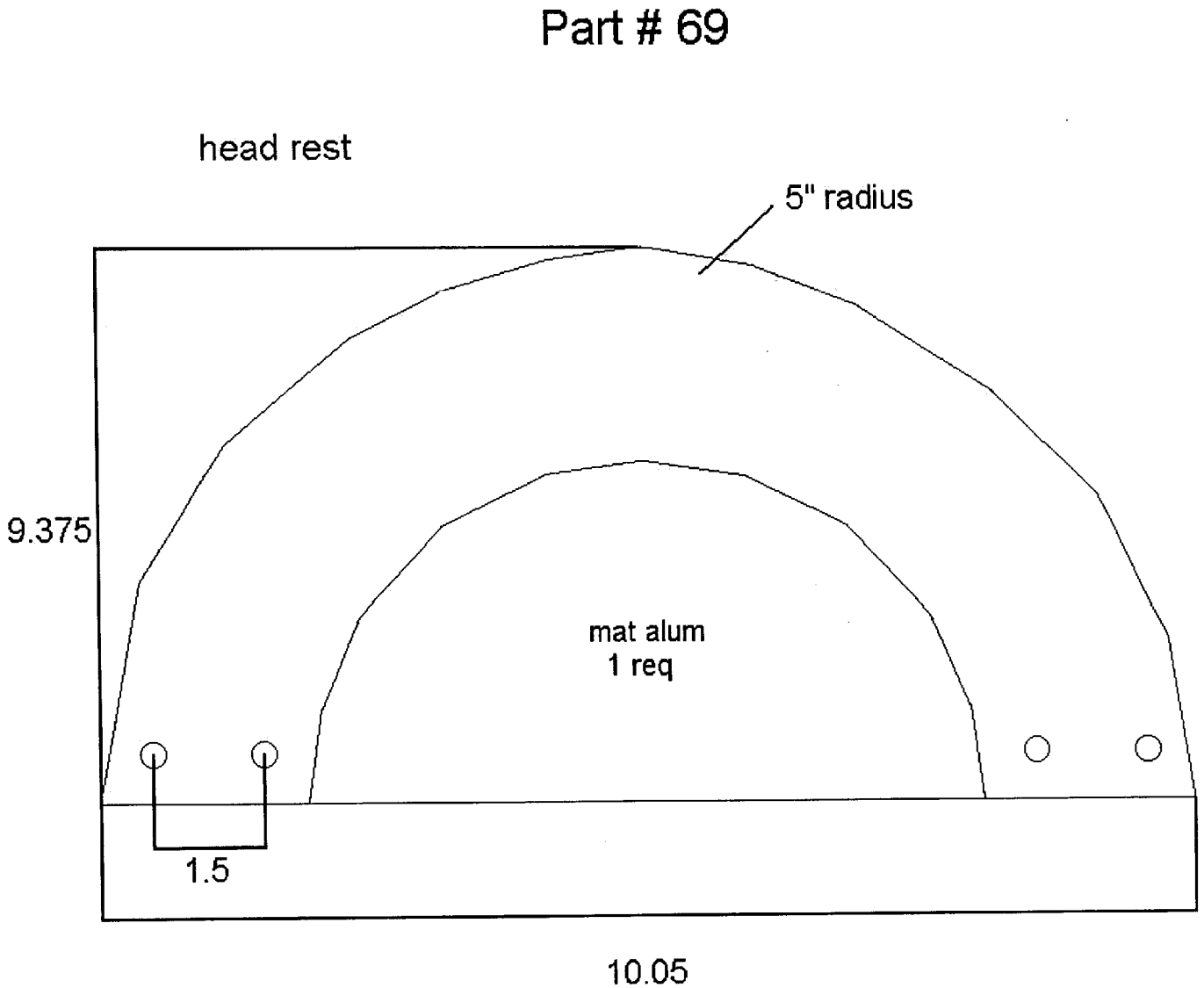

FIG. 63 describes the head rest for Part 69, and attaches to part 68.

DETAILED DESCRIPTION OF THE PREFERRED EMBODIMENTS

A seating device for maneuvering a body part comprising a fully adjustable chair including a base assembly, an occupant supporting assembly and an elevator assembly including drive mechanisms for raising, lowering and tilting the occupant supporting assembly. The chair has a head rest, leg rest, chest rest and a plurality of arm rests. The chair has full adjustment in all axes: rotation around a vertical central axis; vertical height adjustment; fully adjustable seat back for proper lumbar support; and tilt of the seat. The base assembly includes a power unit biased toward the floor. The invention permits support of the occupant with a full range of adjustment so that the occupant can have proper positioning for selected medical procedures and body part positions.

Figure 1:
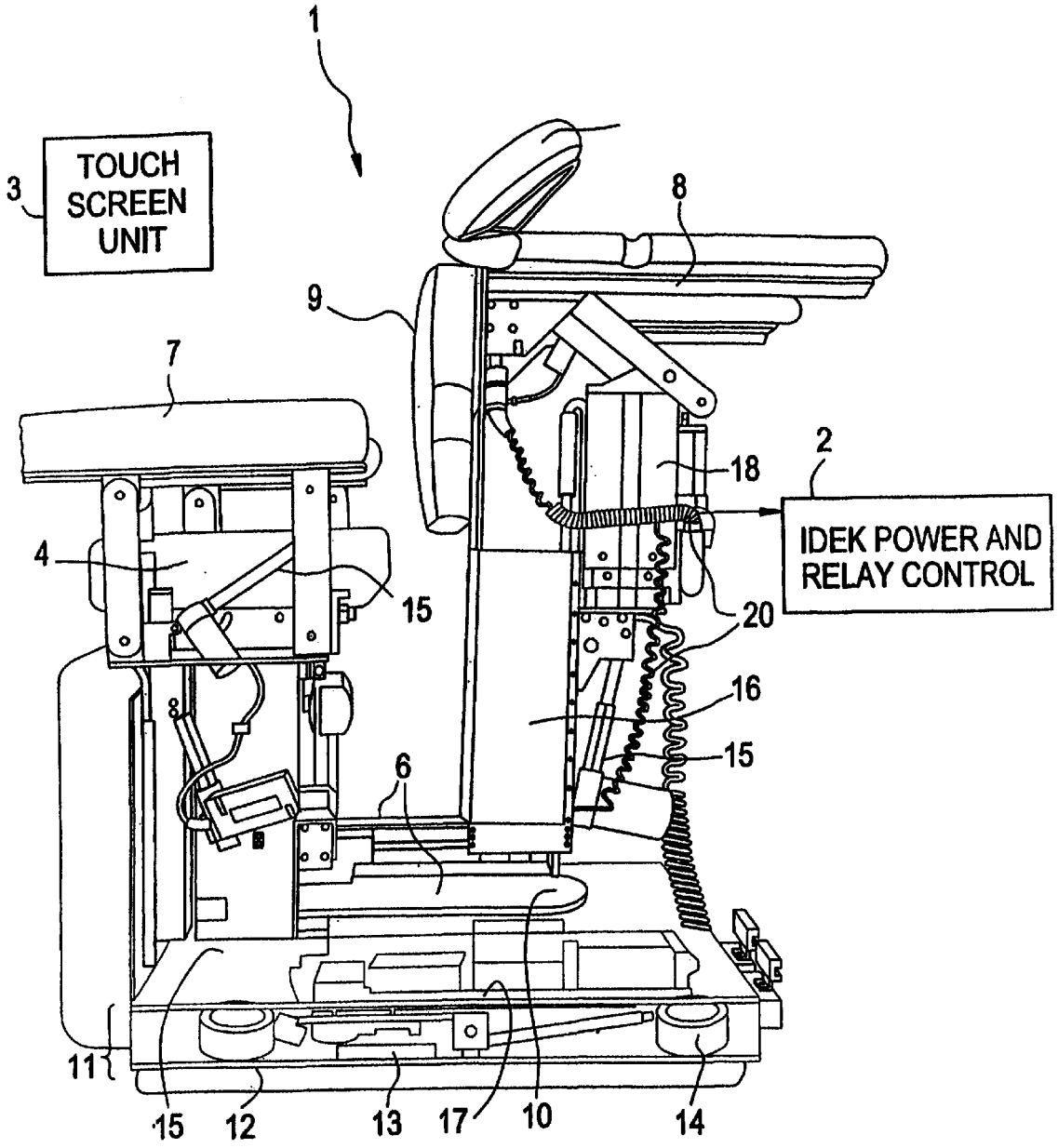
FIG. 1 is a right side view of a treatment chair constructed in accordance with the invention, but having some items such as arm rests, removed for clarity.
Figure 2:
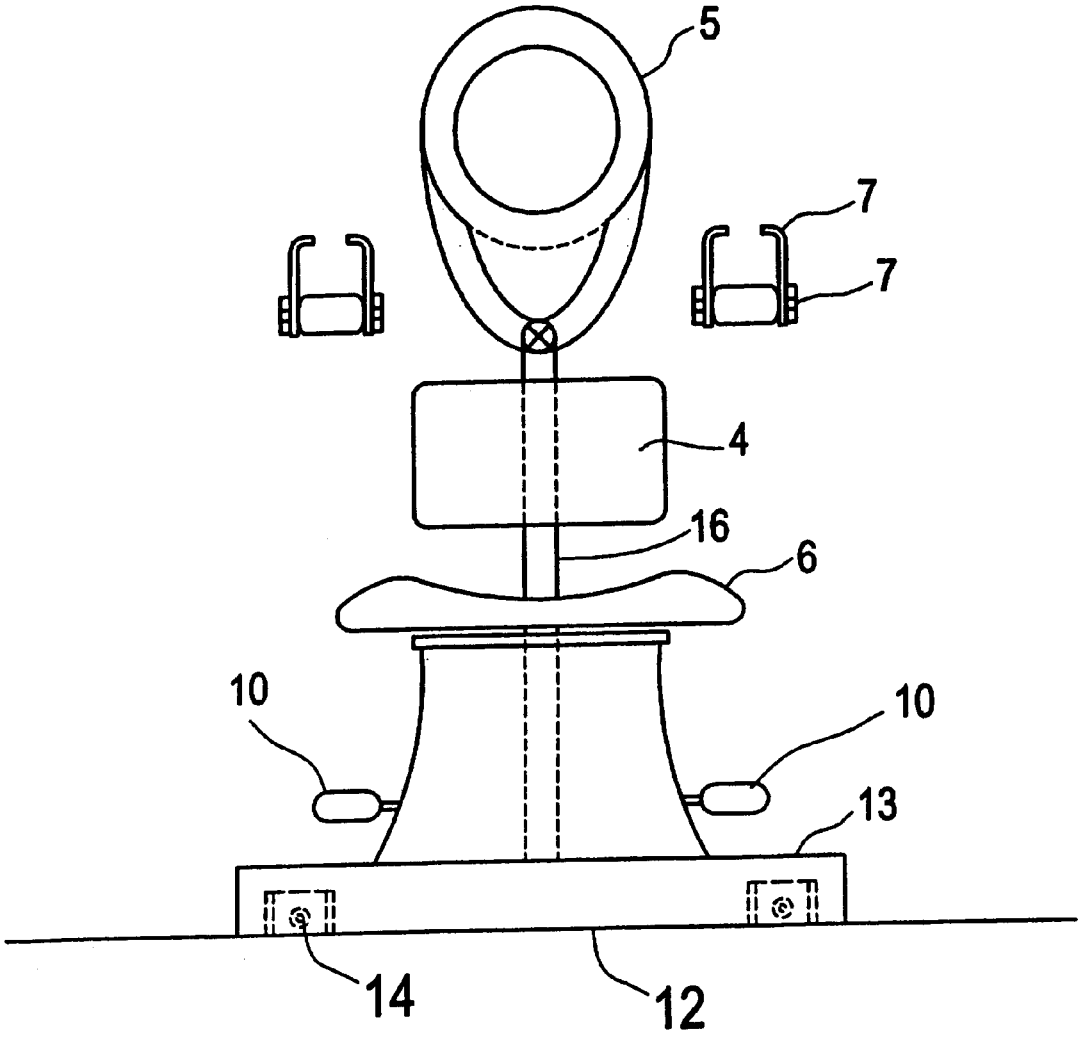
FIG. 2 is the front elevational view of a simplified version of the chair illustrated in FIG. 1.

Referring to the drawings, there is shown in FIG. 1 a preferred arrangement of power-operated instrument assembly and treatment chair device in accordance with this invention. The apparatus includes a treatment chair for receiving and supporting an individual in a desired position, an IDEK power and relay control unit 2 housing a plurality of DC actuators, relays and breakers, to provide electrical power to the treatment chair device assembly. The device, as shown in FIG. 1, may also include an auxiliary unit comprising the touch screen control unit 3 which may be detached from the treatment chair 1 and the IDEK power and relay control unit 2. The relay control unit 2 is adapted to carry power-operated switches and various electronic circuits and accessories for accessing the individual structural elements of the treatment chair, to enable proper positioning of the patient in the treatment chair 1.

Referring firstly to the treatment chair, this chair may be constructed to provide power-operated for up-down-movement, forward-and-reverse movement, movement between an upright and a reclined position, lateral movement or angular and pivotal movement. Generally, the chair comprises an occupant-supporting assembly or seat 4 which may include a head rest 5, two leg rests 6, two arm supports 7, two arm rests 8, a chest column 9 and a foot rest 10. The treatment chair 1 further includes a base assembly 11. The base assembly 11 includes a stationary portion 12 (See FIGS. 1 and 4) for supporting the treatment chair on a floor or surface and a housing unit 13 suitably mounted over the stationary portion 12 and including ball bearings 14 or the like, connected by the rods 17, for providing swiveling or movement of the treatment chair.

The treatment chair further includes a central elevator control assembly 16 connected to and between the seat 4 and the base assembly 11. An electrically operable control means, preferably in the form of an actuator motor 15 is connected with the elevator assembly 16 for operating the same to raise and lower the treatment chair 1. The specific construction and elevator of the central elevator control 16 for raising and lowering the chair 1 includes a-hollow housing to which an actuator 15 is secured. The actuator 15 includes a shaft extending outwardly therefrom to be driven in either direction of rotation.

Specifically, an adaptive power operated chair device comprises a base assembly; a central elevator control assembly pivotally secured to said base for vertical pivotal movement relative thereto including a seat support member having a seat portion at its upper end for supporting the buttocks of the chair occupant, and a leg support portion extending downwardly therefrom for supporting the legs of the occupant, and foot support member pivotally secured at its rearward end to the forward end of the leg portion for vertical pivotal movement relative thereto, operating means secured between said elevator assembly and said base for pivotally moving said elevator assembly relative to said base, operating means secured between said foot support member and said seat-leg support member for pivotally moving said foot support portion relative to said leg support portion, a back rest means pivotally secured to said base at the upper end of said central elevator assembly for vertical pivotal movement relative thereto, operating means secured between said back rest means and said base for pivotally moving said back rest means relative to said central elevator assembly and said base, each of said operating means secured to a power supply for operating same, and selective control means operatively connected with said operating means for selectively controlling the movement of each of said operating means independently to provide the occupant with selective positioning of said foot support portion, said leg support portion, and said back rest means relative to one another and to said base.

A plurality of actuators 15 are adapted for relative movement with respect to the housing of the elevator 16, the arm supports 7 and the chest rest 9.

Specifically, the adaptive power-operated chair device comprises a chest rest member pivotally secured at its lower end to the central elevator assembly for vertical pivotal movement relative thereto, a head rest member pivotally secured at its forward end to the chest member for horizontal pivotal movement relative thereto, operating means secured between said chest support means or said head rest member and said central elevator assembly each of said operating means secured to a power source for operating same, and selective control means connected with said operating means for selectively controlling the movement of each of said operating means independently to provide the occupant with selective positioning of said chest rest member and said head rest member assembly relative to one another, said central elevator assembly and to said base assembly.

The adaptive power-operated chair also includes left and right arm rest means pivotally secured at each lateral side of said chest rest member for independent vertical movement relative thereto, operating means secured between said left and right arm rest means and said chest rest member for pivotally moving each arm rest means independently relative to said chest rest means, and selective control means on said arm rest means for selectively controlling the movement of each said operating means independently to provide the occupant with selective positioning of said central elevator assembly, said chest member, and said left and right arm rest means relative to one another and to said base assembly.

A second control means 18, preferably in the form of an electrically operated motor and actuator 15 is connected with the central elevator control 16 for operating the same. The second control means 18 is connected to the IDEK control unit 2 by an electrical cable harness 20.

Specifically, the operating means comprises one or more operable actuator motor assemblies, said power means comprises electrical energy, and said control means comprises a series of switches for reversibly conducting such electrical energy to selectively extend or retreat the same.

Figure 3:
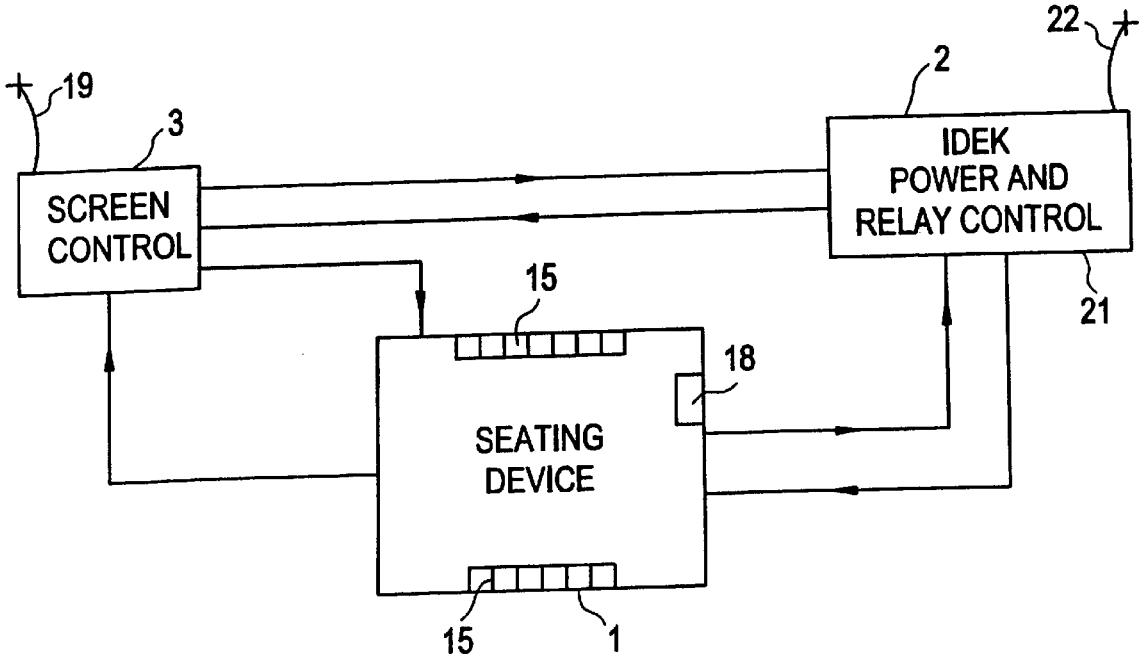
FIG. 3 is the electrical circuit of the entire assembly of one embodiment of the treatment chair.

Referring more specifically to FIG. 3 which illustrate in detail the IDEK control unit 2, it may be seen that the IDEK Control unit 2 comprises a housing 21 in which are stationed a plurality of DC actuators, relays and breakers. The IDEK Control unit 2 is attached to a power supply by an electrical cable 22, and to the Touch Screen Control unit 3.

As shown in FIG. 3, the Touch Screen Control unit 3 comprises a source of electrical energy, indicated schematically, an electric circuit indicated schematically and collectively between the source of the power 19, the control means 18 and each of the actuators 15.

Specifically, the control means includes a touch screen unit including a plurality of switches, said touch screen unit mounted on a movable means for moving such control means to a location adjacent said power-operated chair, the chair occupant or an operator.

For example, if the switch is manually turned on the Touch Screen control 3 to a chair mode, the seat column will be energized to complete the electric circuit for causing operation thereof for raising or lowering movement. Thus, the electrically operated selective movements of the treatment chairs may be controlled individually and separately for each of the modes for which the Touch Screen Control is programmed, for example, the chair mode, sleep mode, rotate mode, compression of spine mode, traction mode and so on.

The device 1 is provided with several optionally usable accessories including two detachable arm cushion rests, detachable pillows, leg, waist, torso and head straps, a support caddy to which equipment like medical supplies and instruments and the like, can be securely mounted (not shown).

The arm rests can also be positioned inwardly or outwardly to accommodate patients of different sizes.

The tilting of the seat portion of the device 1 is controlled by a linear actuator 16. The lower end of the linear actuator is attached to the seat frame members that are integral with the lower frame of the seat. The upper end of a linear actuator is attached to a bracket that is connected to a control unit. The linear actuator is extended and retracted by means of a shaft within a gear box. Thus, rotation of the actuator will raise or lower the seat—as required for a particular patient.

Similarly, the chest rest, head rest, leg rest, arm rest or the foot rest are each connected to respective actuators which are electrically controlled by the control units housed in the longitudinal rest or elevator columns, and in circuit with the touch control unit. Thus, an operator may individually, selectively and simultaneously achieve the positioning of a patient by moving the plurality of actuators to a desired position as required for a particular patient.

In the drawings and specification, there has been set forth and preferred embodiment of the invention and, although specific terms are employed, they are used in a generic and descriptive sense only. FIGS. 4–63 represent the structural plans and details of constructing and utilizing the invention to enable one skilled in the art to use the invention.

While the device herein described is effectively adapted to fulfill the aforesaid objects, it is to be understood that the invention is not intended to be limited to the specific preferred embodiment of the treatment chair set forth above. Rather, it is to be taken as including all reasonable equivalents within the scope of the following claims:

What is claimed is:

1. An adaptive power operated chair device comprising:

a base assembly;

a central elevator control assembly pivotally secured to said base assembly for vertical pivotal movement relative thereto including a seat support member having a seat portion at its upper end for supporting buttocks of a chair occupant, and a leg support member extending downwardly therefrom for supporting the legs of the occupant, and a foot support member pivotally secured at its rearward end to the forward end of the leg support member for vertical pivotal movement relative thereto, operating means secured between said elevator assembly and said base assembly for pivotally moving said elevator assembly relative to said base assembly, operating means secured between said foot support member and said leg support member for pivotally moving said foot support member relative to said leg support member, a back rest means pivotally secured to said base assembly at the upper end of said central elevator assembly for vertical pivotal movement relative thereto, operating means secured between said back rest means and said base assembly for pivotally moving said back rest means relative to said central elevator assembly and said base assembly, each of said operating means secured to a power supply for operating same, and selective control means operatively connected with said operating means for selectively controlling the movement of each of said operating means independently to provide the occupant with selective positioning of said foot support member, said leg support member, and said back rest means relative to one another and to said base assembly.

2. The adaptive power-operated chair device according to claim 1 further comprising:

a chest rest member pivotally secured at its lower end to the central elevator assembly for vertical pivotal movement relative thereto, a head rest member pivotally secured at its lower end to the central elevator assembly for horizontal pivotal movement thereto, operating means secured between said chest rest member and said head rest member and said central elevator assembly, each of said operating means secured to a power source for operating same, and selective control means connected with said operating means for selectively controlling the movement of each of said operating means independently to provide the occupant with selective positioning of said chest rest member and said head rest member relative to one another, said central elevator assembly and to said base assembly.

3. The adaptive power-operated chair device according to claim 2 including: left and right arm rest means pivotally secured at each lateral side of said chest rest member for independent vertical movement relative thereto, operating means secured between said left and right arm rest means and said chest rest member for pivotally moving each arm rest means independently relative to said chest rest member, and selective control means on said arm rest means for selectively controlling the movement of each said operating means independently to provide the occupant with selective positioning of said central elevator assembly, said chest rest member and said left and right arm rest means relative to one another and to said base assembly.

4. The adaptive power-operated chair device according to claim 1 in which:

said operating means comprises an operable actuator motor assembly, said power means comprises electrical energy, and said control means comprises a series of switches for reversibly conducting such electrical energy to selectively extend or retreat the same.

5. The adaptive power-operated chair device according to claim 4, further comprising at least one additional operable actuator motor assembly.

6. The adaptive power-operated chair device according to claim 1 including a selectively adjustable lumbar support means disposed in said back rest means and operatively connected to said power means and controlled by said control means for selectively engaging the lumbar portion of the back of the chair occupant.

7. The adaptive power-operated chair device according to claim 6 wherein said control means includes a touch screen unit including a plurality of switches, said touch screen unit mounted on a movable means for moving such control means to a location adjacent said power-operated chair, the chair occupant or a caregiver.

8. The adaptive power-operated chair device according to claim 7, further including a micro camera.

9. The adaptive power-operated chair device according to claim 8, further including a audiovisual projection system.

10. The adaptive-power-operated chair device according to claim 7, further comprising a first member base and a second member base, wherein the first member base provides a drive means for selectively moving said first member base, said second member base is including at least one second member wheel and said second member wheel being independently biased from said first member base downwardly towards the floor.

11. The adaptive power-operated chair device according to claim 1 wherein the base assembly includes:

a stationary portion for supporting the chair on a floor, a housing unit mounted over the stationary portion, said stationary portion including ball bearings connected by rods, and operating means to provide swiveling movement of the chair.

* * * * *